US011571733B2

(12) United States Patent
Yoshida et al.

(10) Patent No.: US 11,571,733 B2
(45) Date of Patent: Feb. 7, 2023

(54) BINDING MACHINE

(71) Applicant: MAX CO., LTD., Tokyo (JP)

(72) Inventors: Yusuke Yoshida, Tokyo (JP); Kenichi Arai, Tokyo (JP); Takahiro Ito, Tokyo (JP); Shigeki Shindou, Tokyo (JP)

(73) Assignee: MAX CO., LTD., Tokyo (JP)

( * ) Notice: Subject to any disclaimer, the term of this patent is extended or adjusted under 35 U.S.C. 154(b) by 8 days.

(21) Appl. No.: 16/815,484

(22) Filed: Mar. 11, 2020

(65) Prior Publication Data

US 2020/0290109 A1 Sep. 17, 2020

(30) Foreign Application Priority Data

Mar. 11, 2019 (JP) ..... JP2019-044291
Jun. 3, 2019 (JP) ..... JP2019-103942

(51) Int. Cl.
*B21F 15/04* (2006.01)

(52) U.S. Cl.
CPC ..... *B21F 15/04* (2013.01)

(58) Field of Classification Search
CPC ..... B65B 13/025; B65B 13/18; B65B 13/185; B65B 13/28; B65B 13/285; E04G 21/123; B21F 7/00; B21F 15/04
See application file for complete search history.

(56) References Cited

U.S. PATENT DOCUMENTS 4,362,192 A 12/1982 Furlong et al.
5,983,473 A 11/1999 Yuguchi et al.
2004/0244866 A1 12/2004 Ishikawa et al.
2012/0118176 A1 5/2012 Gregersen
2018/0155940 A1 6/2018 Nagaoka et al.
2018/0161848 A1 6/2018 Itagaki et al.
2018/0207709 A1 7/2018 Kasahara et al.
2021/0114080 A1 4/2021 Itagaki et al.
(Continued)

FOREIGN PATENT DOCUMENTS

EP 3327223 A1 5/2013
EP 3326921 A1 * 5/2018 ..... B65B 13/02
(Continued)

OTHER PUBLICATIONS

The Extended European Search Report mailed in corresponding EP Patent Application No. 20162114.1 dated Dec. 9, 2020 (12 pages).
(Continued)

*Primary Examiner* — Jessica Cahill
*Assistant Examiner* — Bobby Yeonjin Kim
(74) *Attorney, Agent, or Firm* — Weihrouch IP

(57) ABSTRACT

A binding machine includes a wire feeding unit configured to feed two wires to be wound on an object to be bound, a wire guide configured to align the two wires in parallel, a binding unit having an engaging member in which the wires are to be engaged, and the binding unit configured to twist the wires which are wound on the object to be bound and which are engaged in the engaging member, a curl guide configured to curl the wires being fed by the wire feeding unit into a loop shape, an inductive guide configured to guide the wires curled by the curl guide toward the binding unit, and a parallel alignment regulation part configured to guide an alignment direction of the two wires to be engaged with the engaging member in a radial direction of the loop.

10 Claims, 46 Drawing Sheets

(56) References Cited

U.S. PATENT DOCUMENTS

| | | | |
|---|---|---|---|
| 2021/0138527 | A1 | 5/2021 | Itagaki et al. |
| 2021/0387246 | A1 | 12/2021 | Kasahara et al. |

FOREIGN PATENT DOCUMENTS

| | | | | |
|---|---|---|---|---|
| EP | 3326921 | A1 | 5/2018 | |
| JP | H05-3494 | U | 1/1993 | |
| JP | H07-40411 | U | 7/1995 | |
| JP | H09-250205 | A | 9/1997 | |
| JP | 2003-34305 | A | 2/2003 | |
| JP | 2004-332494 | A | 11/2004 | |
| JP | 2013227728 | A | 11/2013 | |
| JP | 5929468 | B2 * | 6/2016 | |
| JP | 2017-024752 | A | 2/2017 | |
| WO | 2017/014268 | A1 | 1/2017 | |
| WO | 2017/014280 | A1 | 1/2017 | |
| WO | WO-2017014266 | A1 * | 1/2017 | ..... B65B 13/02 |

OTHER PUBLICATIONS

The Partial European Search Report mailed in corresponding EP Patent Application No. 20162114.1 dated Aug. 10, 2020 (12 pages).

* cited by examiner

BINDING MACHINE

CROSS-REFERENCE TO RELATED APPLICATIONS

This application is based upon and claims the benefit of priority from prior Japanese patent applications No. 2019-044291 filed on Mar. 11, 2019 and No. 2019-103942 filed on Jun. 3, 2019, the entire contents of which are incorporated herein by reference.

TECHNICAL FIELD

The present disclosure relates to a binding machine configured to bind an object to be bound such as a reinforcing bar with a wire.

BACKGROUND ART

In the related art, a binding machine called as a reinforcing bar binding machine configured to wind a wire on two or more reinforcing bars, and to bind the two or more reinforcing bars with the wire by twisting the wire wound on the reinforcing bars is suggested.

The binding machine causes the wire fed by a drive force of a motor to pass through a guide called as a curl guide or the like configured to curl the wire, thereby winding the wire around the reinforcing bars. The curled wire is guided to a binding unit configured to twist a wire by a guide called as an inductive guide or the like and the wire wound around the reinforcing bars is twisted by the binding unit, so that the reinforcing bars is bound with the wire.

In the binding machine, in order to increase a binding force between the reinforcing bars, technology of binding the reinforcing bars with two wires is suggested (for example, refer to WO2017/014280).

In the related art, suggested is a reinforcing bar binding machine including a binding wire feeding mechanism configured to deliver a wire wound on a reel and to wind the same on a reinforcing bar, a gripping mechanism configured to grip the wire wound on the reinforcing bar, and a binding wire twisting mechanism configured to twist the wire by rotatively driving the gripping mechanism. In the reinforcing bar binding machine, the binding wire feeding mechanism, the gripping mechanism and the binding wire twisting mechanism are sequentially actuated by a trigger operation, so that a binding operation of one cycle is performed (for example, refer to JP-A-2003-34305).

For the binding machine, suggested is a means for winding the wire on the reinforcing bar and improving a binding force by gripping a tip end of the wire wound on the reinforcing bar with the gripping mechanism and returning a surplus wire.

SUMMARY OF DISCLOSURE

In the binding unit configured to twist the wires, while engaging two wires between a pair of engaging members configured to contact/separate each other, when the two wires are aligned in parallel in a contact/separation direction of the engaging members, the two wires are engaged in a state in which an interval corresponding to the two wires is formed between the pair of engaging members. Thereby, a load to be applied to the engaging members increases.

The present disclosure has been made in view of the above situations, and an object thereof is to provide a binding machine capable of guiding an alignment direction of two wires.

In order to further improve the binding force, a binding machine in which two wires are used is also suggested. In order to grip the two wires with clamping plates, it is possible to securely grip the two wires if the two wires are aligned in parallel with intersecting with an opening/closing direction of the clamping plates.

In contrast, if the two wires are gripped by the clamping plates in such an aspect that the two wires are aligned in parallel in the opening/closing direction of the clamping plates, the clamping plates cannot be closed to a predetermined position, so that a load to be applied to the clamping plates increases. Also, a configuration of detecting an increase in load to be applied to the clamping plates and stopping the binding operation deteriorates the operation efficiency.

The present disclosure has been made in view of the above situations, and an object thereof is to provide a binding machine capable of releasing a state in which two wires are aligned in parallel in a predetermined direction.

In order to achieve the above object, the present disclosure provides a binding machine including a wire feeding unit configured to feed two wires to be wound on an object to be bound, a wire guide configured to align the two wires in parallel, a binding unit having an engaging member in which the wires are to be engaged, and configured to twist the wires wound on the object to be bound and engaged in the engaging member, a curl guide configured to curl the wires being fed by the wire feeding unit into a loop shape, an inductive guide configured to guide the wires curled by the curl guide toward the binding unit, and a parallel alignment regulation part configured to guide an alignment direction of the two wires to be engaged with the engaging member in a radial direction of the loop.

The two wires guided to the binding unit are guided in a direction in which the wires are aligned in parallel in a direction intersecting with a contact/separation direction of the engaging member, and a direction in which the two wires are aligned becomes a direction that is suitable for engagement by the engaging member.

In order to achieve the above object, the present disclosure provides a binding machine including a wire feeding unit configured to feed two wires to be wound on an object to be bound, a binding unit including at least one pair of openable/closable engaging members and configured to twist the two wires engaged by closing the pair of engaging members, and a control unit configured to execute an operation of releasing a parallel alignment state of the two wires in an opening/closing direction of the pair of engaging members.

Also, the present disclosure provides a binding machine including a wire feeding unit configured to feed two wires to be wound on an object to be bound, a binding unit including at least one pair of openable/closable engaging members and configured to twist the two wires engaged by closing the pair of engaging members, and a control unit configured to execute an operation of closing and then opening the pair of engaging members, and again closing the pair of engaging members before twisting the wires by the binding unit.

The two wires can be engaged between the pair of engaging members in such an aspect that the parallel alignment state of the two wires in the opening/closing direction of the pair of engaging members is released and the two wires are aligned in parallel with intersecting with the opening/closing direction of the pair of engaging members.

In the present disclosure, while engaging the two wires between a pair of engaging members configured to contact/separate each other, the two wires are engaged in a state in which an interval corresponding to one wire is formed between the pair of engaging members. Thereby, a load to be applied to the engaging members is applied to securely engage the two wires W.

According to the present disclosure, since the two wires can be engaged between the pair of engaging members in such an aspect that the two wires are aligned in parallel with intersecting with the opening/closing direction of the pair of engaging members, it is possible to reduce a load to be applied to the binding member. Also, since it is possible to continuously perform the binding operation, it is possible to suppress deterioration in operation efficiency.

DETAILED DESCRIPTION OF EMBODIMENTS

Hereinbelow, an example of a reinforcing bar binding machine as an embodiment of the binding machine of the present disclosure will be described with reference to the drawings.

<Example of Reinforcing Bar Binding Machine>

Figure 1:
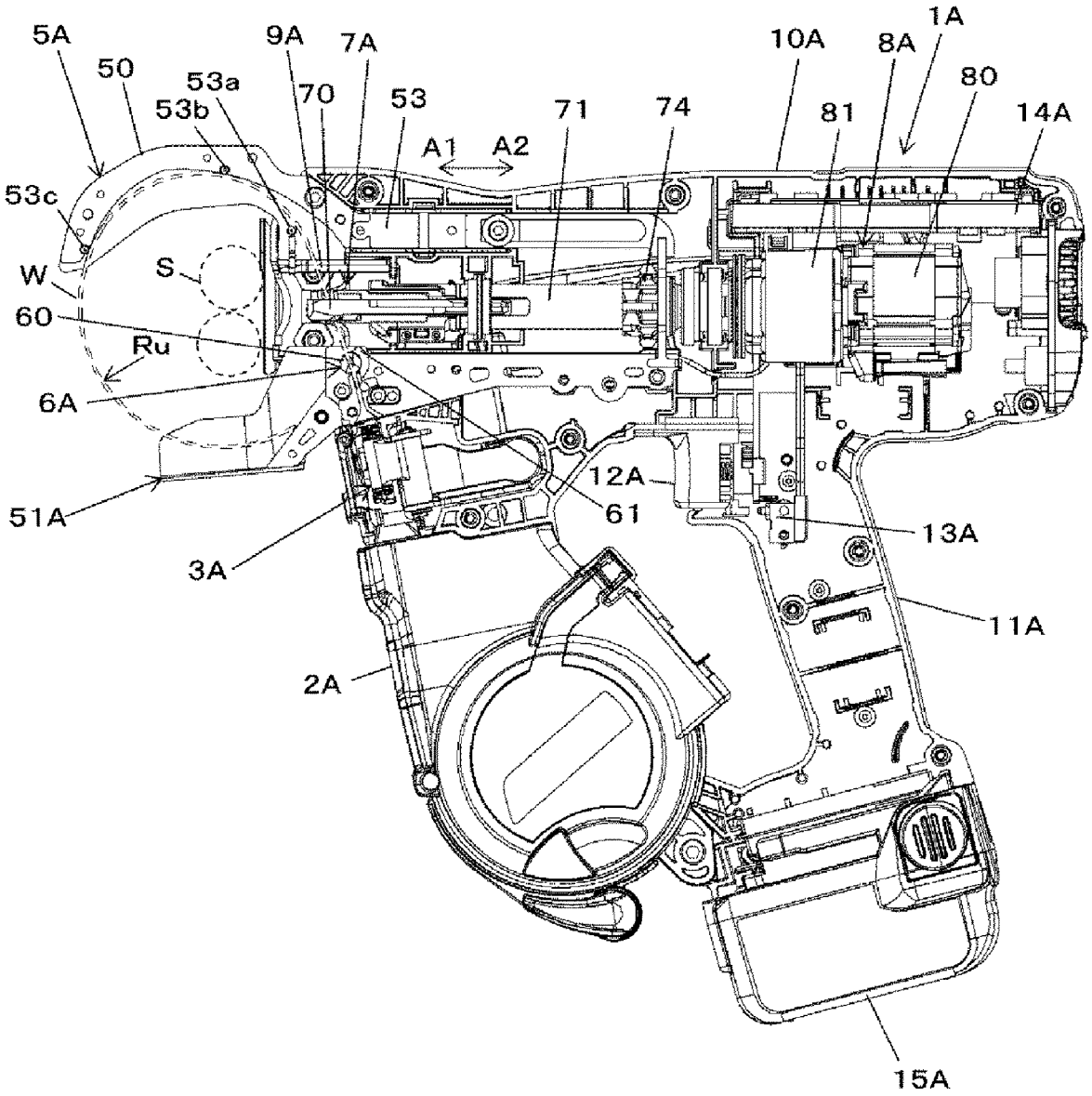
FIG. 1 is a configuration view depicting an example of an entire configuration of a reinforcing bar binding machine, as seen from a side.
Figure 2:
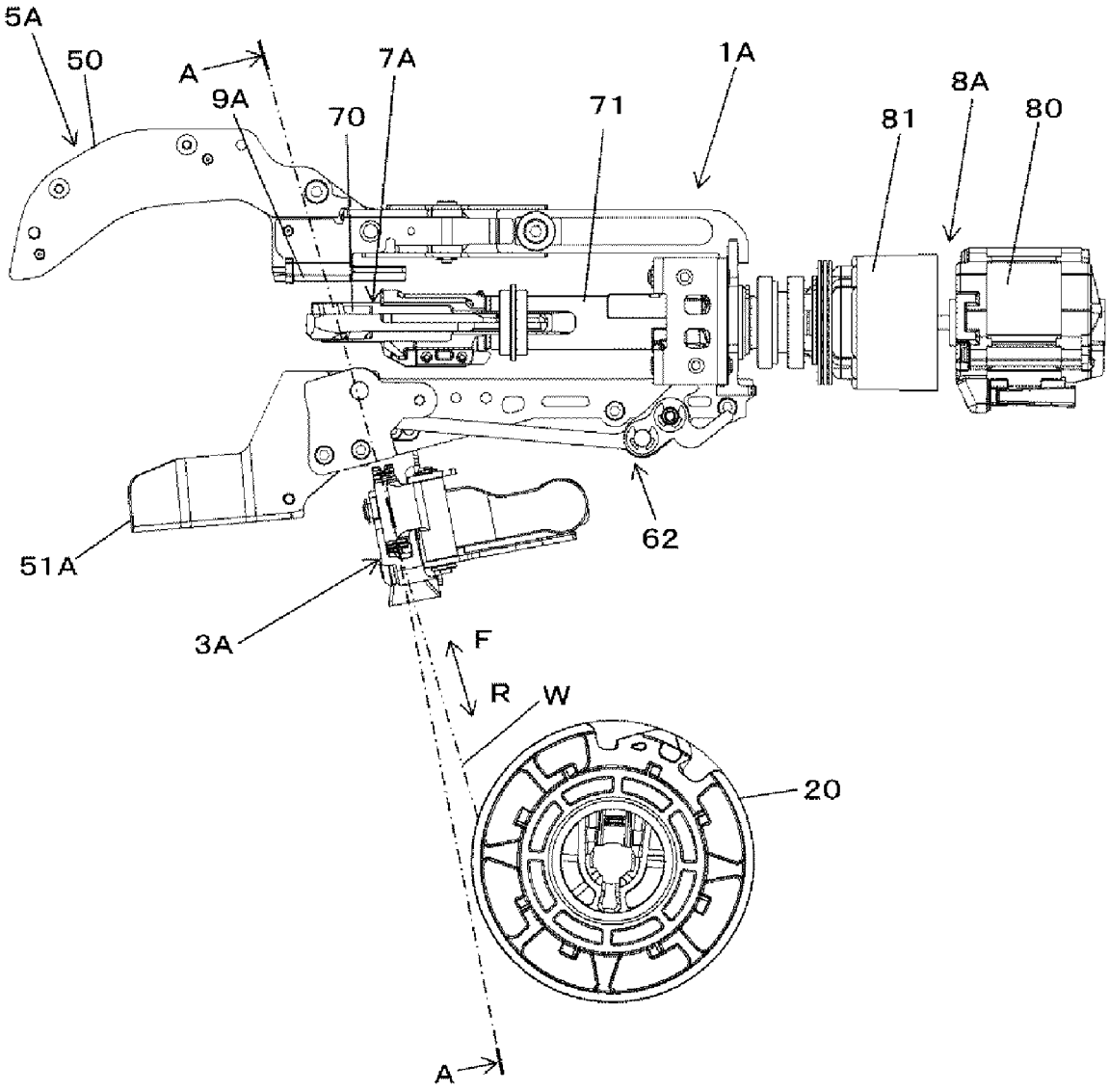
FIG. 2 is a configuration view depicting an example of a main configuration of the reinforcing bar binding machine, as seen from a side.
Figure 3:
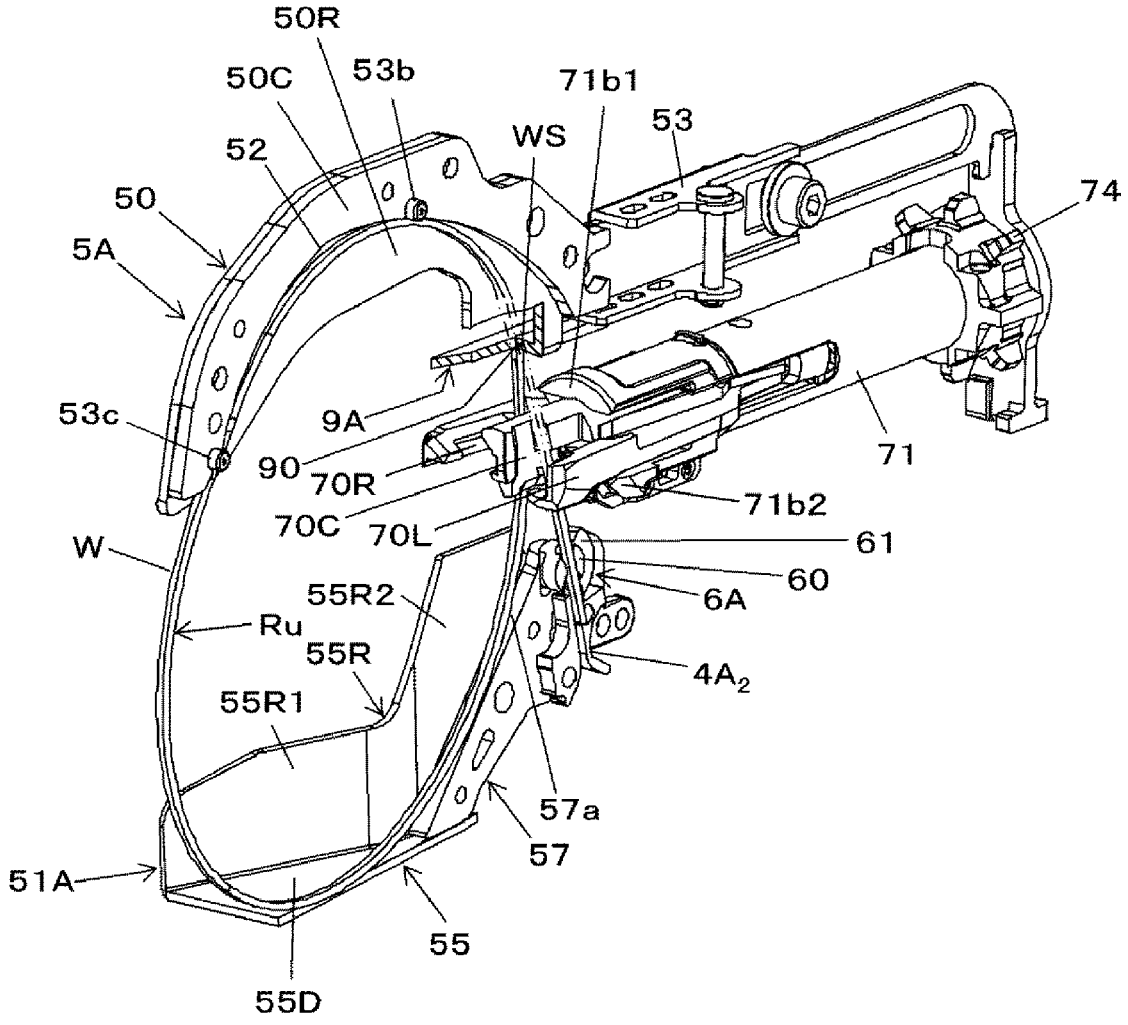
FIG. 3 is a partially broken perspective view depicting an example of the main configuration of the reinforcing bar binding machine.
Figure 4A:
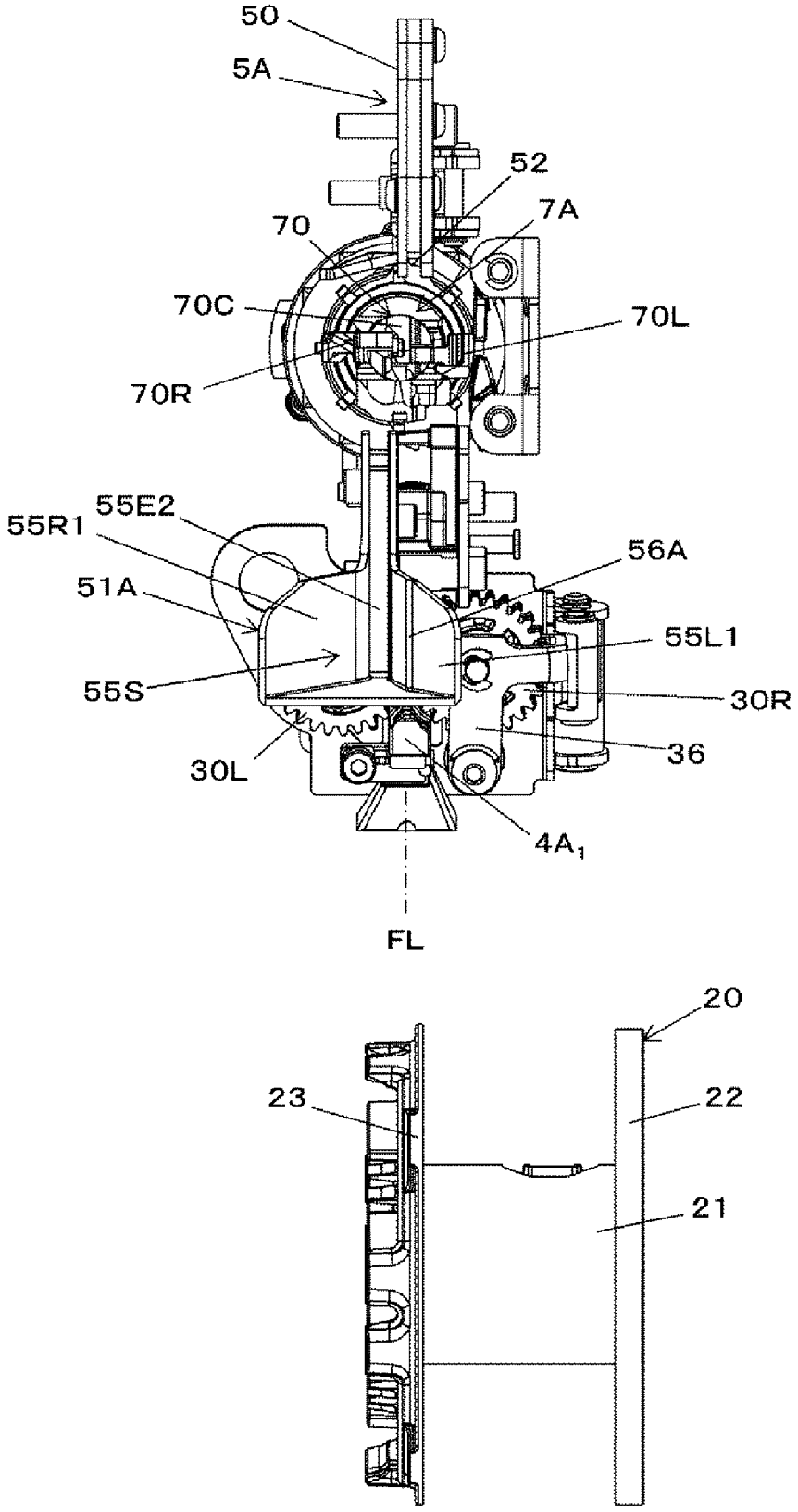
FIG. 4A is a configuration view depicting an example of the entire configuration of the reinforcing bar binding machine, as seen from front.
Figure 4B:
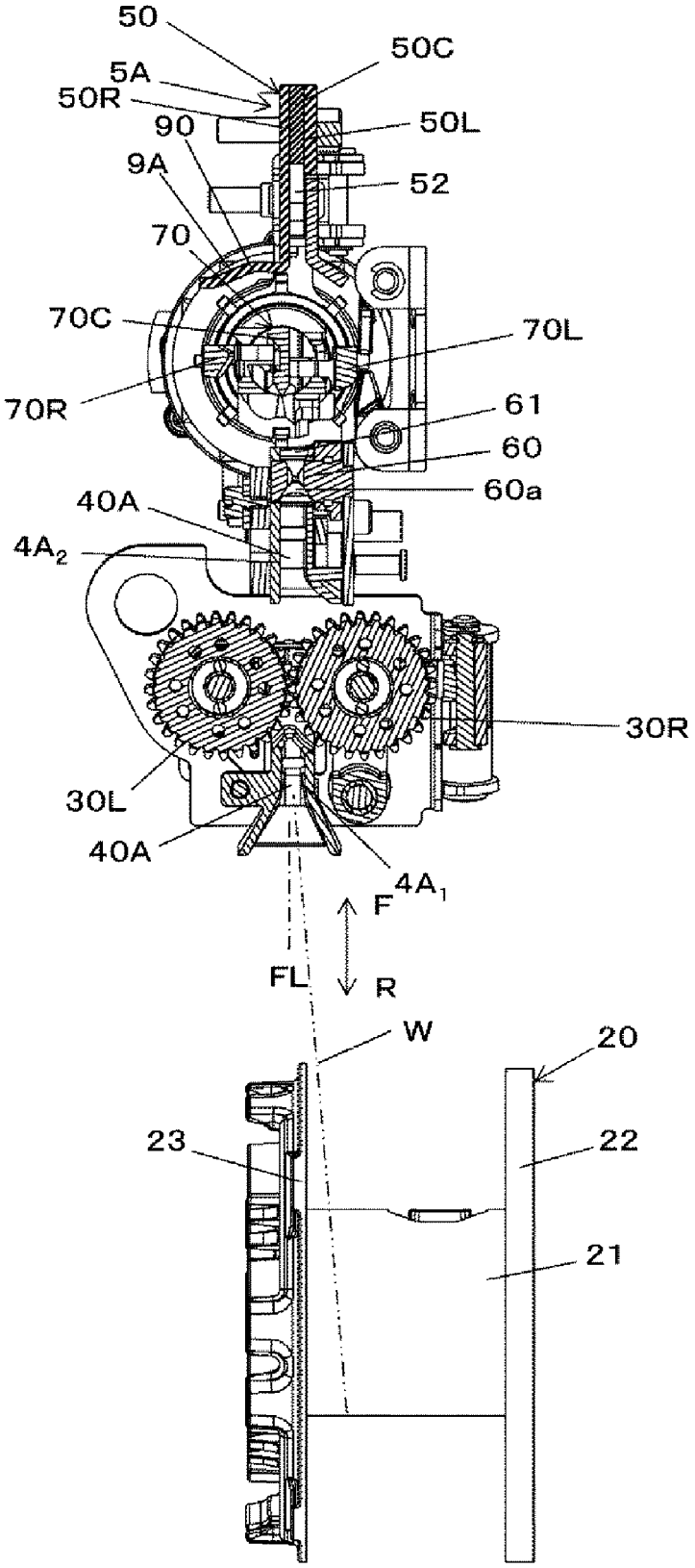
FIG. 4B is a sectional view taken along a line A-A in FIG. 2.
Figure 5:
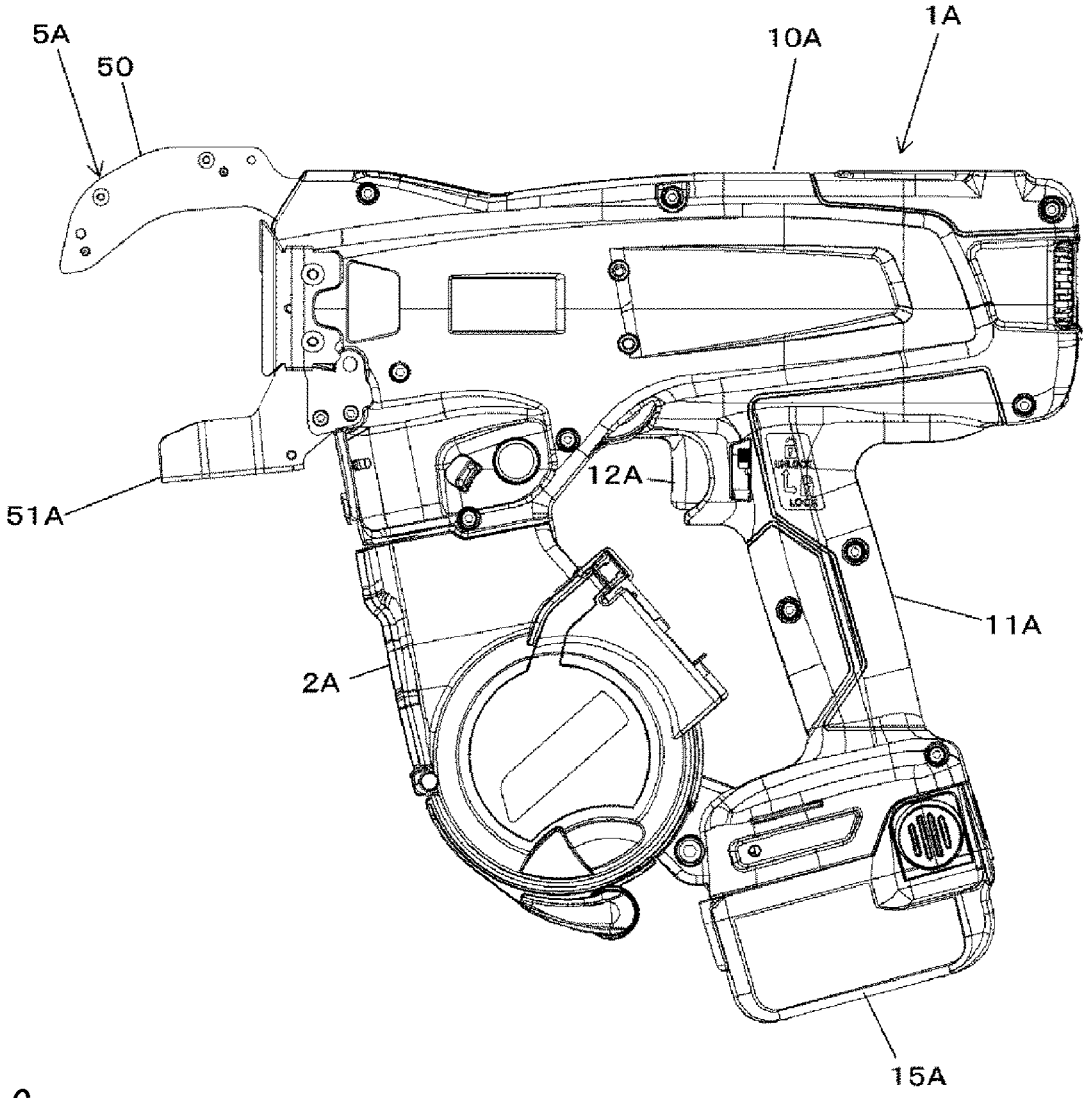
FIG. 5 is a side view depicting an outer shape of the reinforcing bar binding machine.
Figure 6:
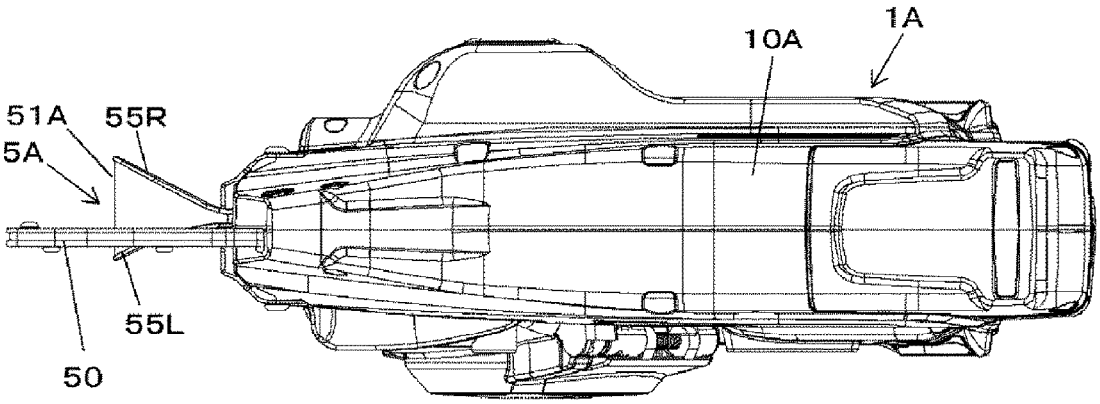
FIG. 6 is a top view depicting the outer shape of the reinforcing bar binding machine.
Figure 7:
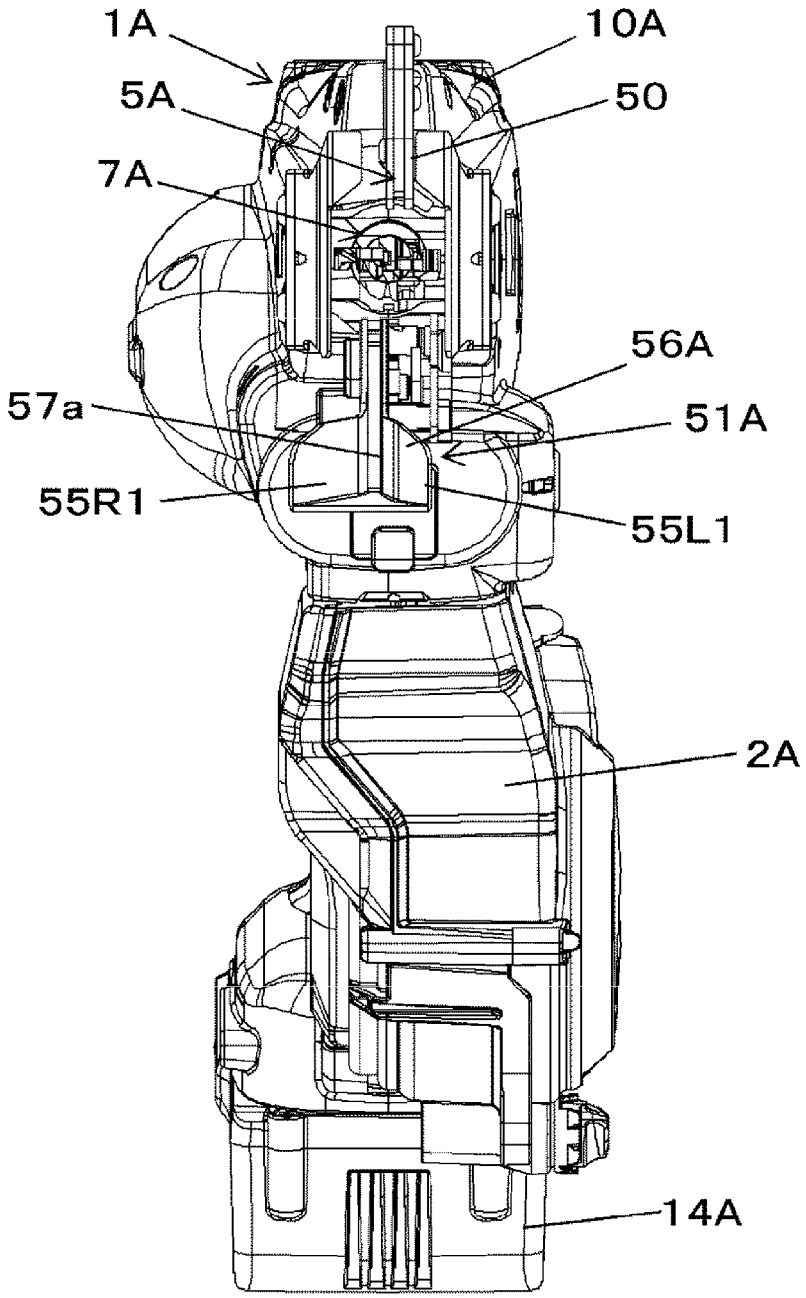
FIG. 7 is a front view depicting the outer shape of the reinforcing bar binding machine.

FIG. 1 is a view depicting an example of an entire structure of a reinforcing bar binding machine, as seen from a side, FIG. 2 is a view depicting an example of a main structure of the reinforcing bar binding machine, as seen from a side, FIG. 3 is a partially broken perspective view depicting an example of the main structure of the reinforcing bar binding machine, FIG. 4A is a view depicting an example of the entire structure of the reinforcing bar binding machine, as seen from front, and FIG. 4B is a sectional view taken along a line A-A in FIG. 2. Also, FIG. 5 is a side view depicting an outer shape of the reinforcing bar binding machine, FIG. 6 is a top view depicting the outer shape of the reinforcing bar binding machine, and FIG. 7 is a front view depicting the outer shape of the reinforcing bar binding machine.

A reinforcing bar binding machine 1A is configured to feed wires W in a forward direction denoted with an arrow F, to wind the wires around reinforcing bars S, which are an object to be bound, to feed the wires W wound around the reinforcing bars S in a reverse direction denoted with an arrow R, to wind the wires on the reinforcing bars S, and to twist the wires W, thereby binding the reinforcing bars S with the wires W.

In order to realize the above functions, the reinforcing bar binding machine 1A includes a magazine 2A in which the wires W are accommodated, and a wire feeding unit 3A configured to feed the wires W. Also, the reinforcing bar binding machine 1A includes a first wire guide $4A_1$ configured to guide the wires W that are to be fed into the wire feeding unit 3A and a second wire guide $4A_2$ configured to guide the wires W that are to be delivered from the wire feeding unit 3A, in an operation of feeding the wires W in the forward direction by the wire feeding.

Also, the reinforcing bar binding machine 1A includes a curl forming unit 5A configured to form a path along which the wires W fed by the wire feeding unit 3A are to be wound around the reinforcing bars S. Also, the reinforcing bar binding machine 1A includes a cutting unit 6A configured to cut the wires W wound on the reinforcing bars S during an operation of feeding the wires Win the reverse direction by the wire feeding unit 3A, a binding unit 7A configured to twist the wires W wound on the reinforcing bars S, and a drive unit 8A configured to drive the binding unit 7A.

The magazine 2A is an example of an accommodation unit in which a reel 20 on which the long wires W are wound to be reeled out is rotatably and detachably accommodated. For the wire W, a wire made of a plastically deformable metal wire, a wire having a metal wire covered with a resin, a twisted wire and the like are used.

The reel 20 has a cylindrical hub part 21 on which the wires W are wound, and a pair of flange parts 22 and 23 provided integrally on both axial ends of the hub part 21. The flange parts 22 and 23 each have a substantially circular plate shape having a larger diameter than the hub part 21, and are provided coaxially with the hub part 21. The reel 20 is configured so that two wires W are wound on the hub part 21 and can be reeled out from the reel 20 at the same time.

As shown in FIGS. 4A and 4B, the magazine 2A is mounted with the reel 20 with being offset in one direction along an axis direction of the reel 20 following an axial direction of the hub part 21 with respect to a feeding path FL of the wires W defined by the first wire guide $4A_1$ and the second wire guide $4A_2$. In the present example, the entire hub part 21 of the reel 20 is offset in one direction with respect to the feeding path FL of the wires W.

Figure 8A:
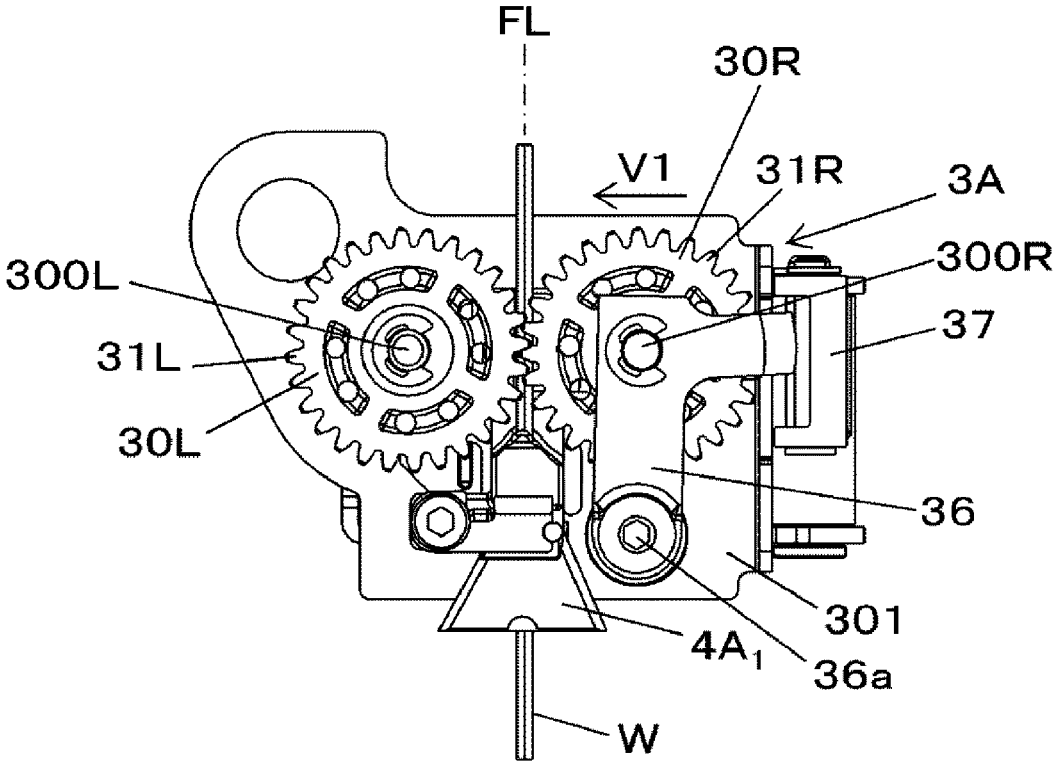
FIG. 8A is a front view depicting an example of a wire feeding unit.
Figure 8B:
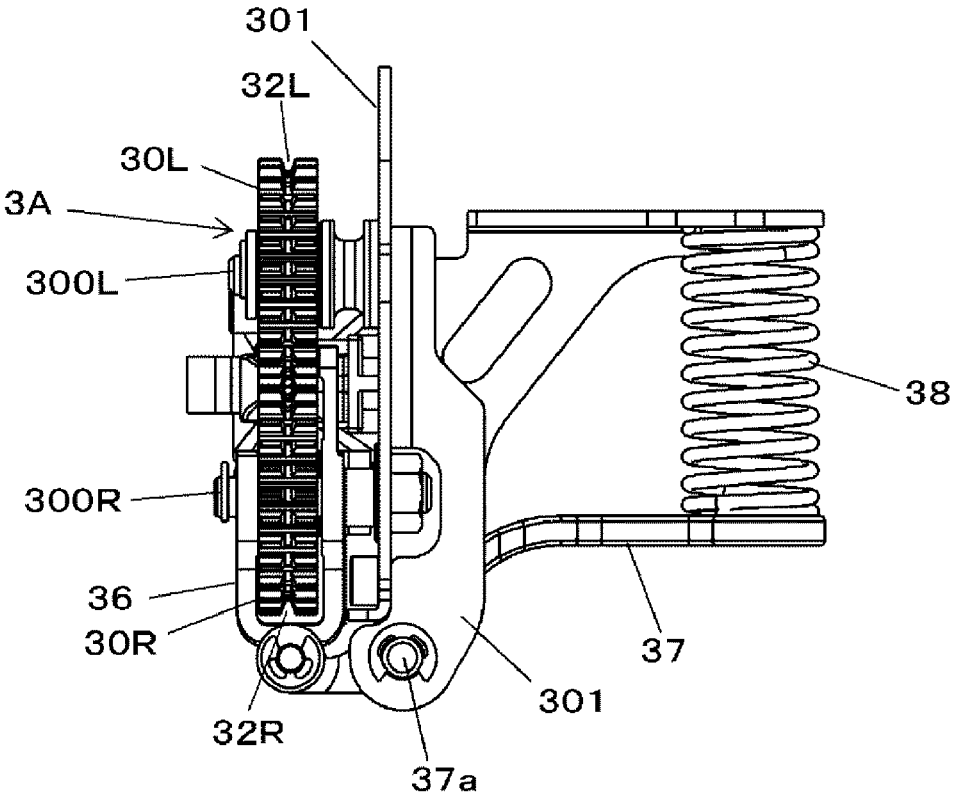
FIG. 8B is a plan view depicting an example of the wire feeding unit.

FIG. 8A is a front view depicting an example of the wire feeding unit, and FIG. 8B is a plan view depicting an example of the wire feeding unit. Subsequently, a structure of the wire feeding unit 3A is described. The wire feeding unit 3A includes, as a pair of feeding members configured to sandwich and feed two wires W aligned in parallel, a first feeding gear 30L and a second feeding gear 30R configured to feed the wires W by a rotating operation.

The first feeding gear 30L has a tooth part 31L configured to transmit a drive force. In the present example, the tooth part 31L has a spur gear shape, and is formed on an entire circumference of an outer periphery of the first feeding gear 30L. Also, the first feeding gear 30L has a groove portion 32L into which the wire W is to enter. In the present example, the groove portion 32L is a concave portion of which a sectional shape is a substantial V shape, and is formed on the entire circumference of the outer periphery of the first feeding gear 30L along a circumferential direction.

The second feeding gear 30R has a tooth part 31R configured to transmit a drive force. In the present example, the tooth part 31R has a spur gear shape, and is formed on an entire circumference of an outer periphery of the second feeding gear 30R. Also, the second feeding gear 30R has a groove portion 32R into which the wire W is to enter. In the present example, the groove portion 32R is a concave portion of which a sectional shape is a substantial V shape, and is formed on the entire circumference of the outer periphery of the second feeding gear 30R along a circumferential direction.

In the wire feeding unit 3A, the groove portion 32L of the first feeding gear 30L and the groove portion 32R of the second feeding gear 30R are arranged to face each other, so that the first feeding gear 30L and the second feeding gear 30R are provided with the feeding path FL of the wires W defined by the first wire guide $4A_1$ and the second wire guide $4A_2$ being interposed therebetween. The feeding path FL of the wires W becomes a width center position of the wire feeding unit 3A configured by the pair of first feeding gear 30L and the second feeding gear 30R. As shown in FIG. 4B and the like, the reel 20 is arranged with being offset in one direction with respect to the width center position of the wire feeding unit 3A.

The wire feeding unit 3A is configured so that the first feeding gear 30L and the second feeding gear 30R can be displaced toward and away from each other. In the present example, the second feeding gear 30R is displaced relative to the first feeding gear 30L.

The first feeding gear 30L is rotatably supported to a support member 301 of the wire feeding unit 3A by a shaft 300L. Also, the wire feeding unit 3A includes a first displacement member 36 configured to displace the second feeding gear 30R toward and away from the first feeding gear 30L. The first displacement member 36 is configured to rotatably support the second feeding gear 30R to one end portion-side by a shaft 300R. Also, the other end portion of the first displacement member 36 is supported to the support member 301 so as to be rotatable about a shaft 36*a* serving as a support point.

The wire feeding unit 3A includes a second displacement member 37 configured to displace the first displacement member 36. The second displacement member 37 is coupled on one end portion-side to the first displacement member 36. Also, the second displacement member 37 is coupled on the other end portion-side to a spring 38. Also, the second displacement member 37 is supported to the support member 301 between one end portion-side and the other end portion-side so as to be rotatable about a shaft 37*a* serving as a support point.

The first displacement member 36 is pressed via the second displacement member 37 by the spring 38, and is displaced in a direction of an arrow V1 by a rotating operation about the shaft 36*a* serving as a support point. Thereby, the second feeding gear 30R is pressed toward the first feeding gear 30L by a force of the spring 38.

In a state in which the two wires W are mounted between the first feeding gear 30L and the second feeding gear 30R, the wires W are sandwiched between the groove portion 32L of the first feeding gear 30L and the groove portion 32R of the second feeding gear 30R in such an aspect that one wire W is put in the groove portion 32L of the first feeding gear 30L and the other wire W is put in the groove portion 32R of the second feeding gear 30R.

In the wire feeding unit 3A, the tooth part 31L of the first feeding gear 30L and the tooth part 31R of the second feeding gear 30R are in mesh with each other in a state in which the wires W are sandwiched between the groove portion 32L of the first feeding gear 30L and the groove portion 32R of the second feeding gear 30R. Thereby, the drive force is transmitted between the first feeding gear 30L and the second feeding gear 30R by rotation.

In the wire feeding unit 3A of the present example, the first feeding gear 30L is a drive side, and the second feeding gear 30R is a driven side.

The first feeding gear 30L is configured to rotate as a rotating operation of a feeding motor 33 (described below) is transmitted thereto. The second feeding gear 30R is configured to rotate in conjunction with the first feeding gear 30L as a rotating operation of the first feeding gear 30L is transmitted thereto through engagement between the tooth part 31L and the tooth part 31R.

Thereby, the wire feeding unit 3A is configured to feed the wires W sandwiched between the first feeding gear 30L and the second feeding gear 30R along an extension direction of the wires W. In the structure of feeding the two wires W, the two wires W are fed with being aligned in parallel by a frictional force that is generated between the groove portion 32L of the first feeding gear 30L and one wire W, a frictional force that is generated between the groove portion 32R of the second feeding gear 30R and the other wire W, and a frictional force that is generated between one wire W and the other wire W.

The wire feeding unit 3A is configured so that the rotation directions of the first feeding gear 30L and the second feeding gear 30R are switched and the feeding direction of the wires W is switched between the forward and reverse directions by switching the rotation direction of the feeding motor 33 between the forward and reverse directions.

Subsequently, the wire guide configured to guide the feeding of the wires W is described. As shown in FIG. 4B, the first wire guide $\mathbf{4}A_1$ is arranged upstream of the first feeding gear 30L and the second feeding gear 30R with respect to the feeding direction of the wires W to be fed in the forward direction. Also, the second wire guide $\mathbf{4}A_2$ is arranged downstream of the first feeding gear 30L and the second feeding gear 30R with respect to the feeding direction of the wires W to be fed in the forward direction.

The first wire guide $\mathbf{4}A_1$ and the second wire guide $\mathbf{4}A_2$ each have a guide hole 40A through which the wires W are to pass. The guide hole 40A has a shape for regulating a radial position of the wire W. In the reinforcing bar binding machine 1A, a path of the wires W that are fed by the wire feeding unit 3A is regulated by the curl forming unit 5A, so that a locus of the wires W becomes a loop Ru as shown with a broken line in FIG. 1 and the wires W are thus wound around the reinforcing bars S.

When a direction intersecting with a radial direction of the loop Ru to be formed by the wires W is set as an axial direction, the guide holes 40A of the first wire guide $\mathbf{4}A_1$ and the second wire guide $\mathbf{4}A_2$ are respectively formed so that the two wires W are to pass therethrough with being aligned in parallel along the axial direction of the loop Ru. In the meantime, the direction in which the two wires W are aligned in parallel is also a direction in which the first feeding gear 30L and the second feeding gear 30R are arranged.

The first wire guide $\mathbf{4}A_1$ and the second wire guide $\mathbf{4}A_2$ have the guide holes 40A provided on the feeding path L of the wires W to pass between the first feeding gear 30L and the second feeding gear 30R. The first wire guide $\mathbf{4}A_1$ is configured to guide the wires W to pass through the guide hole 40A to the feeding path L between the first feeding gear 30L and the second feeding gear 30R.

The first wire guide $\mathbf{4}A_1$ and the second wire guide $\mathbf{4}A_2$ have a wire introduction part, respectively, which is provided upstream of the guide hole 40A with respect to the feeding direction of the wires W to be fed in the forward direction and has a tapered shape of which an opening area is larger than a downstream side, such as a conical shape, a pyramid shape or the like. Thereby, the wires W can be easily introduced into the first wire guide $\mathbf{4}A_1$ and the second wire guide $\mathbf{4}A_2$.

Subsequently, the curl forming unit 5A configured to form the feeding path of the wires W along which the wires W are to be wound around the reinforcing bars S is described. The curl forming unit 5A includes a curl guide 50 configured to curl the wires W that are fed by the first feeding gear 30L and the second feeding gear 30R, and an inductive guide 51A configured to guide the wires W curled by the curl guide 50 toward the binding unit 7A.

The curl guide 50 has a guide groove 52 configuring the feeding path of the wires W, and a first guide pin 53*a*, a second guide pin 53*b* and a third guide pin 53*c* serving as a guide member for curling the wires W in cooperation with the guide groove 52. The curl guide 50 has such a structure that a guide plate 50L, a guide plate 50C and a guide plate 50R are stacked, and a guide surface of the guide groove 52 is configured by the guide plate 50C. Also, sidewall surfaces that are upright from the guide surface of the guide groove 52 is configured by the guide plates 50L and 50R.

The first guide pin 53*a* is provided on an introduction part-side of the curl guide 50, to which the wires W being fed in the forward direction by the first feeding gear 30L and the second feeding gear 30R are introduced. The first guide pin 53*a* is arranged on a radially inner side of the loop Ru to be formed by the wires W with respect to the feeding path of the wires W configured by the guide groove 52. The first guide pin 53*a* is configured to regulate the feeding path of the wires W so that the wires W being fed along the guide groove 52 do not enter the radially inner side of the loop Ru to be formed by the wires W.

The second guide pin 53*b* is provided between the first guide pin 53*a* and the third guide pin 53*c*. The second guide pin 53*b* is arranged on a radially outer side of the loop Ru to be formed by the wires W with respect to the feeding path of the wires W configured by the guide groove 52. A part of a circumferential surface of the second guide pin 53*b* protrudes from the guide groove 52. Thereby, the wires W that are guided by the guide groove 52 come into contact with the second guide pin 53*b* at a part at which the second guide pin 53*b* is provided.

The third guide pin 53*c* is provided on a discharge part-side of the curl guide 50, from which the wires W being fed in the forward direction by the first feeding gear 30L and the second feeding gear 30R are discharged. The third guide pin 53*c* is arranged on a radially outer side of the loop Ru to be formed by the wires W with respect to the feeding path of the wires W configured by the guide groove 52. A part of a circumferential surface of the third guide pin 53*c* protrudes from the guide groove 52. Thereby, the wires W that are guided by the guide groove 52 come into contact with the third guide pin 53*c* at a part at which the third guide pin 53*c* is provided.

The curl forming unit 5A includes a retraction mechanism 53 configured to retract the first guide pin 53*a*. The retraction mechanism 53 is configured to retract the first guide pin 53*a* from a moving path of the wires W wound on the reinforcing bars S by an operation of moving laterally the first guide pin 53*a* with respect to an axial direction of the first guide pin 53*a* to feed the wires W in the reverse direction by the first feeding gear 30L and the second feeding gear 30R.

Subsequently, an operation of curling the wires W is described. The wires W that are fed in the forward direction by the first feeding gear 30L and the second feeding gear 30R are curled in a loop shape as the radial position of the loop Ru to be formed by the wires W is regulated at least at three points of two points on the radially outer side of the loop Ru to be formed by the wires W and one point on the radially inner side between the two points.

In the present example, a radially outer position of the loop Ru to be formed by the wires W is regulated at two points of the second wire guide 4$A_2$ provided upstream of the first guide pin 53*a* and the third guide pin 53*c* provided downstream of the first guide pin 53*a* with respect to the feeding direction of the wires W that are fed in the forward direction. Also, a radially inner position of the loop Ru to be formed by the wires W is regulated by the first guide pin 53*a*. Thereby, the wires W that are fed in the forward direction by the first feeding gear 30L and the second feeding gear 30R are curled in a loop shape.

In the meantime, in the radially outer position of the loop Ru to be formed by the wires W, the guide groove 52 in a position in which the wires W being fed to the third guide pin 53*c* is contacted is provided with the second guide pin 53*b*, so that the wear of the guide groove 52 can be prevented.

Figure 9A:
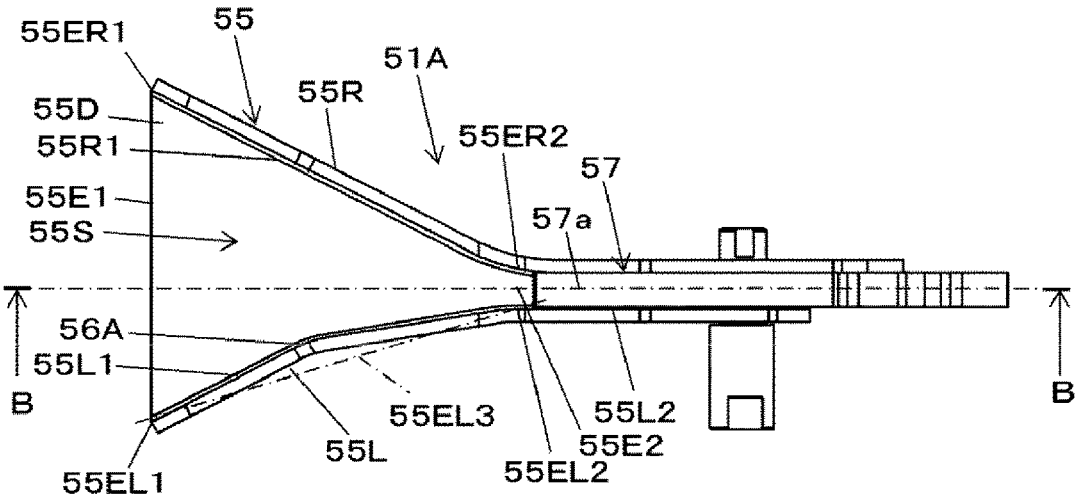
FIG. 9A is a plan view depicting an inductive guide of a first embodiment.
Figure 9B:
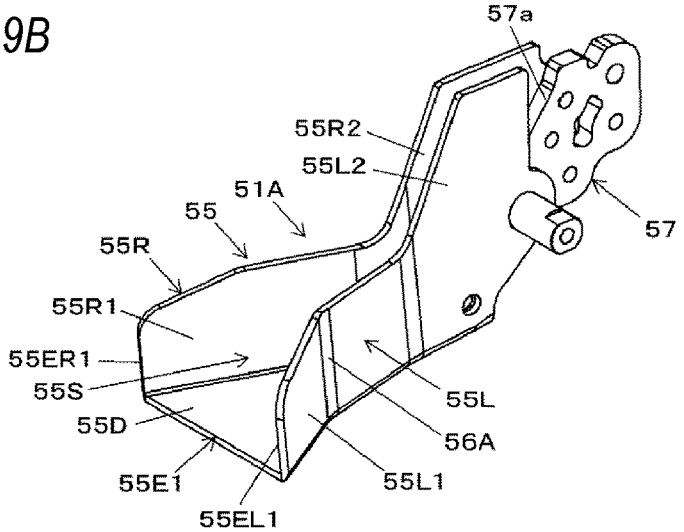
FIG. 9B is a perspective view depicting the inductive guide of the first embodiment.
Figure 9C:
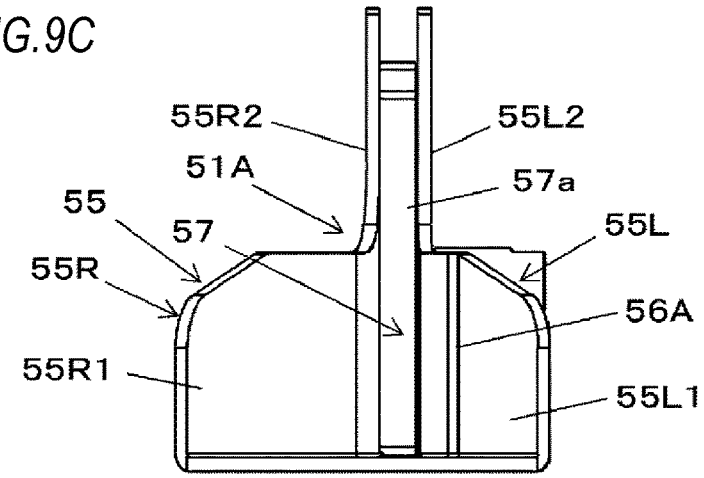
FIG. 9C is a front view depicting the inductive guide of the first embodiment.
Figure 9D:
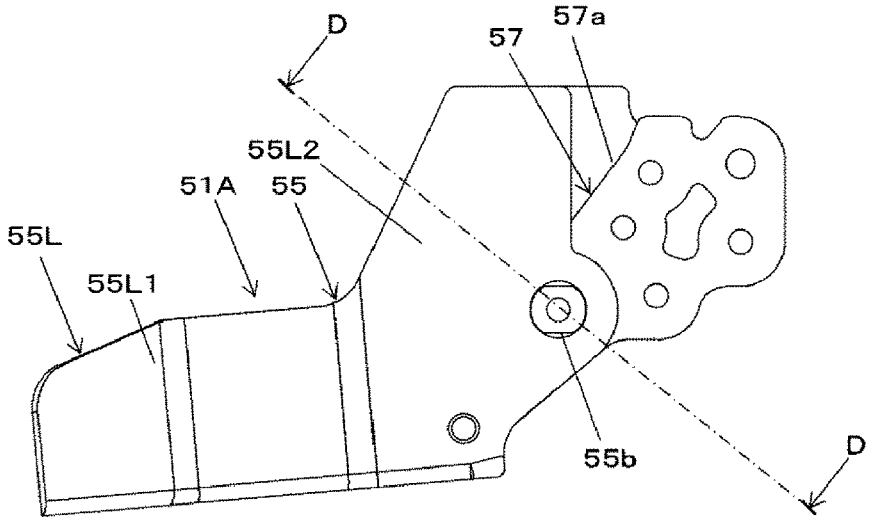
FIG. 9D is a side view depicting the inductive guide of the first embodiment.
Figure 9E:
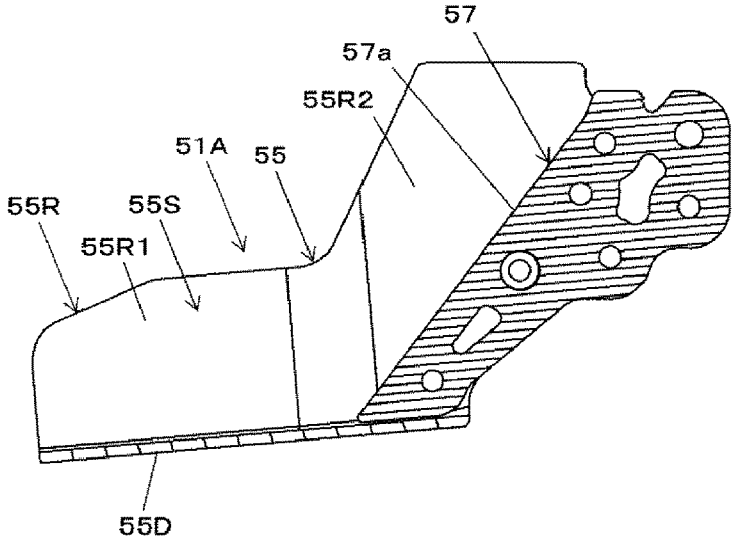
FIG. 9E is a sectional view taken along a line B-B in FIG. 9A.
Figure 9F:
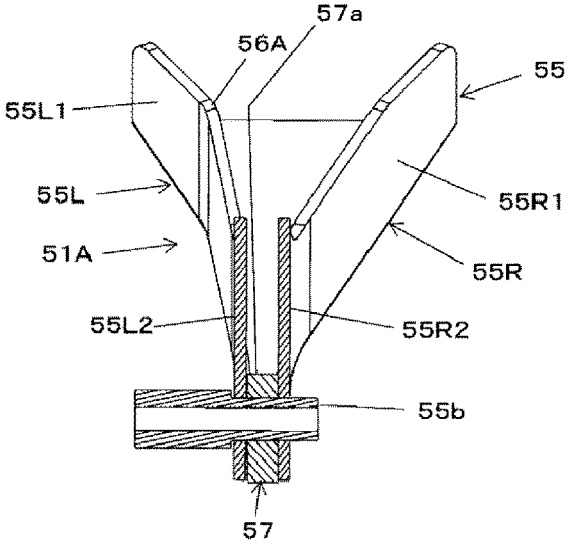
FIG. 9F is a sectional view taken along a line D-D in FIG. 9D.
Figure 9G:
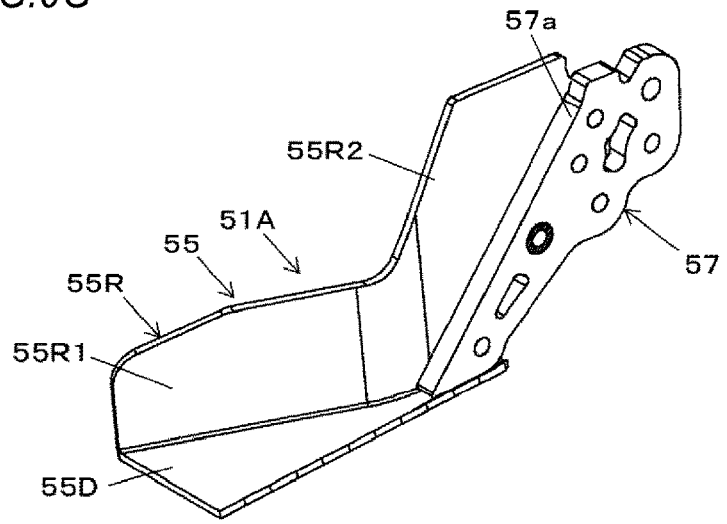
FIG. 9G is a broken perspective view depicting the inductive guide of the first embodiment.

FIG. 9A is a plan view depicting an inductive guide of a first embodiment, FIG. 9B is a perspective view depicting the inductive guide of the first embodiment, FIG. 9C is a front view depicting the inductive guide of the first embodiment, and FIG. 9D is a side view depicting the inductive guide of the first embodiment. Also, FIG. 9E is a sectional view taken along a line B-B in FIG. 9A, FIG. 9F is a sectional view taken along a line D-D in FIG. 9D, and FIG. 9G is a broken perspective view depicting the inductive guide of the first embodiment.

Subsequently, an inductive guide 51A of a first embodiment is described. As shown in FIG. 4A, the inductive guide 51A is provided in a position offset in the other direction that is an opposite direction to the one direction in which the reel 20 is offset, with respect to the feeding path FL of the wires W defined by the first wire guide 4$A_1$ and the second wire guide 4$A_2$.

The inductive guide 51A has a first guide part 55 configured to regulate an axial position of the loop Ru to be formed by the wires W curled by the curl guide 50 and a second guide part 57 configured to regulate a radial position of the loop Ru to be formed by the wires W.

The first guide part 55 is provided on an introduction-side to which the wires W curled by the curl guide 50 are to be introduced, with respect to the second guide part 57. The first guide part 55 has a side surface part 55L provided on one side that is a side on which the reel 20 is positioned with being offset in one direction. Also, the first guide part 55 has a side surface part 55R facing the side surface part 55L and provided on the other side that is a side located in an opposite direction to one direction in which the reel 2 is offset. Also, the first guide part 55 has a bottom surface part 55D on which the side surface part 55L is erected on one side thereof and the side surface part 55R is erected on the other side thereof, the bottom surface part 55D connecting the side surface part 55L and the side surface part 55R.

The second guide part 57 has a guide surface 57*a* provided on a radially outer side of the loop Ru to be formed by the wires W and configured by a surface extending toward the binding unit 7A along the feeding direction of the wires W.

The side surface part 55L on one side of the first guide part 55 has a first guiding part 55L1 configured to guide the wires W to the guide surface 57*a* of the second guide part 57 and a second guiding part 55L2 configured to guide the wires W along the guide surface 57*a*.

The side surface part 55R on the other side of the first guide part 55 has a third guiding part 55R1 configured to guide the wires W to the guide surface 57*a* of the second guide part 57 and a fourth guiding part 55R2 configured to guide the wires W along the guide surface 57*a*.

The inductive guide 51A configures a converging passage 55S by a space surrounded by the pair of side surface parts 55L and 55R and the bottom surface part 55D. Also, the inductive guide 51A is formed with an opening end portion 55E1 from which the wires W are to be introduced into the converging passage 55S. The opening end portion 55E1 is an end portion of the first guide part 55 on a side distant from the second guide part 57, and is opened toward the space surrounded by the pair of side surface parts 55L and 55R and the bottom surface part 55D.

The first guide part 55 is formed so that an interval between the first guiding part 55L1 and the third guiding part 55R1 gradually decreases from the opening end portion 55E1 toward the guide surface 57*a* of the second guide part 57. Thereby, the first guide part 55 is formed so that the interval between the first guiding part 55L1 and the third guiding part 55R1 is greatest between an opening end portion 55EL1 of the first guiding part 55L1 and an opening end portion 55ER1 of the third guiding part 55R1, which are located at the opening end portion 55E1.

Also, the first guide part 55 is formed so that the second guiding part 55L2 connecting to the first guiding part 55L1 is located on one side of the guide surface 57*a* of the second guide part 57 and the fourth guiding part 55R2 connecting to the third guiding part 55R1 is located on the other side of the guide surface 57*a*. The second guiding part 55L2 and the fourth guiding part 55R2 face in parallel to each other with a predetermined interval equal to or greater than a radial width of two wires W aligned in parallel.

Thereby, the interval between the first guiding part 55L1 and the third guiding part 55R1 is narrowest at a part at which the first guiding part 55L1 connects to the second guiding part 55L2 and the third guiding part 55R1 connects to the fourth guiding part 55R2. Therefore, the part at which the first guiding part 55L1 and the second guiding part 55L2 connect each other becomes a narrowest part 55EL2 of the first guiding part 55L1 with respect to the third guiding part 55R1. Also, the part at which the third guiding part 55R1 and the fourth guiding part 55R2 connect each other becomes a narrowest part 55ER2 of the third guiding part 55R1 with respect to the first guiding part 55L1.

Thereby, the inductive guide 51A is formed so that a part between the narrowest part 55EL2 of the first guiding part 55L1 and the narrowest part 55ER2 of the third guiding part 55R1 becomes a narrowest part 55E2 of the converging passage 55S. The inductive guide 51A is formed so that a cross-sectional area of the converging passage 55S gradually decreases from the opening end portion 55E1 toward the narrowest part 55E2 along an entry direction of the wires W.

The inductive guide 51A has an entry angle regulation part 56A configured to change an entry angle of the wires W entering the converging passage 55S so as to face toward the narrowest part 55E2.

In the reinforcing bar binding machine 1A, the reel 20 is arranged with being offset in one direction. The wires W that are fed from the reel 20 offset in one direction by the wire feeding unit 3A and are curled by the curl guide 50 are directed toward the other direction that is an opposite direction to one direction in which the reel 20 is offset.

For this reason, the wires W to enter the converging passage 55S between the side surface part 55L and the side surface part 55R of the first guide part 55 first enters toward the third guiding part 55R1 of the side surface part 55R. Tip ends of the wires W entering toward the third guiding part 55R1 of the side surface part 55R are directed toward between the narrowest part 55EL2 of the first guiding part 55L1 and the narrowest part 55ER2 of the third guiding part 55R1, i.e., toward the narrowest part 55E2 of the converging passage 55S. Therefore, the first guiding part 55L1 of the side surface part 55L facing the side surface part 55R is provided with the entry angle regulation part 56A.

The entry angle regulation part 56A is provided in a position protruding toward an inner side of a virtual line interconnecting the opening end portion 55E1 of the converging passage 55S and the narrowest part 55E2, in the present example, a virtual line 55EL3 interconnecting the opening end portion 55E1 of the converging passage 55S and the narrowest part 55E2, the inner side being located closer to the side surface part 55R than the virtual line 55EL3. In the present example, the entry angle regulation part 56A has such a shape that an intermediate portion of the first guiding part 55L1 between the opening end portion 55EL1 and the narrowest part 55EL2 is made convex toward the third guiding part 55R1. Thereby, the first guiding part 55L1 has a bent shape, as seen from top (FIG. 9A).

The wires curled by the curl guide 50 are introduced between the pair of side surface parts 55L and 55R of the first guide part 55. The inductive guide 51A is configured to regulate an axial position of the loop Ru to be formed by the wires W by the first guiding part 55L1 and the third guiding part 55R1 of the first guide part 55 and to guide the same to the guide surface 57*a* of the second guide part 57.

Also, the inductive guide 51A is configured to regulate an axial position of the loop Ru to be formed by the wires W guided to the guide surface 57*a* of the second guide part 57 by the second guiding part 55L2 and the fourth guiding part 55R2 of the first guide part 55, and to regulate a radial position of the loop Ru to be formed by the wires W by the guide surface 57*a* of the second guide part 57.

In the inductive guide 51A of the present example, the second guide part 57 is fixed to a main body part 10A of the reinforcing bar binding machine 1A, and the first guide part 55 is fixed to the second guide part 57. In the meantime, the first guide part 55 may be supported to the second guide part 57 in a state in which it can rotate about a shaft 55*b* as a support point. In this structure, the first guide part 55 is configured to be openable/closable in directions of contacting and separating with respect to the curl guide 50 in a state in which the opening end portion 55E1-side is urged toward the curl guide 50 by a spring (not shown). Thereby, after binding the reinforcing bars S with the wires W, the first guide part 55 is retracted by an operation of pulling out the reinforcing bar binding machine 1A from the reinforcing bars S, so that the reinforcing bar binding machine 1A can be easily pulled out from the reinforcing bars S.

Subsequently, the cutting unit 6A configured to cut the wires W wound on the reinforcing bars S is described. The cutting unit 6A includes a fixed blade part 60, a movable blade part 61 configured to cut the wires W in cooperation with the fixed blade part 60, and a transmission mechanism 62 configured to transmit an operation of the binding unit 7A to the movable blade part 61. The fixed blade part 60 has an opening 60*a* through which the wires W are to pass, and an edge portion provided at the opening 60*a* and capable of cutting the wires W.

The movable blade part 61 is configured to cut the wires W passing through the opening 60*a* of the fixed blade part 60 by a rotating operation about the fixed blade part 60, which is a support point. The transmission mechanism 62 is configured to transmit an operation of the binding unit 7A to the movable blade part 61 and to rotate the movable blade part 61 in conjunction with an operation of the binding unit 7A, thereby cutting the wires W.

The fixed blade part 60 is provided downstream of the second wire guide $4A_2$ with respect to the feeding direction of the wires W that are fed in the forward direction, and the opening 60*a* configures a wire guide.

Figure 10A:
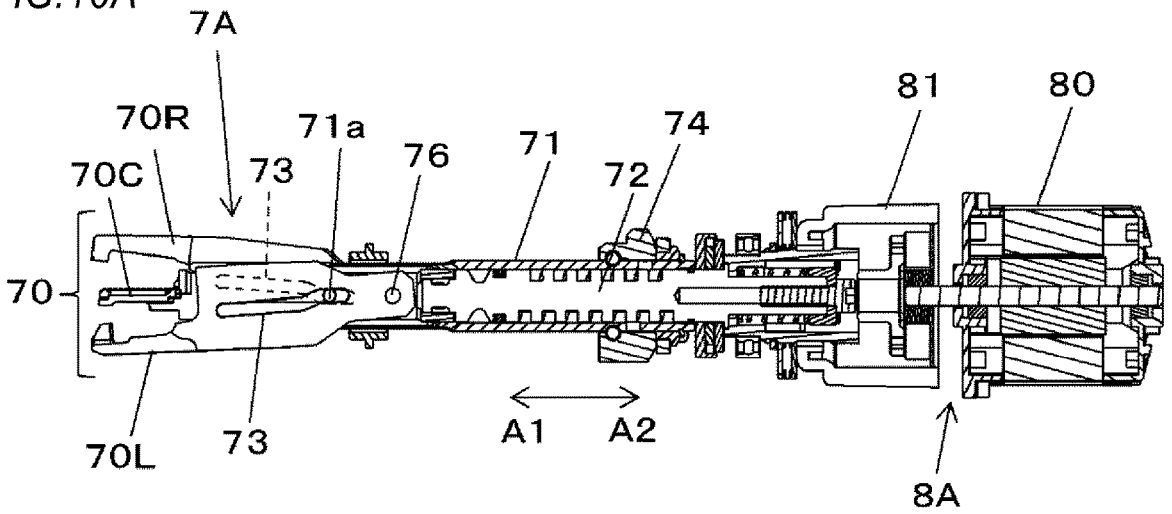
FIG. 10A is a sectional plan view depicting an example of a binding unit and a drive unit.
Figure 10B:
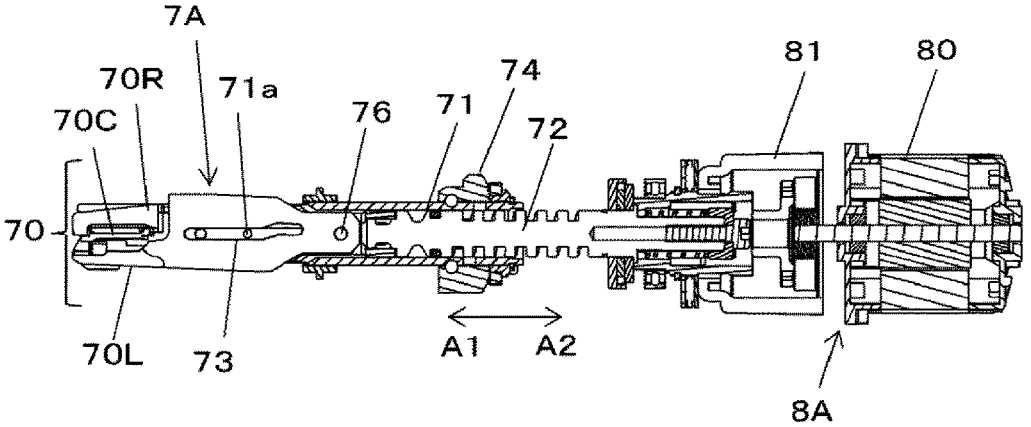
FIG. 10B is a sectional plan view depicting an example of the binding unit and the drive unit.
Figure 10C:
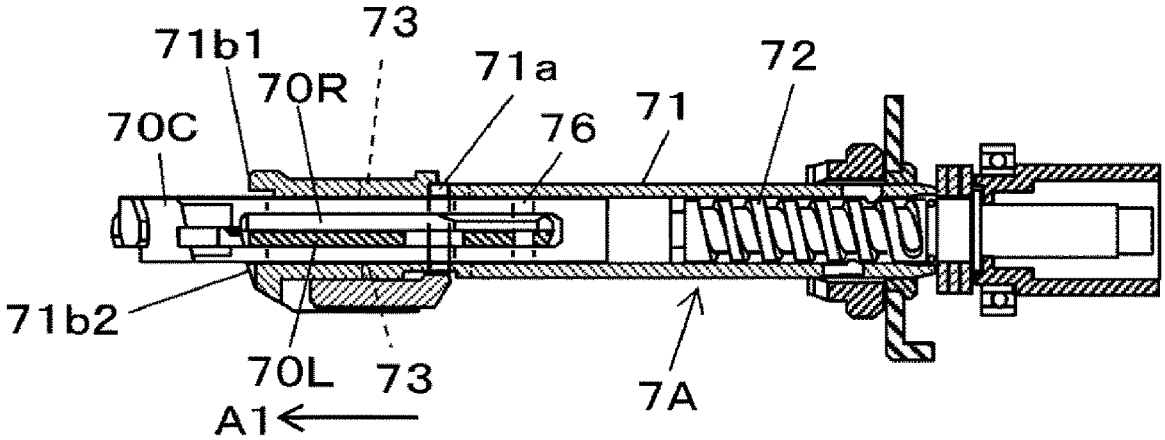
FIG. 10C is a sectional side view depicting an example of the binding unit and the drive unit.

FIGS. 10A and 10B are plan views depicting an example of the binding unit and the drive unit, and FIG. 10C is a side view depicting an example of the binding unit and the drive unit. In the below, the binding unit 7A configured to bind the reinforcing bars S with the wires W and the drive unit 8A configured to drive the binding unit 7A are described.

The binding unit 7A includes an engaging member 70 to which the wires W are to be engaged, an actuating member 71 configured to open/close the engaging member 70, and a rotary shaft 72 for actuating the engaging member 70 and the actuating member 71.

The engaging member 70 includes a first movable engaging member 70L, a second movable engaging member 70R, and a fixed engaging member 70C. A pair of engaging members is configured by the first movable engaging member 70L and the fixed engaging member 70C. A pair of engaging members is configured by the second movable engaging member 70R and the fixed engaging member 70C. The engaging member 70 is configured so that a tip end-side of the first movable engaging member 70L is positioned on one side with respect to the fixed engaging member 70C and a tip end-side of the second movable engaging member 70R is positioned on the other side with respect to the fixed engaging member 70C.

The engaging member 70 is configured so that rear ends of the first movable engaging member 70L and the second movable engaging member 70R are supported to the fixed engaging member 70C so as to be rotatable about a shaft 76. Thereby, the engaging member 70 opens/closes in directions in which the tip end-side of the first movable engaging member 70L contacts and separates with respect to the fixed engaging member 70C by a rotating operation about the shaft 76 as a support point. Also, the engaging member opens/closes in directions in which the tip end-side of the second movable engaging member 70R contacts and separates with respect to the fixed engaging member 70C.

The actuating member 71 and the rotary shaft 72 are configured so that a rotating operation of the rotary shaft 72 is converted into movement of the actuating member 71 in a front and rear direction along an axial direction of the rotary shaft 72 shown with arrows A1 and A2 by a screw part provided on an outer periphery of the rotary shaft 72 and a screw part provided on an inner periphery of the actuating member 71. The actuating member 71 has an opening/closing pin 71*a* for opening/closing the first movable engaging member 70L and the second movable engaging member 70R.

The opening/closing pin 71*a* is inserted in opening/closing guide holes 73 formed in the first movable engaging member 70L and the second movable engaging member 70R. The opening/closing guide hole 73 extends in a moving direction of the actuating member 71, and has a shape of converting linear movement of the opening/closing pin 71*a* moving in conjunction with the actuating member 71 into an opening/closing operation by rotation of the first movable engaging member 70L and the second movable engaging member 70R about the shaft 76 as a support point. In FIGS. 10A and 10B, the opening/closing guide hole 73 formed in the first movable engaging member 70L is shown. However, the second movable engaging member 70R is also provided with the similar opening/closing guide hole 73 having a bilaterally symmetrical shape.

In the binding unit 7A, a side on which the engaging member 70 is provided is referred to as a front side, and a side on which the actuating member 71 is provided is referred to as a rear side. The engaging member 70 is configured so that, when the actuating member 71 is moved rearward (refer to the arrow A2), the first movable engaging member 70L and the second movable engaging member 70R move away from the fixed engaging member 70C by a rotating operation about the shaft 76 as a support point, due to a locus of the opening/closing pin 71*a* and a shape of the opening/closing guide hole 73, as shown in FIG. 10A.

Thereby, the first movable engaging member 70L and the second movable engaging member 70R are opened with respect to the fixed engaging member 70C, so that a feeding path through which the wires W are to pass is formed between the first movable engaging member 70L and the fixed engaging member 70C and between the second movable engaging member 70R and the fixed engaging member 70C.

In a state in which the first movable engaging member 70L and the second movable engaging member 70R are opened with respect to the fixed engaging member 70C, the wires W that are fed by the first feeding gear 30L and the second feeding gear 30R are guided to the first wire guide $4A_1$ and the second wire guide $4A_2$ and passes between the fixed engaging member 70C and the first movable engaging member 70L. The wires W passing between the fixed engaging member 70C and the first movable engaging member 70L are guided to the curl forming unit 5A. Also, the wires W curled by the curl forming unit 5A and guided to the binding unit 7A passes between the fixed engaging member 70C and the second movable engaging member 70R.

The engaging member 70 is configured so that, when the actuating member 71 is moved in the forward direction denoted with the arrow A1, the first movable engaging member 70L and the second movable engaging member 70R move toward the fixed engaging member 70C by the rotating operation about the shaft 76 as a support point, due to the locus of the opening/closing pin 71*a* and the shape of the opening/closing guide hole 73, as shown in FIG. 10B. Thereby, the first movable engaging member 70L and the second movable engaging member 70R are closed with respect to the fixed engaging member 70C.

When the first movable engaging member 70L is closed with respect to the fixed engaging member 70C, the wires W sandwiched between the first movable engaging member 70L and the fixed engaging member 70C are engaged in such an aspect that the wires can move between the first movable engaging member 70L and the fixed engaging member 70C. Also, when the second movable engaging member 70R is closed with respect to the fixed engaging member 70C, the wires W sandwiched between the second movable engaging member 70R and the fixed engaging member 70C are engaged in such an aspect that the wires cannot come off between the second movable engaging member 70R and the fixed engaging member 70C.

The actuating member 71 has a bending part 71*b*1 configured to push and bend tip ends WS (one end portions) of the wires W in a predetermined direction, and a bending part 71*b*2 configured to push and bend termination ends WE (other end portions) of the wires W cut by the cutting unit 6A in a predetermined direction The actuating member 71 is moved in the forward direction denoted with the arrow A1, so that the tip ends WS of the wires W engaged by the fixed engaging member 70C and the second movable engaging member 70R are pushed and are thus bent toward the reinforcing bars S by the bending part 71*b*1. Also, the actuating member 71 is moved in the forward direction denoted with the arrow A1, so that the termination ends WE of the wires engaged by the fixed engaging member 70C and the second movable engaging member 70R and cut by the cutting unit 6A are pushed and are thus bent toward the reinforcing bars S by the bending part 71*b*2.

The binding unit 7A includes a rotation regulation part 74 configured to regulate rotations of the engaging member 70 and the actuating member 71 in conjunction with the rotating operation of the rotary shaft 72. The rotation regulation part 74 is provided to the actuating member 71. The rotation regulation part 74 is engaged to an engaging part (not shown) from an operating area in which the wires W are engaged by the engaging member 70 to an operating area in which the wires W are bent by the bending parts 71*b*1 and 71*b*2 of the actuating member 71. Thereby, the rotation of the actuating member 71 in conjunction with the rotation of the rotary shaft 72 is regulated, so that the actuating member 71 is moved in the front and rear direction by the rotating operation of the rotary shaft 72. Also, in an operating area in which the wires W engaged by the engaging member 70 are twisted, the rotation regulation part 74 is disengaged from the engaging part (not shown), so that the actuating member 71 is rotated in conjunction with the rotation of the rotary shaft 72. The first movable engaging member 70L, the second movable engaging member 70R and the fixed engaging member 70C of the engaging member 70 engaging the wires W are rotated in conjunction with the rotation of the actuating member 71.

The drive unit 8A includes a motor 80, and a decelerator 81 for deceleration and torque amplification. The binding unit 7A and the drive unit 8A are configured so that the rotary shaft 72 and the motor 80 are coupled via the decelerator 81 and the rotary shaft 72 is driven via the decelerator 81 by the motor 80.

The retraction mechanism 53 of the first guide pin 53*a* is configured by a link mechanism configured to convert movement of the actuating member 71 in the front and rear direction into displacement of the first guide pin 53*a*. Also, the transmission mechanism 62 of the movable blade part 61 is configured by a link mechanism configured to convert movement of the actuating member 71 in the front and rear direction into a rotating operation of the movable blade part 61.

Subsequently, the feeding regulation unit 9A configured to regulate the feeding of the wires W is described. The feeding regulation unit 9A is configured by providing a member, to which the tip ends WS of the wires W are to be butted, on the feeding path of the wires W to pass between the fixed engaging member 70C and the second movable engaging member 70R. As shown in FIGS. 3 and 4B, the feeding regulation unit 9A of the present example is configured integrally with the guide plate 50R configuring the curl guide 50 and protrudes from the guide plate 50R in a direction intersecting with the feeding path of the wires W.

The feeding regulation unit 9A includes a parallel alignment regulation part 90 configured to guide a parallel alignment direction of the wires W. The parallel alignment regulation part 90 is configured by providing a surface of the feeding regulation unit 9A that the wires W are to come into contact with a concave part extending in a direction intersecting with a parallel alignment direction of the two wires W to be regulated by the first wire guide $4A_1$ and the second wire guide $4A_2$.

Subsequently, a shape of the reinforcing bar binding machine 1A is described. The reinforcing bar binding machine 1A has such a shape that an operator grips with a hand, and includes a main body part 10A and a handle part 11A. The main body part 10A of the reinforcing bar binding machine 1A is provided at an end portion on a front side thereof with the curl guide 50 and the inductive guide 51A of the curl forming unit 5A. Also, the handle part 11A of the reinforcing bar binding machine 1A extends downwardly from the main body part 10A. Also, a battery 15A is detachably mounted to a lower part of the handle part 11A. Also, the magazine 2A of the reinforcing bar binding machine 1A is provided in front of the handle part 11A. In the main body part 10A of the reinforcing bar binding machine 1A, the wire feeding unit 3A, the cutting unit 6A, the binding unit 7A, and the drive unit 8A configured to drive the binding unit 7A are accommodated.

Subsequently, an operation unit of the reinforcing bar binding machine 1A is described. A trigger 12A is provided on a front side of the handle part 11A of the reinforcing bar binding machine 1A, and a switch 13A is provided inside of the handle part 11A. The reinforcing bar binding machine 1A is configured so that a control unit 14A controls the motor 80 and the feeding motor (not shown), in accordance with a state of the switch 13A pressed as a result of an operation on the trigger 12A.

Figure 19:
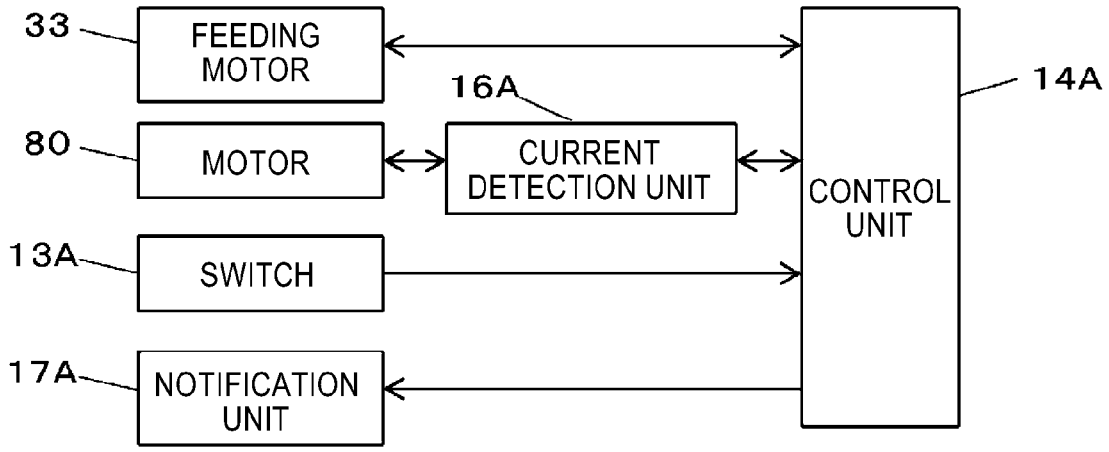
FIG. 19 is a functional block diagram depicting an example of a control function of the reinforcing bar binding machine having a current detection unit.

FIG. 19 is a functional block diagram depicting an example of a control function of the reinforcing bar binding machine having a current detection unit (current detection sensor). The reinforcing bar binding machine 1A includes a control unit 14A (controller) configured to control the motor 80 and the feeding motor 33 configured to drive the first feeding gear 30L, in accordance with a state of the switch 13A.

Also, the reinforcing bar binding machine 1A includes a current detection unit 16A configured to detect current flowing through the motor 80. The control unit 14A and the current detection unit 16A configure a parallel alignment state estimation means for detecting the current flowing through the motor 80 with the current detection unit 16A and estimating a parallel alignment state of the two wires W sandwiched between the second movable engaging member 70R and the fixed engaging member 70C.

Also, the reinforcing bar binding machine 1A includes a notification unit 17A configured to issue a notification corresponding to a parallel alignment state of the two wires W. The notification unit 17A is configured by a lamp, a display unit such as a display, a sound output unit such as a buzzer, and the like.

<Example of Operation of Reinforcing Bar Binding Machine>

FIGS. 11A to 11E illustrate an example of an operation of binding reinforcing bars with wires. In the below, an operation of binding the reinforcing bars S with the two wires W by the reinforcing bar binding machine 1A is described with reference to the drawings.

The reinforcing bar binding machine 1A is in a standby state in which the two wires W are sandwiched between the first feeding gear 30L and the second feeding gear 30R and the tip ends WS of the wires W are positioned from the sandwiched position between the first feeding gear 30L and the second feeding gear 30R to the fixed blade part 60 of the cutting unit 6A. Also, as shown in FIG. 10A, when the reinforcing bar binding machine 1A is in the standby state, the first movable engaging member 70L is opened with respect to the fixed engaging member 70C and the second movable engaging member 70R is opened with respect to the fixed engaging member 70C.

When the reinforcing bars S are inserted between the curl guide 50 and the inductive guide 51A of the curl forming unit 5A and the trigger 12A is operated, the feeding motor 33 is driven in the forward rotation direction by the control unit 14A, so that the first feeding gear 30L is rotated in the forward direction and the second feeding gear 30R is also rotated in the forward direction in conjunction with the first feeding gear 30L. Thereby, the two wires W sandwiched between the first feeding gear 30L and the second feeding gear 30R are fed in the forward direction denoted with the arrow F.

The first wire guide $4A_1$ is provided upstream of the wire feeding unit 3A and the second wire guide $4A_2$ is provided downstream of the wire feeding unit 3A with respect to the feeding direction of the wires W being fed in the forward direction by the wire feeding unit 3A, so that the two wires W are fed with being aligned in parallel along the axial direction of the loop Ru formed by the wires W.

When the wires W are fed in the forward direction, the wires W pass between the fixed engaging member 70C and the first movable engaging member 70L and pass through the guide groove 52 of the curl guide 50 of the curl forming unit 5A. Thereby, the wires W are curled to be wound around the reinforcing bars S at three points of the second wire guide $4A_2$ and the first guide pin 53*a* and the third guide pin 53*c* of the curl guide 50 and at the second guide pin 53*b* upstream of the third guide pin 53*c*.

Figure 11A:
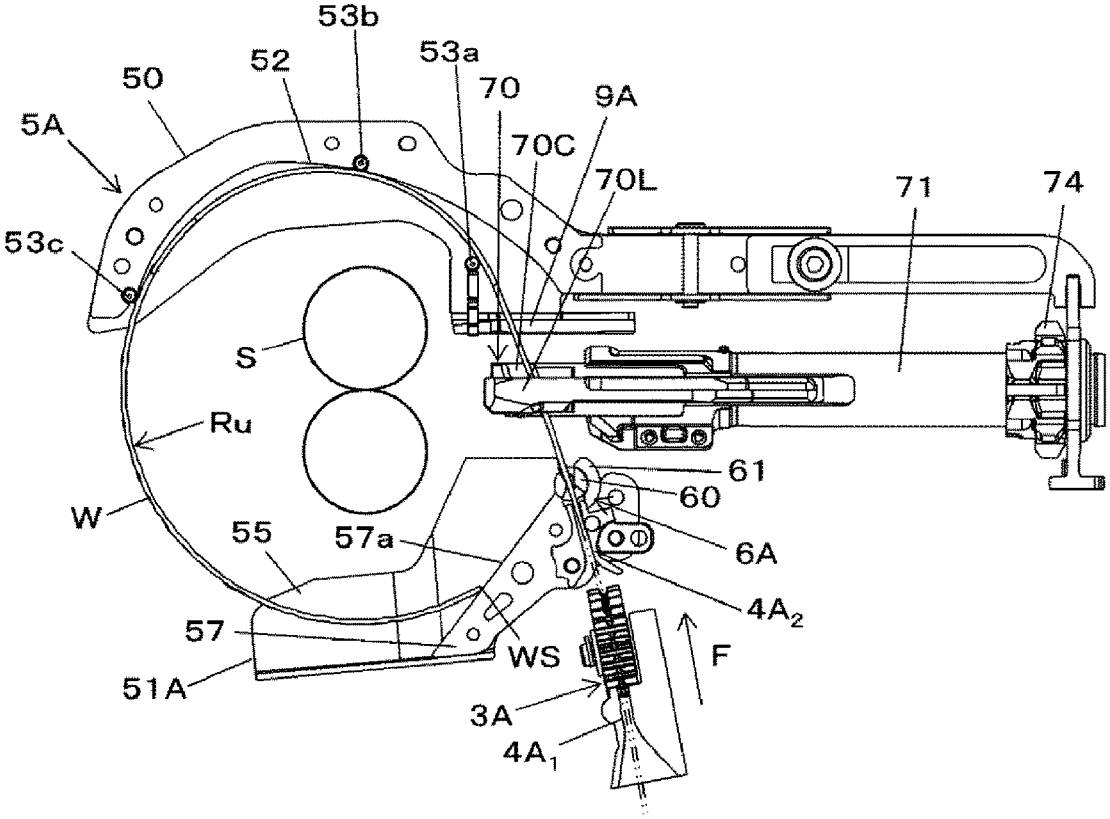
FIG. 11A illustrates an example of an operation of binding reinforcing bars with wires.

The wires W curled by the curl guide 50 are guided to the second guide part 57 by the first guide part 55 of the inductive guide 51A. As shown in FIG. 11A, the tip ends WS of the wires W guided to the second guide part 57 come into contact with the guide surface 57*a* of the second guide part 57. The wires W curled by the curl guide 50 are further fed in the forward direction by the wire feeding unit 3A, so that the wires are guided between the fixed engaging member 70C and the second movable engaging member 70R by the inductive guide 51A. The wires W are fed until the tip ends WS are butted to the feeding regulation unit 9A. When the wires W are fed to a position in which the tip ends WS are butted to the feeding regulation unit 9A, the drive of the feeding motor (not shown) is stopped.

Figure 11B:
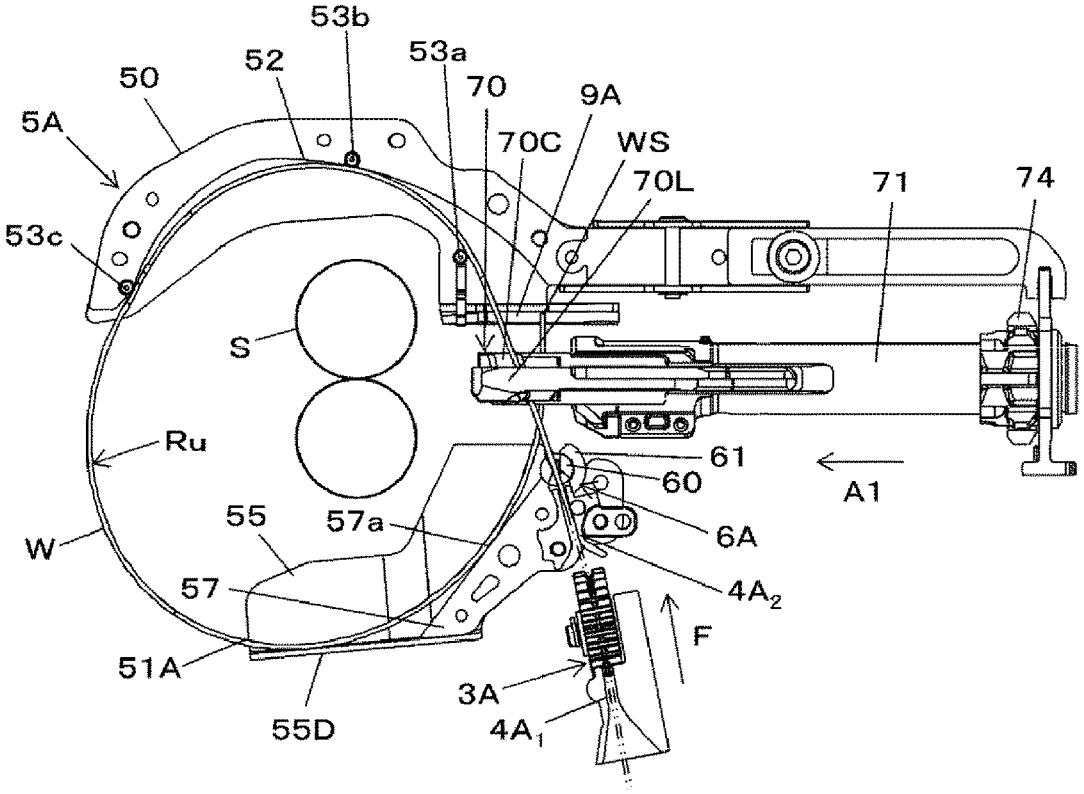
FIG. 11B illustrates an example of the operation of binding reinforcing bars with wires.

In the meantime, there is a slight time lag after the tip ends WS of the wires W come into contact with the feeding regulation unit 9A until the drive of the wire feeding unit 3A is stopped. Therefore, as shown in FIG. 11B, the loop Ru formed by the wires W is bent in a radially expanding direction until it comes into contact with the bottom surface part 55D of the first guide part 55 of the inductive guide 51A.

After the feeding of the wires W in the forward direction is stopped, the motor 80 is driven in the forward rotation direction by the control unit 14A. The rotating operation of the rotary shaft 72 of the actuating member 71 in conjunction with the rotation of the motor 80 is regulated by the rotation regulation part 74, so that the rotation of the motor 80 is converted into linear movement. Thereby, the actuating member 71 is moved in the forward direction denoted with the arrow A1.

When the actuating member 71 is moved in the forward direction, the opening/closing pin 71*a* passes through the opening/closing guide hole 73, as shown in FIG. 10B. Thereby, the first movable engaging member 70L is moved toward the fixed engaging member 70C by the rotating operation about the shaft 76 as a support point. When the first movable engaging member 70L is closed with respect to the fixed engaging member 70C, the wires W sandwiched between the first movable engaging member 70L and the fixed engaging member 70C are engaged in an aspect of capable of moving between the first movable engaging member 70L and the fixed engaging member 70C.

Also, the second movable engaging member 70R is moved toward the fixed engaging member 70C by the rotating operation about the shaft 76 as a support point. When the second movable engaging member 70R is closed with respect to the fixed engaging member 70C, the wires W sandwiched between the second movable engaging member 70R and the fixed engaging member 70C are engaged is such an aspect that the wires cannot come off between the second movable engaging member 70R and the fixed engaging member 70C.

Also, when the actuating member 71 is moved in the forward direction, the operation of the actuating member 71 is transmitted to the retraction mechanism 53, so that the first guide pin 53*a* is retracted.

After the actuating member 71 is advanced to a position in which the wires W are engaged by the closing operation of the first movable engaging member 70L and the second movable engaging member 70R, the rotation of the motor 80 is temporarily stopped and the feeding motor 33 is driven in the reverse rotation direction by the control unit 14A. Thereby, the first feeding gear 30L is reversed and the second feeding gear 30R is also reversed in conjunction with the first feeding gear 30L.

Figure 11C:
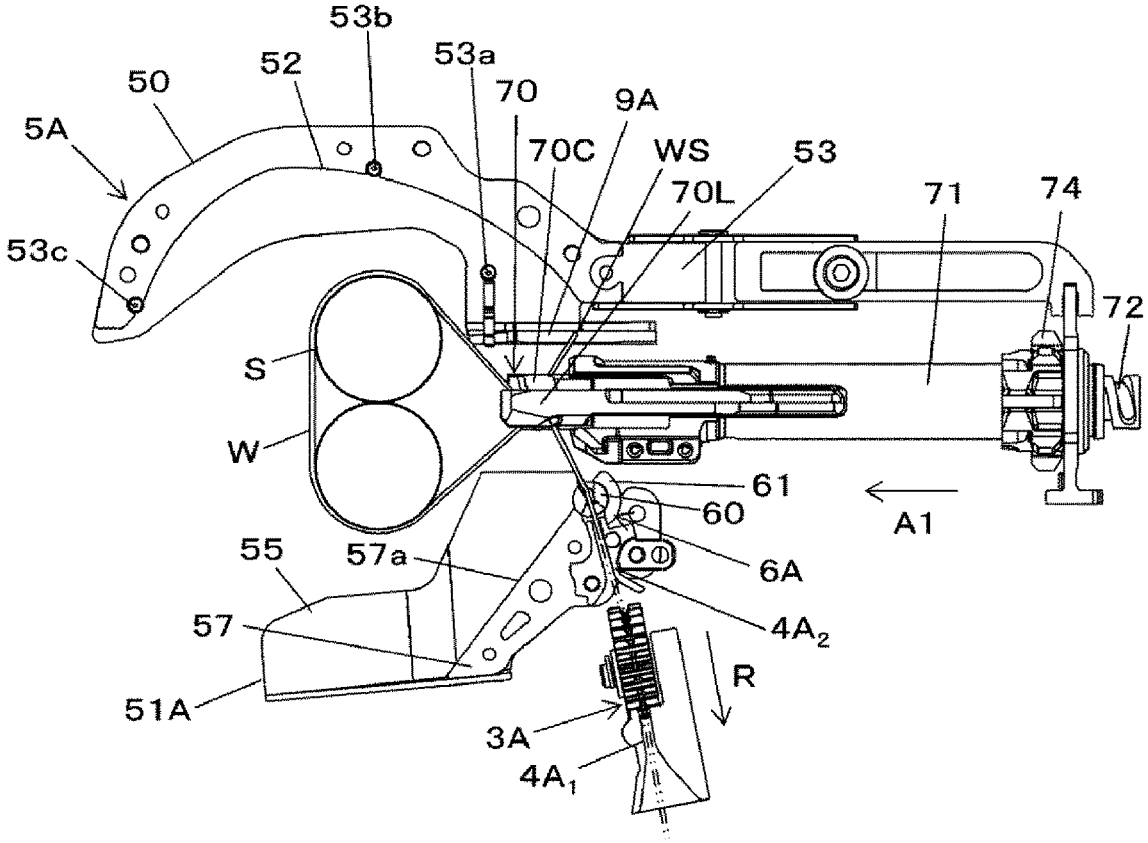
FIG. 11C illustrates an example of the operation of binding reinforcing bars with wires.

Therefore, the two wires W sandwiched between the first feeding gear 30L and the second feeding gear 30R are fed in the reverse direction denoted with the arrow R. Since the tip ends WS of the wires W are engaged in such an aspect that the wires cannot come off between the second movable engaging member 70R and the fixed engaging member 70C, the wires W are wound with closely contacting the reinforcing bars S by the operation of feeding the wires Win the reverse direction, as shown in FIG. 11C.

After the wires W are wound on the reinforcing bars S and the drive of the feeding motor 33 in the reverse rotation direction is stopped by the control unit 14A, the motor 80 is driven in the forward rotation direction, so that the actuating member 71 is moved in the forward direction denoted with the arrow A1. The movement of the actuating member 71 in the forward direction is transmitted to the cutting unit 6A by the transmission mechanism 62, so that the movable blade part 61 is rotated and the wires W engaged by the first movable engaging member 70L and the fixed engaging member 70C are cut by the operation of the fixed blade part 60 and the movable blade part 61.

Figure 11D:
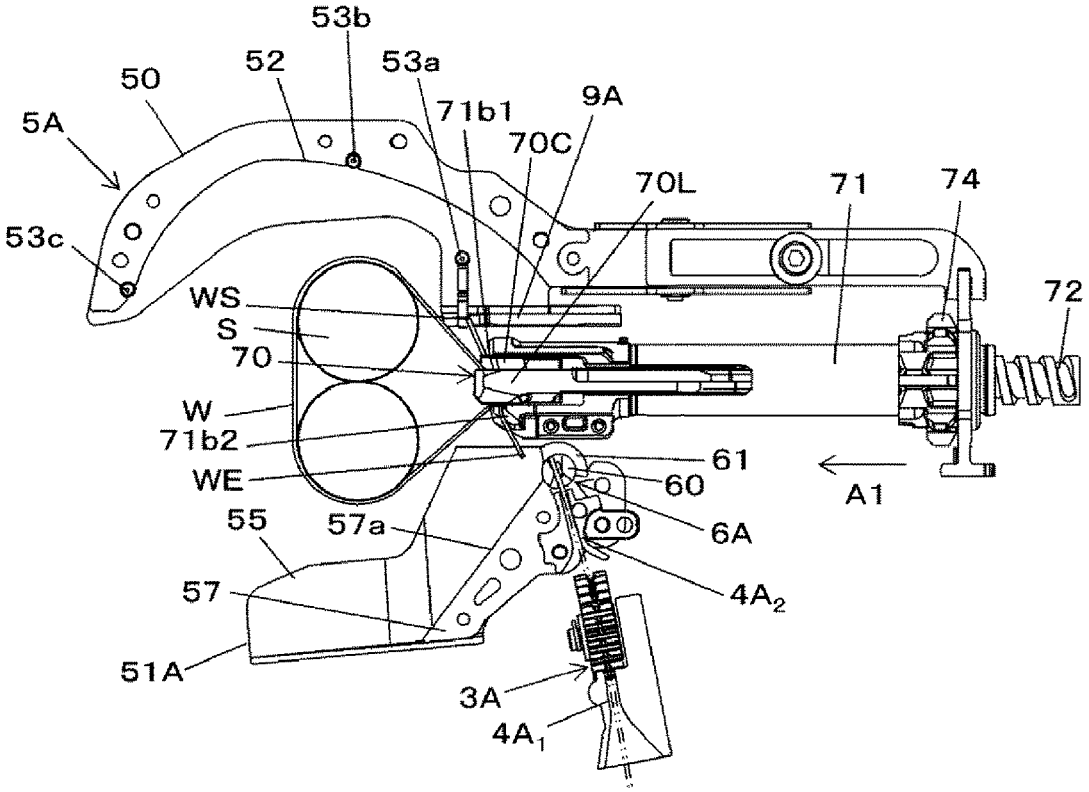
FIG. 11D illustrates an example of the operation of binding reinforcing bars with wires.

After the wires W are cut, the actuating member 71 is further moved in the forward direction, so that the bending parts 71*b*1 and 71*b*2 are moved toward the reinforcing bars S, as shown in FIG. 11D. Thereby, the tip ends WS of the wires W engaged by the fixed engaging member 70C and the second movable engaging member 70R are pressed toward the reinforcing bars S and bent toward the reinforcing bars S at the engaging position as a support point by the bending part 71*b*1. The actuating member 71 is further moved in the forward direction, so that the wires W engaged between the second movable engaging member 70R and the fixed engaging member 70C are maintained as being sandwiched by the bending part 71*b*1.

Also, the termination ends WE of the wires W engaged by the fixed engaging member 70C and the first movable engaging member 70L and cut by the cutting unit 6A are pressed toward the reinforcing bars S and are bent toward the reinforcing bars S at the engaging point as a support point by the bending part 71*b*2. The actuating member 71 is further moved in the forward direction, so that the wires W engaged between the first movable engaging member 70L and the fixed engaging member 70C are maintained as being sandwiched by the bending part 71*b*2.

After the tip ends WS and the termination ends WE of the wires W are bent toward the reinforcing bars S, the motor 80 is further driven in the forward rotation direction, so that the actuating member 71 is further moved in the forward direction. The actuating member 71 is moved to a predetermined position, so that the engaging by the rotation regulation part 74 is released.

Figure 11E:
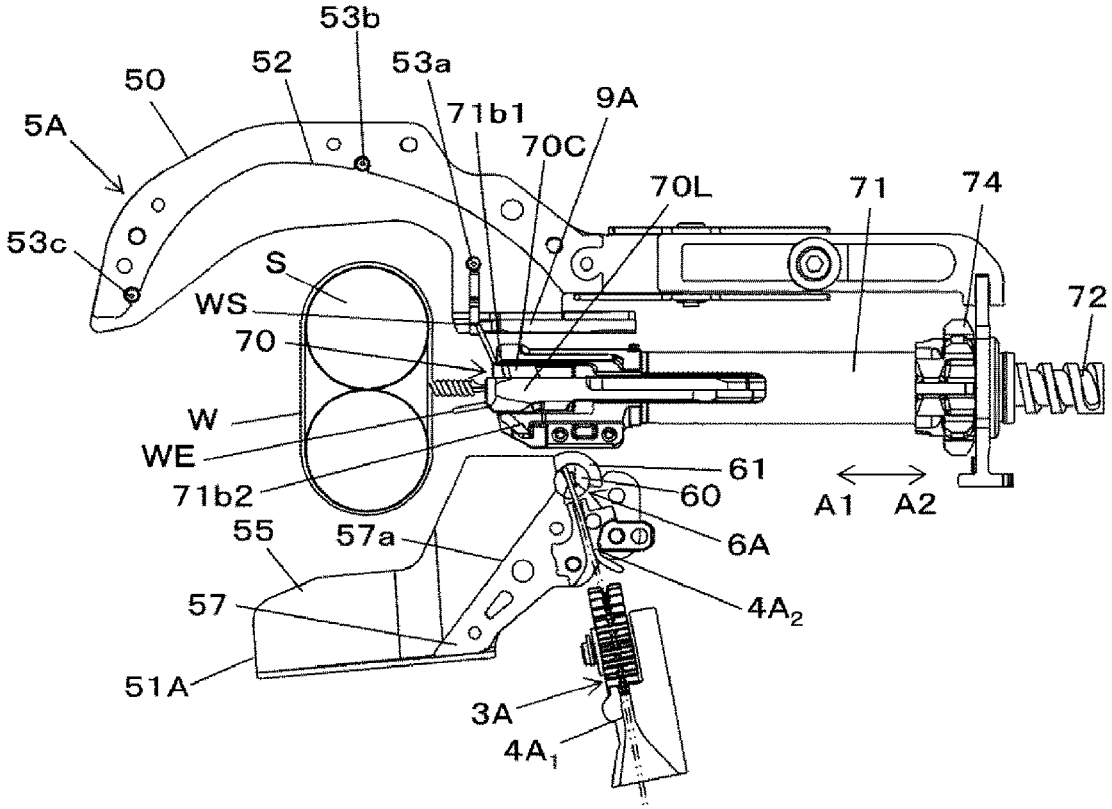
FIG. 11E illustrates an example of the operation of binding reinforcing bars with wires.

Thereby, the motor 80 is further driven in the forward rotation direction, so that the actuating member 71 is rotated in conjunction with the rotary shaft 72 and the engaging member 70 holding the wires W are rotated integrally with the actuating member 71, thereby twisting the wires W, as shown in FIG. 11E.

After the wires W are twisted, the motor 80 is driven in the reverse rotation direction by the control unit 14A. The rotating operation of the rotary shaft 72 of the actuating member 71 in conjunction with the rotation of the motor 80 is regulated by the rotation regulation part 74, so that the rotation of the motor 80 is converted into linear movement. Thereby, the actuating member 71 is moved in the backward direction denoted with the arrow A2.

When the actuating member 71 is moved in the backward direction, the bending parts 71*b*1 and 71*b*2 separate from the wires W, so that the holding state of the wires W by the bending parts 71*b*1 and 71*b*2 is released. Also, when the actuating member 71 moved in the backward direction, the opening/closing pin 71*a* passes through the opening/closing guide hole 73, as shown in FIG. 10A. Thereby, the first movable engaging member 70L is moved away from the fixed engaging member 70C by the rotating operation about the shaft 76 as a support point. Also, the second movable engaging member 70R is moved away from the fixed engaging member 70C by the rotating operation about the shaft 76 as a support point. Thereby, the wires W come off from the engaging member 70.

Figure 12A:
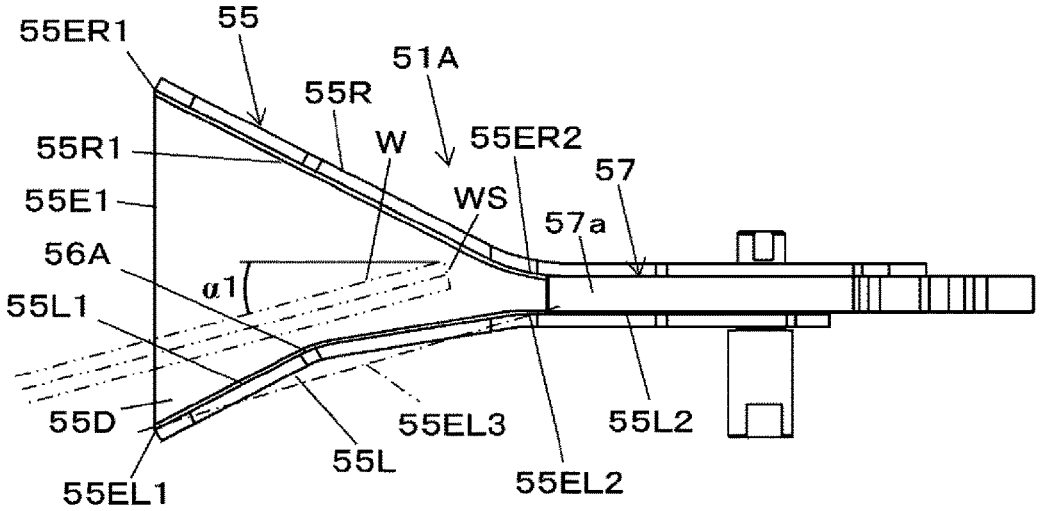
FIG. 12A illustrates movement of the wires in the inductive guide of the first embodiment.
Figure 12B:
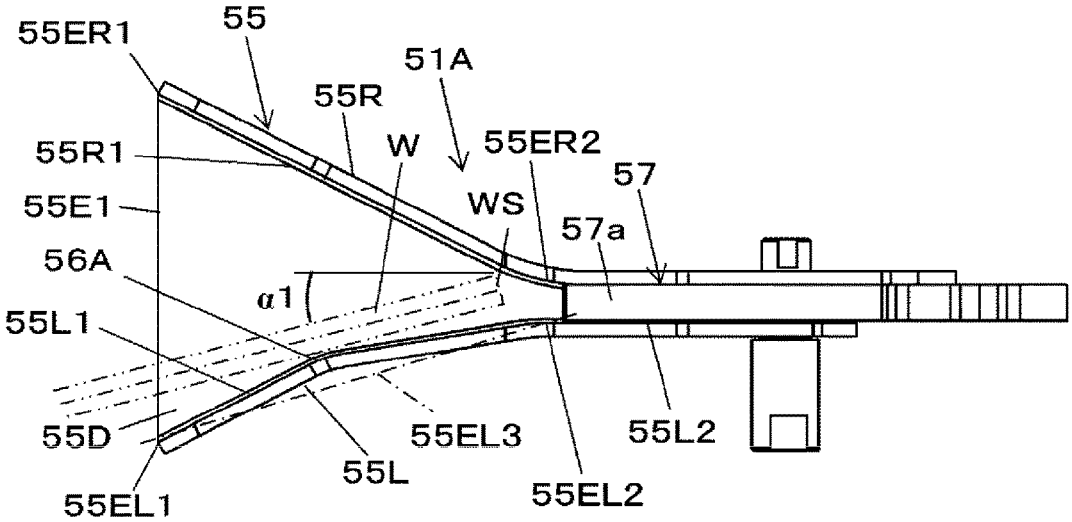
FIG. 12B illustrates movement of the wires in the inductive guide of the first embodiment.
Figure 12C:
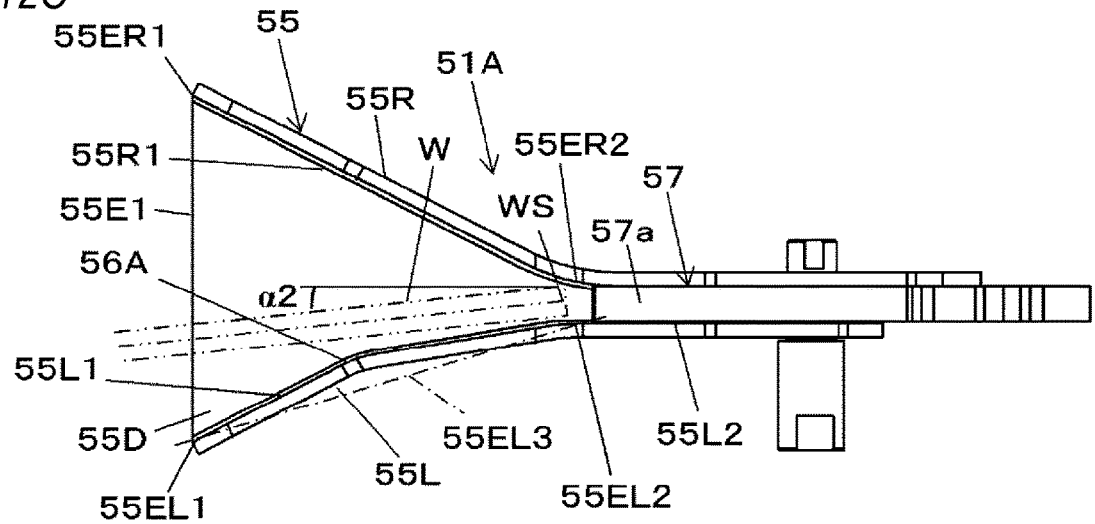
FIG. 12C illustrates movement of the wires in the inductive guide of the first embodiment.

FIGS. 12A, 12B and 12C illustrate movement of the wires in the inductive guide of the first embodiment. In the below, an operational effect of guiding the wires W by the inductive guide 51A is described.

As described above, the wires W cured by the curl guide 50 are directed toward the other direction that is an opposite direction to one direction in which the reel 20 is offset. For this reason, in the inductive guide 51A, the wires W entering between the side surface part 55L and the side surface part 55R of the first guide part 55 are first introduced toward the third guiding part 55R1 of the side surface part 55R.

In the reinforcing bar binding machine of the related art, when it is assumed that a locus of wires curled to form a loop by the curl guide is a circle, a diameter thereof is about 50 to 70 mm. In contrast, according to the reinforcing bar binding machine 1A, when it is assumed that a locus of wires W curled to form the loop Ru by the curl guide 50 is an ellipse, a length in a long axis direction is about equal to or greater than 75 mm and equal to or less than 100 mm.

In this way, when the length in the long axis direction is about equal to or greater than 75 mm and equal to or less than 100 mm, on the assumption that the locus of wires W curled to form the loop Ru by the curl guide 50 is an ellipse, an entry angle $\alpha$1 of the wires W entering toward the third guiding part 55R1 of the side surface part 55R increases, as compared to the reinforcing bar binding machine of the related art.

For this reason, when the tip ends WS of the wires W entering toward the third guiding part 55R1 of the side surface part 55R of the inductive guide 51A come into contact with the third guiding part 55R1, a resistance increases upon guiding of the tip ends WS of the wires W along the third guiding part 55R1. Therefore, a feeding defect that the wires W are not directed toward between the narrowest part 55EL2 of the first guiding part 55L1 and the narrowest part 55ER2 of the third guiding part 55R1 may occur.

Therefore, the entry angle regulation part 56A is provided to cause the tip ends of the wires W entering toward the third guiding part 55R1 of the side surface part 55R to be directed toward between the narrowest part 55EL2 of the first guiding part 55L1 and the narrowest part 55ER2 of the third guiding part 55R1.

That is, when the wires W entering between the side surface part 55L and the side surface part 55R of the first guide part 55 are introduced toward the third guiding part 55R1 of the side surface part 55R, the wires W at a part located between the side surface part 55L and the side surface part 55R come into contact with the entry angle regulation part 56A, as shown in FIG. 12B. When the wires W come into contact with the entry angle regulation part 56A, a force of rotating the wires W in a direction in which the tip ends WS of the wires W are caused to be directed toward between the narrowest part 55EL2 of the first guiding part 55L1 and the narrowest part 55ER2 of the third guiding part 55R1 is applied to the wires W with the entry angle regulation part 56A as a support point.

Thereby, as shown in FIG. 12C, an entry angle $\alpha 2$ of the wires W ($\alpha 2<\alpha 1$) entering toward the third guiding part 55R1 of the side surface part 55R decreases and the tip ends WS of the wires W are directed toward between the narrowest part 55EL2 of the first guiding part 55L1 and the narrowest part 55ER2 of the third guiding part 55R1. Therefore, the wires W curled by the curl guide 50 can be introduced between the pair of second guiding part 55L2 and fourth guiding part 55R2 of the first guide part 55.

Figure 13A:
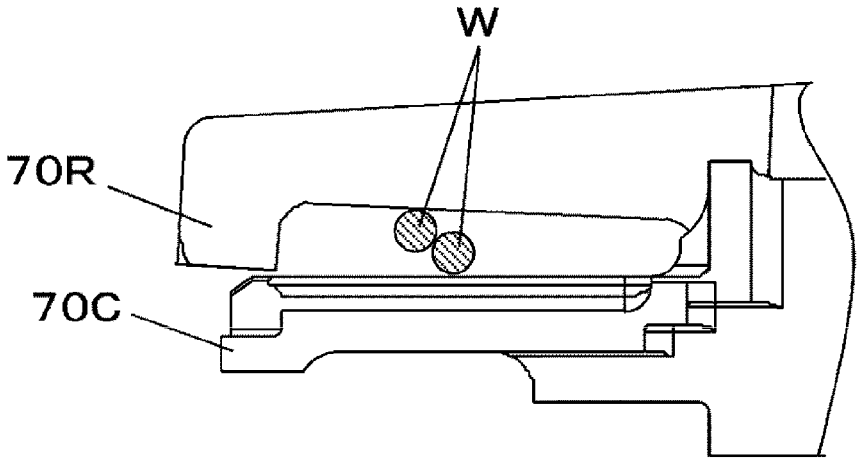
FIG. 13A illustrates an engaged state of the wires in an engaging member.
Figure 13B:
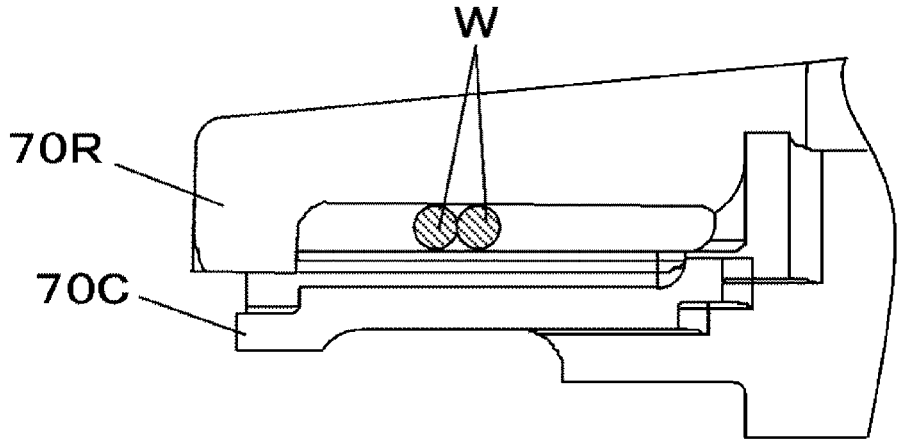
FIG. 13B illustrates an engaged state of the wires in the engaging member.
Figure 13C:
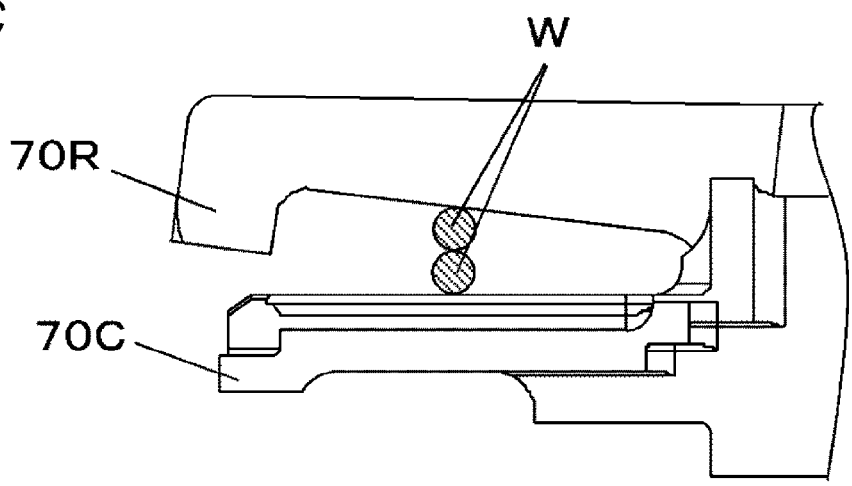
FIG. 13C illustrates an engaged state of the wires in the engaging member.

FIGS. 13A, 13B and 13C illustrate engaged state of the wires in the engaging member. In the below, when engaging the two wires W in the engaging member 70, an operational effect of guiding a parallel alignment direction of the two wires W is described.

In the reinforcing bar binding machine of the related art, the wires W are guided to the engaging member 70 of the binding unit 7A without the wires W contacting the guide surface 57*a* of the second guide part 57. In contrast, according to the reinforcing bar binding machine 1A, the wires W guided to the second guide part 57 by the first guiding part 55L1 and the third guiding part 55R1 of the first guide part 55 of the inductive guide 51A are contacted to the guide surface 57*a* and are thus guided to the engaging member 70 of the binding unit 7A, as shown in FIGS. 11A and 11B.

When the two wires W come into contact with the guide surface 57*a*, the wires W are guided between the fixed engaging member 70C and the second movable engaging member 70R in a state in which the parallel alignment direction of the two wires W is regulated by the guide surface 57*a*.

Since the guide surface 57*a* is planar, when the two wires W are fed with being in contact with the guide surface 57*a*, the two wires W are aligned in parallel in a direction following the axial direction of the loop Ru formed by the wires W.

For this reason, as shown in FIG. 13C, the two wires W are aligned in parallel along the direction in which the second movable engaging member 70R is opened/closed with respect to the fixed engaging member 70C, and the two wires W are engaged between the fixed engaging member 70C and the second movable engaging member 70R in a state in which an interval corresponding two wires is formed. Thereby, a load to be applied to the engaging member 70 increases.

Figure 14A:
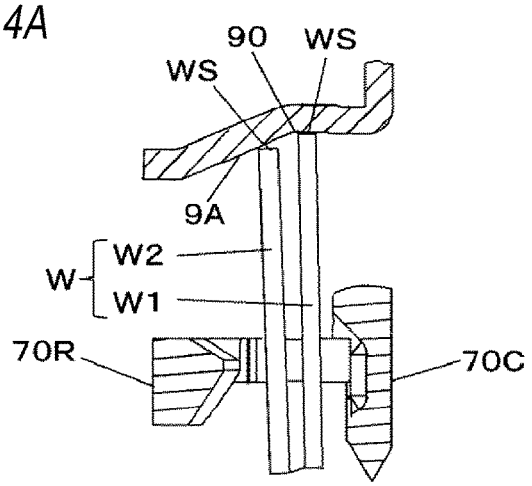
FIG. 14A illustrates movement of the wires in a feeding regulation unit.
Figure 14B:
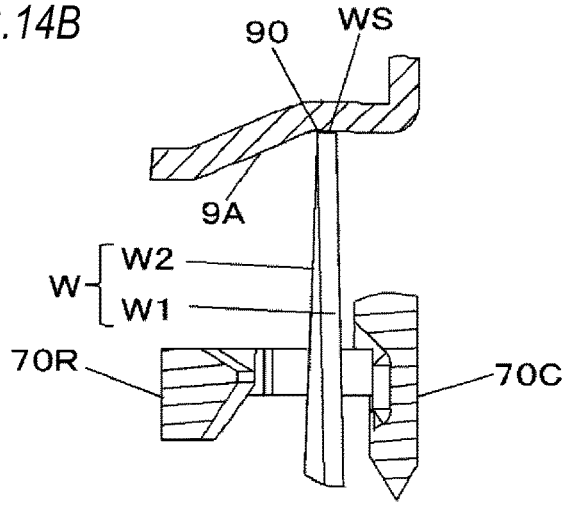
FIG. 14B illustrates movement of the wires in the feeding regulation unit.

Therefore, the parallel alignment direction of the two wires W is guided with the feeding regulation unit 9A. FIGS. 14A and 14B illustrate movement of the wires in the feeding regulation unit. In the below, an operational effect of guiding the wires W with the feeding regulation unit 9A is described.

The feeding regulation unit 9A has the parallel alignment regulation part 90 provided on a surface with which the wires W come into contact and extending in a direction intersecting with a parallel alignment direction of the two wires W to be regulated by the first wire guide $\mathbf{4}A_1$ and the second wire guide $\mathbf{4}A_2$.

The parallel alignment regulation part 90 has such a shape that it is concave in the feeding direction of the wires W being fed in the forward direction. Therefore, when the tip ends WS of the wires W are pressed to the feeding regulation unit 9A, the tip ends WS of the wires W are guided toward an apex of the concave portion configuring the parallel alignment regulation part 90.

Thereby, as shown in FIG. 14A, when the two wires W are fed in the forward direction until the tip ends WS of the two wires W having passed between the fixed engaging member 70C and the second movable engaging member 70R are contacted and pressed to the feeding regulation unit 9A, the tip ends WS of the two wires W are guided along the extension direction of the parallel alignment regulation part 90, as shown in FIG. 14B. Therefore, a direction in which the two wires W are aligned in parallel between the fixed engaging member 70C and the second movable engaging member 70R is guided to the radial direction of the loop Ru shown in FIG. 3.

For this reason, as shown in FIG. 13A, it is possible to guide the two wires W so that the wires are to be aligned in parallel in a direction intersecting with the opening/closing direction of the second movable engaging member 70R with respect to the fixed engaging member 70C. Therefore, as shown in FIG. 13B, the two wires W are engaged between the fixed engaging member 70C and the second movable engaging member 70R in such an aspect that an interval corresponding to one wire is formed therebetween. As a result, it is possible to reduce the load to be applied to the engaging member 70, thereby securing engaging the two wires W.

Figure 15A:
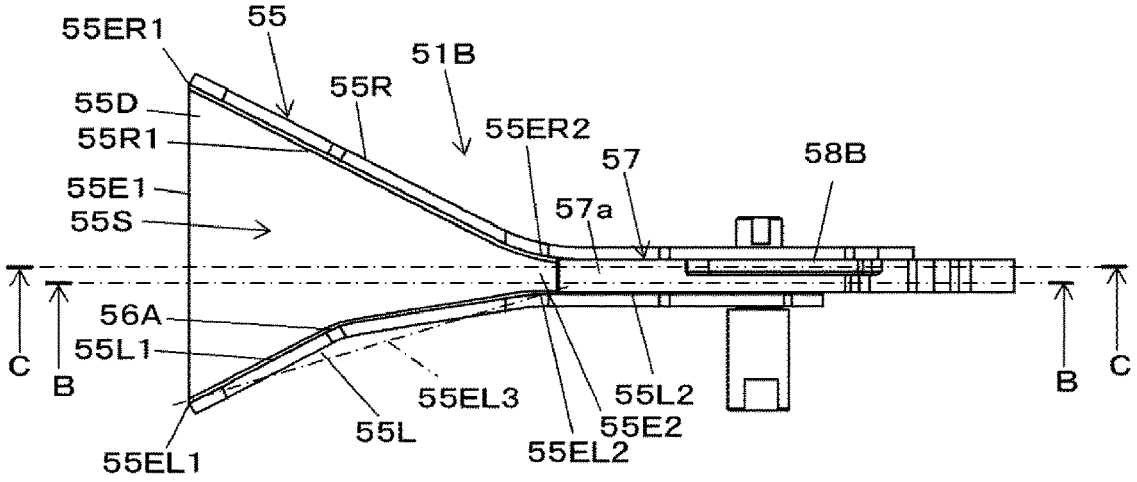
FIG. 15A is a plan view depicting an inductive guide of a second embodiment.
Figure 15B:
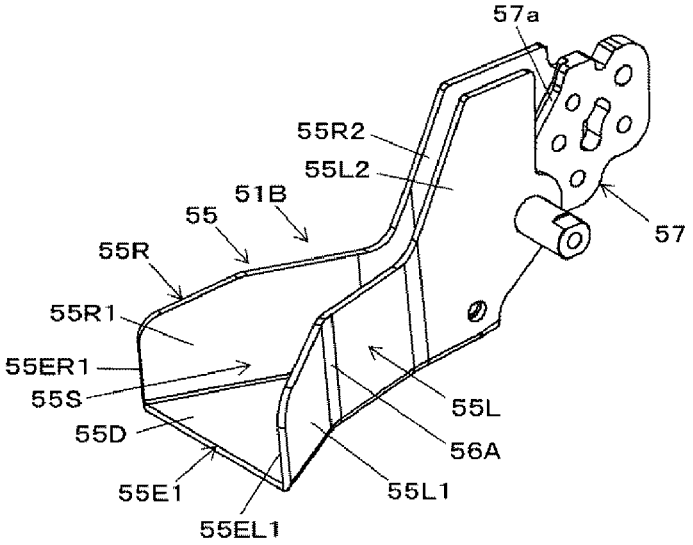
FIG. 15B is a perspective view depicting the inductive guide of the second embodiment.
Figure 15C:
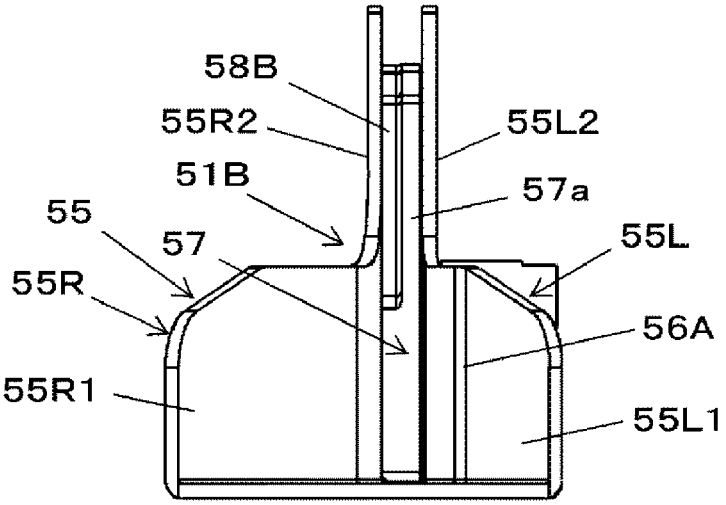
FIG. 15C is a front view depicting the inductive guide of the second embodiment.
Figure 15D:
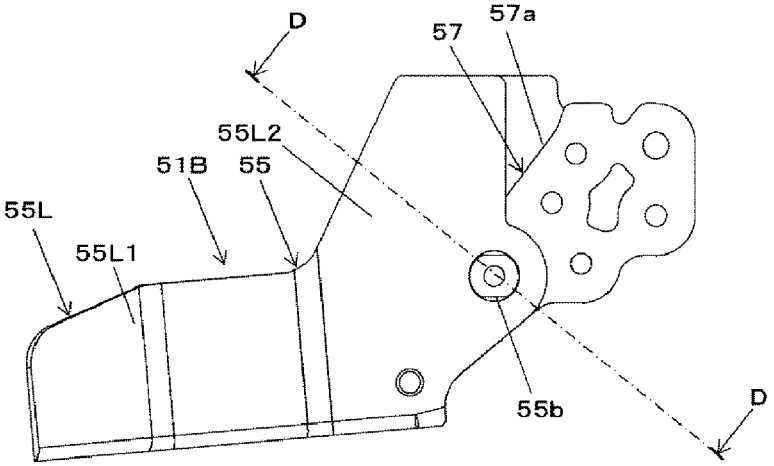
FIG. 15D is a side view depicting the inductive guide of the second embodiment.
Figure 15E:
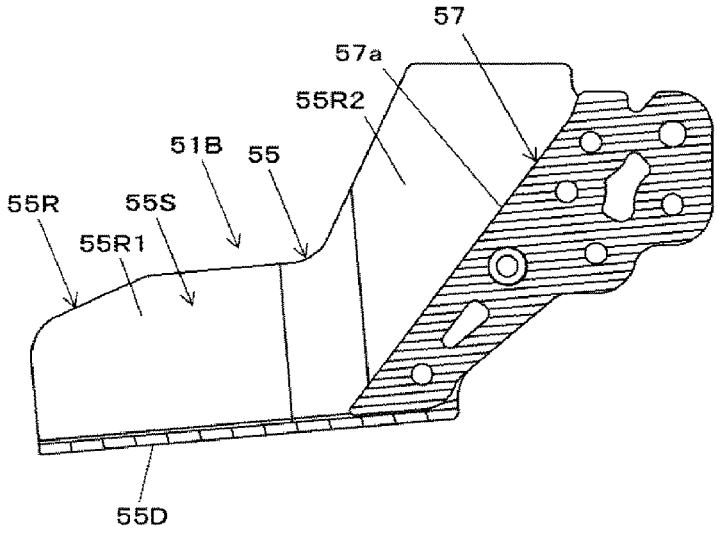
FIG. 15E is a sectional view taken along a line B-B in FIG. 15A.

In the meantime, the parallel alignment direction of the two wires W may be guided by the inductive guide. FIG. 15A is a plan view depicting an inductive guide of a second embodiment, FIG. 15B is a perspective view depicting the inductive guide of the second embodiment, FIG. 15C is a front view depicting the inductive guide of the second embodiment, and FIG. 15D is a side view depicting the inductive guide of the second embodiment. Also, FIG. 15E is a sectional view taken along a line B-B in FIG. 15A, FIG. 15F is a sectional view taken along a line C-C in FIG. 15A, FIG. 15G is a sectional view taken along a line D-D in FIG. 15D, and FIG. 15H is a broken perspective view depicting the inductive guide of the second embodiment.

In an inductive guide 51B of the second embodiment, the configurations that are equivalent to those of the inductive guide 51A of the first embodiment are denoted with the same reference signs, and the descriptions thereof are omitted.

The inductive guide 51B of the second embodiment has a parallel alignment regulation part 58B provided on the guide surface 57*a*. The parallel alignment regulation part 58B is configured by providing the guide surface 57*a* with a plurality of surfaces along an axial direction intersecting with the radial direction of the loop Ru to be formed by the wires W. That is, the parallel alignment regulation part 58B is configured by providing the guide surface 57*a* with a step in the extension direction of the guide surface 57*a*. A position in which the parallel alignment regulation part 58B is provided is a position in which the loop Ru to be formed by the wires W curled by the curl guide 50 is to come into contact. The parallel alignment regulation part 58B has such a shape that it is concave toward a radially outer side of the loop Ru to be formed by the wires W with respect to the guide surface 57*a*.

Figure 15F:
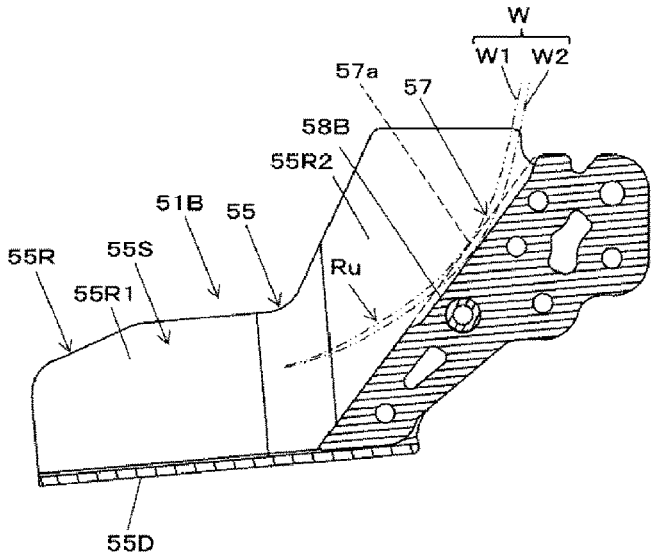
FIG. 15F is a sectional view taken along a line C-C in FIG. 15A.
Figure 15G:
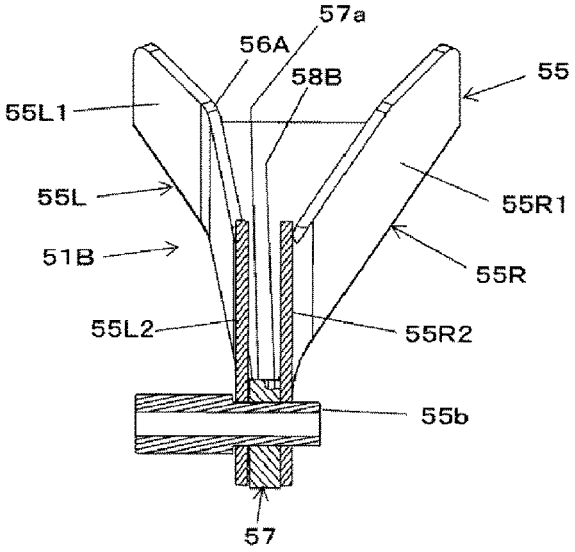
FIG. 15G is a sectional view taken along a line D-D in FIG. 15D.
Figure 15H:
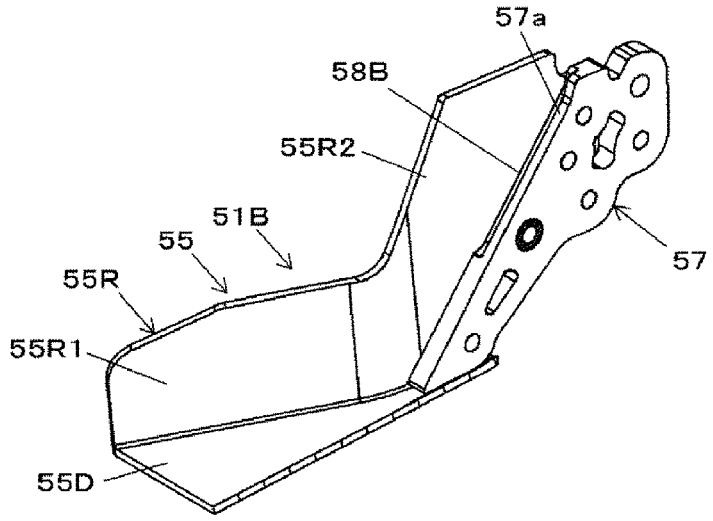
FIG. 15H is a broken perspective view depicting the inductive guide of the second embodiment.

Thereby, as shown in FIG. 15F, one wire W1 of the two wires W guided to the second guide part 57 comes into contact with the guide surface 57*a*, and the other wire W2 comes into contact with the parallel alignment regulation part 58B that is concave with respect to the guide surface 57*a*. Therefore, the parallel alignment direction of the two wires W guided to the second guide part 57 deviates in the radial direction of the loop Ru. Therefore, the parallel alignment direction of the two wires W between the fixed engaging member 70C and the second movable engaging member 70R is guided in the radial direction of the loop Ru.

For this reason, as shown in FIG. 13A, it is possible to guide the two wires W so as to be aligned in parallel in a direction intersecting with a direction in which the second movable engaging member 70R is opened/closed with respect to the fixed engaging member 70C. Therefore, as shown in FIG. 13B, the two wires W are engaged in a state in which an interval corresponding to one wire is formed between the fixed engaging member 70C and the second movable engaging member 70R, so that a load to be applied to the engaging member 70 is reduced to securely engage the two wires W.

Figure 16A:
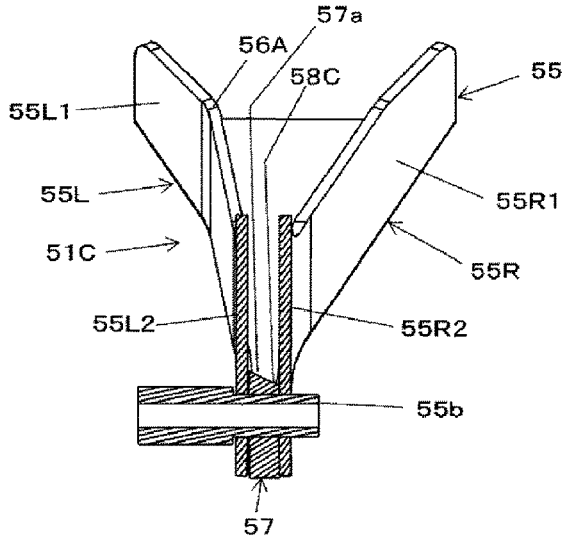
FIG. 16A is a sectional view depicting an inductive guide of a third embodiment.
Figure 16B:
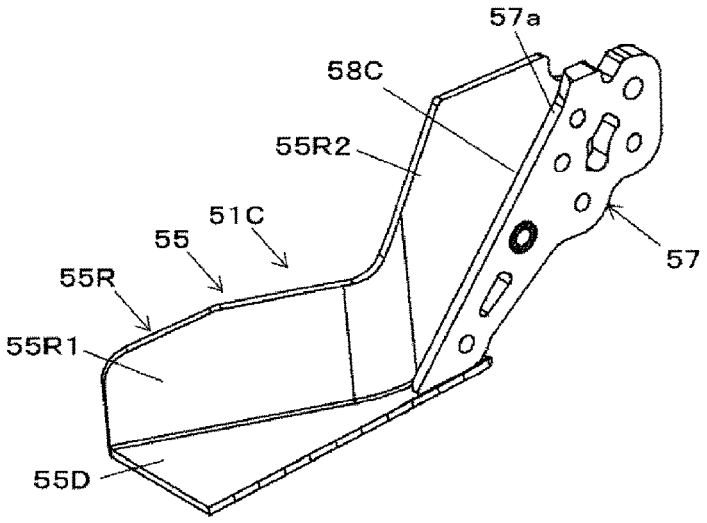
FIG. 16B is a broken perspective view depicting the inductive guide of the third embodiment.

FIG. 16A is a sectional view depicting an inductive guide of a third embodiment, and FIG. 16B is a broken perspective view depicting the inductive guide of the third embodiment. In an inductive guide 51C of the third embodiment, the configurations that are equivalent to those of the inductive guide 51A of the first embodiment are denoted with the same reference signs, and the descriptions thereof are omitted.

The inductive guide 51C of the third embodiment has a parallel alignment regulation part 58C provided on the guide surface 57*a*. The parallel alignment regulation part 58C is configured by a surface that is not parallel to the parallel alignment direction of the two wires defined by the first wire guide $4A_1$ and the second wire guide $4A_2$. That is, the parallel alignment regulation part 58C is configured by providing the guide surface 57*a* with an inclined surface that is inclined in a direction intersecting with the extension direction of the guide surface 57*a* and along an alignment direction of the two wires W. Therefore, the parallel alignment regulation part 58C is a surface inclined from the second guiding part 55L2 toward the fourth guiding part 55R2. In FIG. 16A, the direction in which the parallel alignment regulation part 58C is inclined is a direction descending from the second guiding part 55L2 toward the fourth guiding part 55R2 so that the wire W located on the second guiding part 55L2-side of the two wires W guided to the second guide part 57 is located on a radially inner side of the loop Ru to be formed by the wires W. In the meantime, the direction in which the parallel alignment regulation part 58C is inclined may be a direction descending from the fourth guiding part 55R2 toward the second guiding part 55L2 so that the wire W located on the second guiding part 55L2-side is located on a radially outer side of the loop Ru to be formed by the wires W.

Thereby, one of the two wires W guided to the second guide part 57 comes into contact with a surface, which is located on a radially outer side of the loop Ru to be formed by the wires W, of the inclined surface configuring the parallel alignment regulation part 58C, and the other wire comes into contact with a surface located on a radially inner side of the loop Ru. Therefore, the parallel alignment direction of the two wires W guided to the second guide part 57 deviates in the radial direction of the loop Ru. Therefore, the parallel alignment direction of the two wires W between the fixed engaging member 70C and the second movable engaging member 70R is guided in the radial direction of the loop Ru.

Figure 17A:
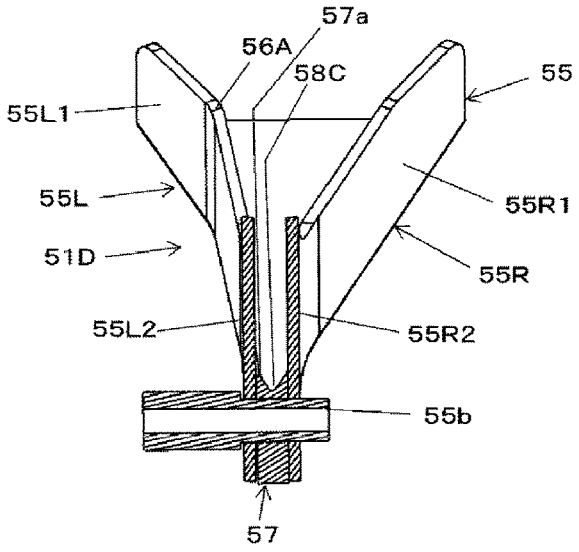
FIG. 17A is a sectional view depicting an inductive guide of a fourth embodiment.
Figure 17B:
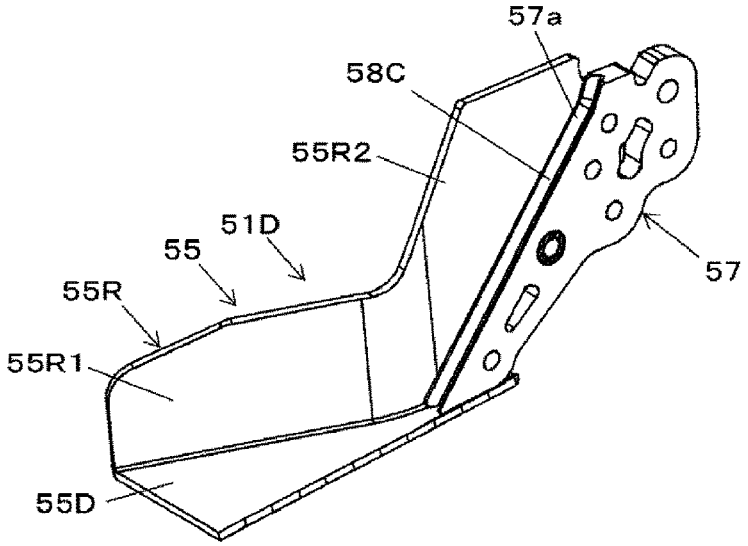
FIG. 17B is a broken perspective view depicting the inductive guide of the fourth embodiment.

FIG. 17A is a sectional view depicting an inductive guide of a fourth embodiment, and FIG. 17B is a broken perspective view depicting the inductive guide of the fourth embodiment. In an inductive guide 51D of the fourth embodiment, the configurations that are equivalent to those of the inductive guide 51A of the first embodiment are denoted with the same reference signs, and the descriptions thereof are omitted.

The inductive guide 51D of the fourth embodiment has a parallel alignment regulation part 58D provided on the guide surface 57*a*. The parallel alignment regulation part 58D is configured by providing the guide surface 57*a* with two inclined surfaces that are inclined in directions intersecting with the extension direction of the guide surface 57*a* and along an alignment direction of the two wires W. That is, the parallel alignment regulation part 58D is configured as a groove part having a V-shaped section in the extension direction of the guide surface 57*a*.

Thereby, one of the two wires W guided to the second guide part 57 comes into contact with a surface, which is located on a radially outer side of the loop Ru to be formed by the wires W, of the inclined surface configuring the parallel alignment regulation part 58D, and the other wire comes into contact with a surface located on a radially inner side of the loop Ru or with the wire W located on the radially outer side of the loop Ru. Therefore, the parallel alignment direction of the two wires W guided to the second guide part 57 deviates in the radial direction of the loop Ru. Therefore, the parallel alignment direction of the two wires W between the fixed engaging member 70C and the second movable engaging member 70R is guided in the radial direction of the loop Ru.

Figure 18A:
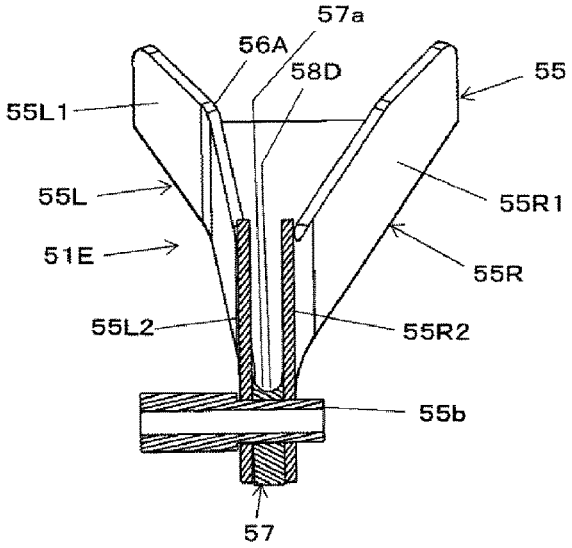
FIG. 18A is a sectional view depicting an inductive guide of a fifth embodiment.
Figure 18B:
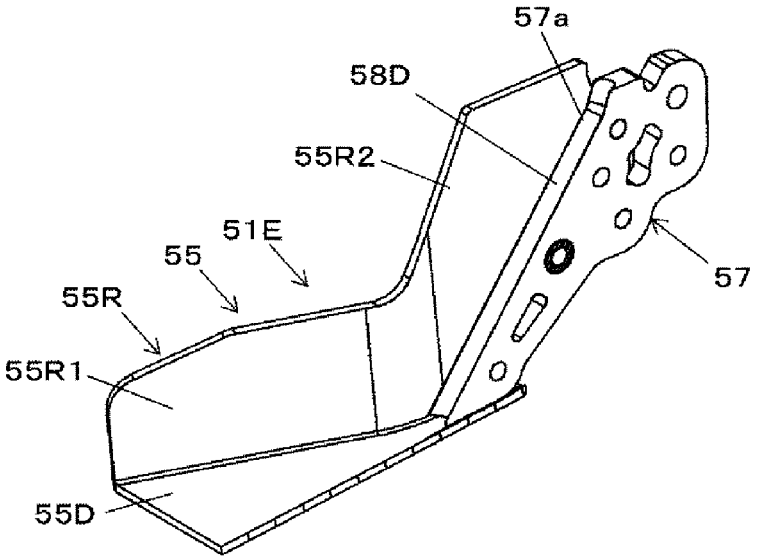
FIG. 18B is a broken perspective view depicting the inductive guide of the fifth embodiment.

FIG. 18A is a sectional view depicting an inductive guide of a fifth embodiment, and FIG. 18B is a broken perspective view depicting the inductive guide of the fifth embodiment. In an inductive guide 51E of the fourth embodiment, the configurations that are equivalent to those of the inductive guide 51A of the first embodiment are denoted with the same reference signs, and the descriptions thereof are omitted.

The inductive guide 51E of the fifth embodiment has a parallel alignment regulation part 58E provided on the guide surface 57*a*. The parallel alignment regulation part 58E is configured by providing the guide surface 57*a* with a groove part having a U-shaped section in the extension direction of the guide surface 57*a*.

Thereby, one of the two wires W guided to the second guide part 57 comes into contact with a surface, which is located on a radially outer side of the loop Ru to be formed by the wires W, of the surface configuring the parallel alignment regulation part 58E, and the other wire comes into contact with a surface located on a radially inner side of the loop Ru or with the wire W located on the radially outer side of the loop Ru. Therefore, the parallel alignment direction of the two wires W guided to the second guide part 57 deviates in the radial direction of the loop Ru. Therefore, the parallel alignment direction of the two wires W between the fixed engaging member 70C and the second movable engaging member 70R is guided in the radial direction of the loop Ru.

<Example of Operational Effect of Aligning Two Wires in Parallel in Predetermined Direction>

Subsequently, an aspect where the two wires W are aligned in parallel between the second movable engaging member 70R and the fixed engaging member 70C when engaging the two wires W in the engaging member 70 is described.

In the reinforcing bar binding machine of the related art, when it is assumed that a locus of wires curled to form a loop by the curl guide is a circle, a diameter thereof is about 50 to 70 mm. For this reason, in the reinforcing bar binding machine of the related art, the wires W are guided to the engaging member 70 of the binding unit 7A without the wires W contacting the guide surface 57*a* of the second guide part 57.

In contrast, according to the reinforcing bar binding machine 1A, when it is assumed that a locus of wires W curled to form the loop Ru by the curl guide 50 is an ellipse, a length in a long axis direction is about equal to or greater than 75 mm and equal to or less than 100 mm.

In this way, when the length in the long axis direction is about equal to or greater than 75 mm and equal to or less than 100 mm, on the assumption that the locus of wires W curled to form the loop Ru by the curl guide 50 is an ellipse, the wires W guided to the second guide part 57 come into contact with the guide surface 57*a*, as shown in FIGS. 12A and 12B, and are thus guided to the engaging member 70 of the binding unit 7A.

When the two wires W come into contact with the guide surface 57*a*, the wires W are guided between the fixed engaging member 70C and the second movable engaging member 70R in a state in which a parallel alignment direction of the two wires W is regulated by the guide surface 57*a*.

When the two wires W are fed with being in contact with the guide surface 57*a*, the two wires W are aligned in parallel in a direction along an axial direction of the loop Ru to be formed by the wires W. In the reinforcing bar binding machine 1A, a direction in which the first movable engaging member 70L and the second movable engaging member 70R are opened/closed with respect to the fixed engaging member 70C is the direction along the axial direction of the loop Ru to be formed by the wires W.

Thereby, the two wires W guided between the fixed engaging member 70C and the second movable engaging member 70R are likely to be aligned in parallel in the opening/closing direction of the second movable engaging member 70R with respect to the fixed engaging member 70C.

FIGS. 13A, 13B and 13C illustrate engaged states of the wires in the engaging member.

Figure 20A:
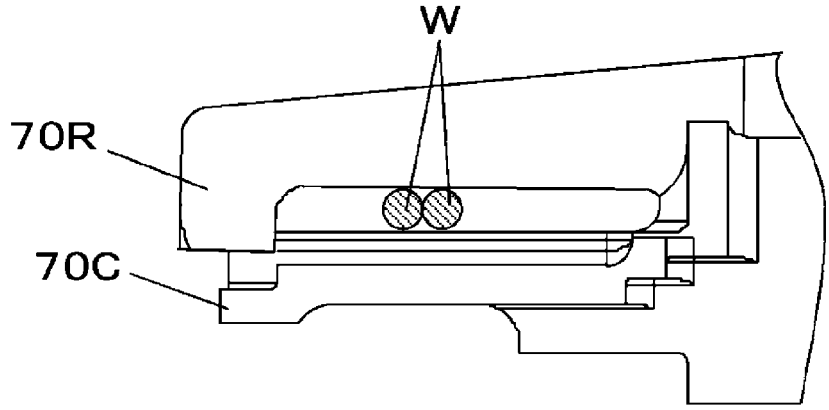
FIG. 20A illustrates an engaged state of the wires in an engaging member.
Figure 20B:
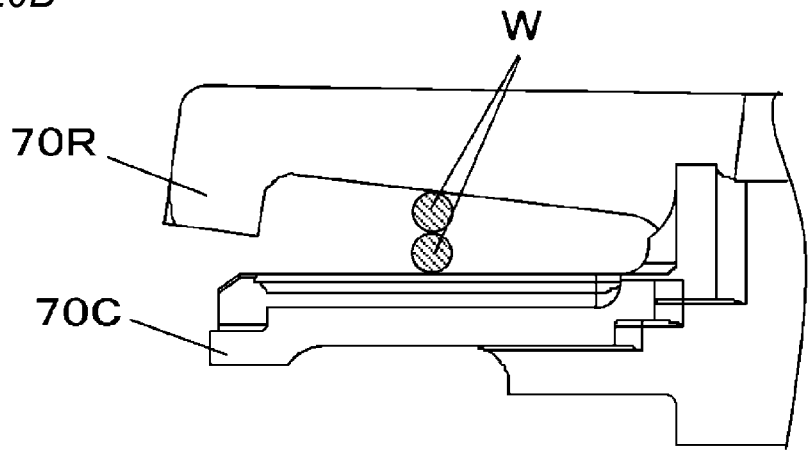
FIG. 20B illustrates an engaged state of the wires in the engaging member.
Figure 20C:
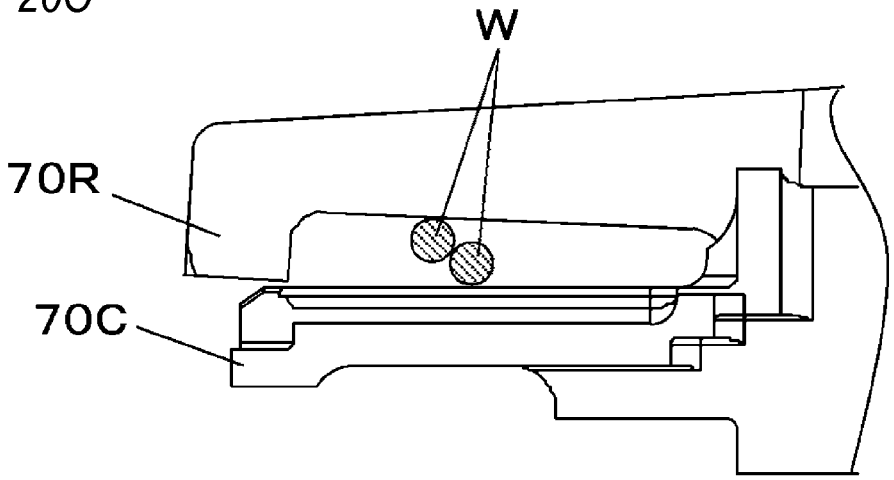
FIG. 20C illustrates an engaged state of the wires in the engaging member.

FIG. 20A depicts a state in which the two wires W are aligned in parallel with intersecting with the opening/closing direction of the second movable engaging member 70R with respect to the fixed engaging member 70C when the two wires W are sandwiched between the second movable engaging member 70R and the fixed engaging member 70C. Also, FIG. 20B depicts a state in which the two wires W are aligned in parallel in the opening/closing direction of the second movable engaging member 70R with respect to the fixed engaging member 70C. Also, FIG. 20C depicts a state in which the parallel alignment state of the two wires W in the opening/closing direction of the second movable engaging member 70R can be easily released by an operation of sandwiching the two wires W between the second movable engaging member 70R and the fixed engaging member 70C.

As shown in FIG. 20A, in the aspect where the two wires W are aligned in parallel with intersecting with the opening/closing direction of the second movable engaging member 70R with respect to the fixed engaging member 70C, the two wires W are engaged between the fixed engaging member 70C and the second movable engaging member 70R in a state in which an interval corresponding to one wire is formed therebetween. Thereby, the interval between the second movable engaging member 70R and the fixed engaging member 70C is equivalent to a diameter of the wire W.

In contrast, as shown in FIG. 20B, in the aspect where the two wires W are aligned in parallel in the opening/closing direction of the second movable engaging member 70R with respect to the fixed engaging member 70C, the two wires W are engaged between the fixed engaging member 70C and the second movable engaging member 70R in a state in which that an interval corresponding to about two wires is formed therebetween. Thereby, the interval between the second movable engaging member 70R and the fixed engaging member 70C is twice as large as the diameter of the wire W.

When sandwiching the two wires W between the second movable engaging member 70R and the fixed engaging member 70C, in order to engage the two wires W in the aspect shown in FIG. 20A, a movable range of the second movable engaging member 70R is determined.

For this reason, when the two wires W are aligned in the aspect shown in FIG. 20B, after the two wires W are sandwiched between the second movable engaging member 70R and the fixed engaging member 70C, the second movable engaging member 70R cannot be further moved toward the fixed engaging member 70C.

Therefore, control of releasing the parallel alignment state of the two wires Win the opening/closing direction of the second movable engaging member 70R is executed so that the two wires W sandwiched between the second movable engaging member 70R and the fixed engaging member 70C are aligned in parallel in a predetermined direction.

Figure 21:
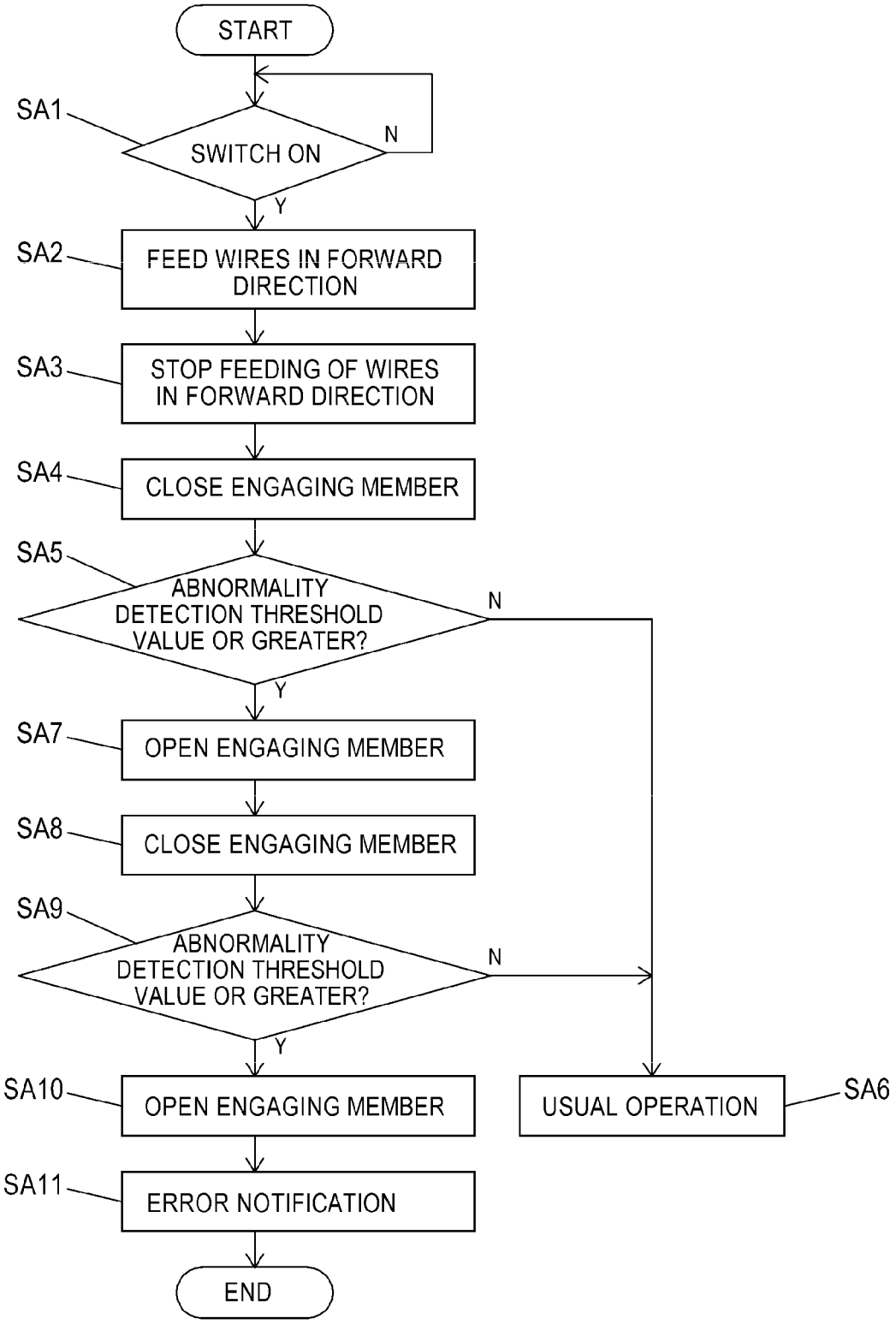
FIG. 21 is a flowchart depicting a sixth embodiment of control of aligning two wires in parallel in a predetermined direction.

FIG. 21 is a flowchart depicting a sixth embodiment of control of aligning two wires in parallel in a predetermined direction, and FIG. 22A to FIG. 22I illustrate an example of an operation of aligning two wires in parallel in a predetermined direction. In the below, an embodiment of operations of estimating the parallel alignment state of the two wires W and releasing the parallel alignment state of the two wires W in the opening/closing direction of the second movable engaging member 70R is described.

In step SA1 of FIG. 21, when it is determined that the switch 13A is in a predetermined state, in the present example, the switch 13A becomes on, the control unit 14A drives the feeding motor 33 in the forward rotation direction to feed the two wires W in the forward direction, in step SA2.

Figure 22A:
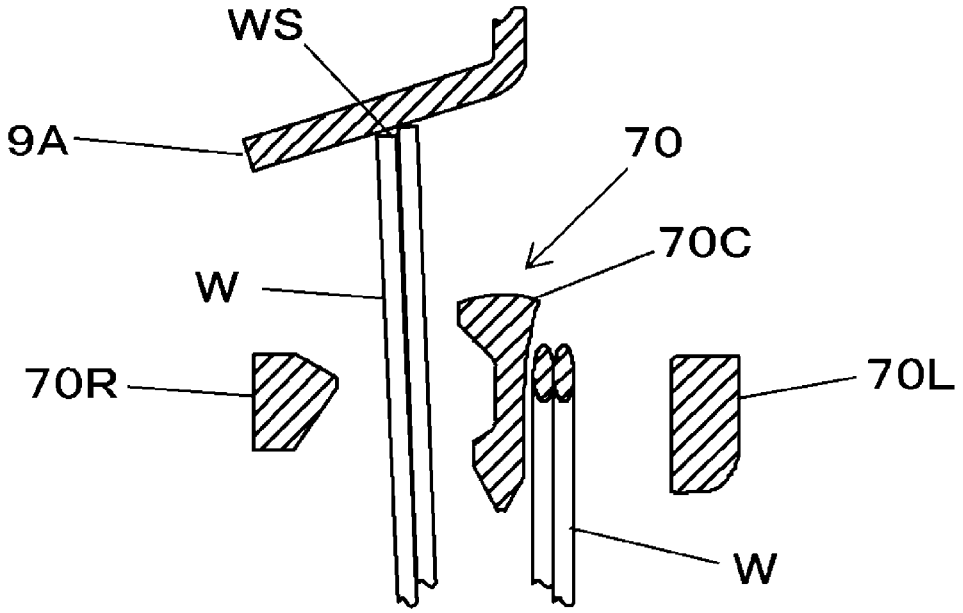
FIG. 22A illustrates an example of an operation of aligning two wires in parallel in a predetermined direction.

When the two wires W guided between the second movable engaging member 70R and the fixed engaging member 70C are fed to a position in which the tip ends WS are butted to the feeding regulation unit 9A, as shown in FIG. 22A, the control unit 14A stops the drive of the feeding motor 33 to stop the feeding of the wires W in the forward direction, in step SA3.

Figure 22B:
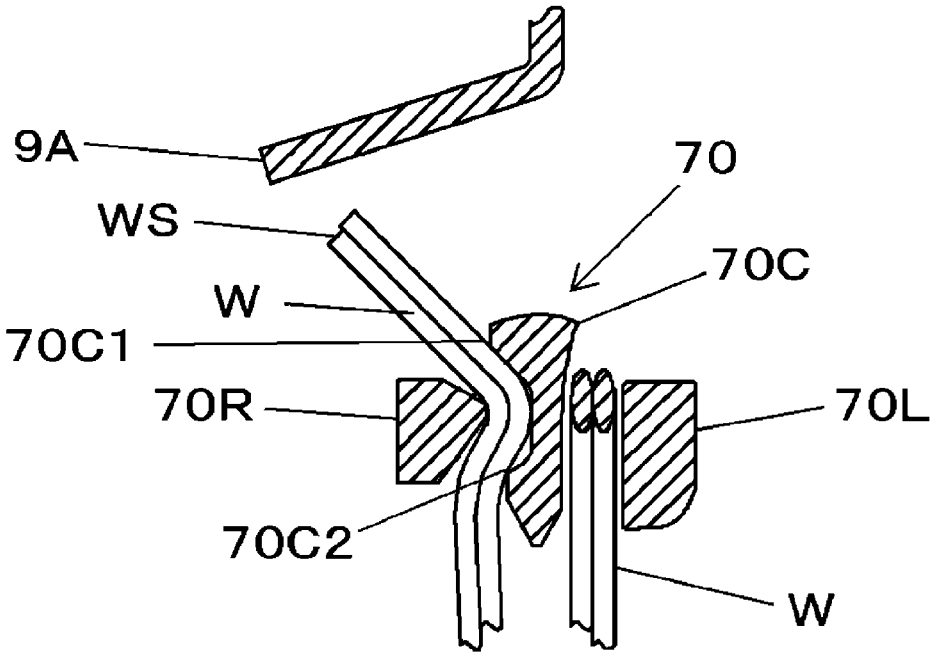
FIG. 22B illustrates an example of an operation of aligning two wires in parallel in a predetermined direction.

When the control unit 14A stops the drive of the feeding motor 33, the control unit drives the motor 80 in the forward rotation direction to move the first movable engaging member 70L toward the fixed engaging member 70C and to move the second movable engaging member 70R toward the fixed engaging member 70C, thereby closing the engaging member 70, in step SA4, as shown in FIG. 22B.

When the two wires W can be aligned in the aspect shown in FIG. 20A by the operation of sandwiching the two wires W between the second movable engaging member 70R and the fixed engaging member 70C, the second movable engaging member 70R is moved to a predetermined position toward the fixed engaging member 70C. That is, the second movable engaging member 70R is moved toward the fixed engaging member 70C until an interval corresponding to one wire is formed between the fixed engaging member 70C and the second movable engaging member 70R. The first movable engaging member 70L is also moved to a predetermined position toward the fixed engaging member 70C in conjunction with the second movable engaging member 70R.

In contrast, when the two wires W sandwiched between the second movable engaging member 70R and the fixed engaging member 70C are aligned in the aspect shown in FIG. 20B, an interval corresponding to two wires is formed between the fixed engaging member 70C and the second movable engaging member 70R.

If the direction in which the two wires W are aligned in the aspect shown in FIG. 20B cannot be switched to the aspect shown in FIG. 20A, the second movable engaging member 70R cannot be further moved toward the fixed engaging member 70C from the state in which the interval corresponding to two wires is formed between the fixed engaging member 70C and the second movable engaging member 70R, so that a load to be applied to the engaging member 70 increases.

Also, even when the motor 80 continues to rotate in the forward direction, it is not possible to rotate the rotary shaft 72. For this reason, as compared to the configuration in which the second movable engaging member 70R can be moved to the position in which the interval corresponding to one wire is formed between the fixed engaging member 70C and the second movable engaging member 70R, toward the fixed engaging member 70C, the current flowing through the motor 80 increases.

Therefore, the control unit 14A estimates a parallel alignment state of the two wires W by detecting the current flowing through the motor 80 with the current detection unit 16A. Then, the control unit 14A executes an operation of releasing the parallel alignment state of the two wires W in the opening/closing direction of the second movable engaging member 70R, in accordance with the parallel alignment state of the two wires.

That is, the control unit 14A detects the current flowing through the motor 80 with the current detection unit 16A, in step SA5. When the current flowing through the motor 80 does not exceed a predetermined value, it can be estimated that the two wires W sandwiched between the second movable engaging member 70R and the fixed engaging member 70C is in a normal state in which the wires are aligned in parallel with intersecting with the opening/closing direction of the second movable engaging member 70R, as shown in FIG. 20A. Thereby, when the current flowing through the motor 80 does not exceed the predetermined threshold value, the control unit 14A executes the usual binding operation, in step SA6.

In contrast, when the current flowing through the motor 80 exceeds the predetermined threshold value, it can be estimated that the two wires W sandwiched between the second movable engaging member 70R and the fixed engaging member 70C is in an abnormal state in which the wires are aligned in parallel in the opening/closing direction of the second movable engaging member 70R, as shown in FIG. 20B. Thereby, when the current flowing through the motor 80 exceeds an abnormality detection threshold value at which the two wires W are not aligned in a normal aspect, the control unit 14A stops the drive of the motor 80 in the forward rotation direction.

When the control unit 14A stops the drive of the motor 80 in the forward rotation direction, the control unit 14A executes operations of opening/closing the first movable engaging member 70L and the second movable engaging member 70R and releasing the parallel alignment state of the two wires W in the opening/closing direction of the second movable engaging member 70R.

First, a case in which the parallel alignment state of the two wires W in the opening/closing direction of the second movable engaging member 70R is released by an operation of opening the first movable engaging member 70L and the second movable engaging member 70R is described.

Figure 22C:
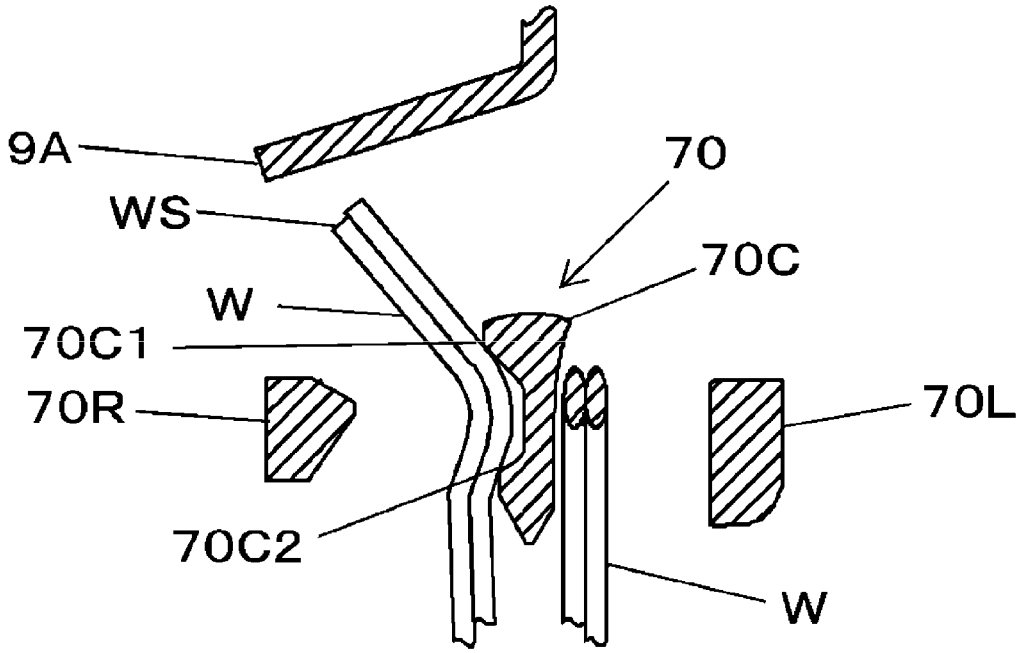
FIG. 22C illustrates an example of an operation of aligning two wires in parallel in a predetermined direction.

In step SA7, the control unit 14A drives the motor 80 in the reverse rotation direction to move the first movable engaging member 70L away from the fixed engaging member 70C and to move the second movable engaging member 70R away from the fixed engaging member 70C, thereby opening the engaging member 70, as shown in FIG. 22C.

When the control unit 14A drives the motor 80 in the reverse rotation direction in a predetermined amount by which the first movable engaging member 70L and the second movable engaging member 70R are opened, the control unit 14A stops the drive of the motor 80 in the reverse rotation direction.

As described above, there is a slight time difference after the tip ends WS of the wires W come into contact with the feeding regulation unit 9A until the drive of the wire feeding unit 3A is stopped. Therefore, the wires W are fed in the forward direction by a slight amount in a state in which the tip ends WS are in contact with the feeding regulation unit 9A, so that the loop Ru formed by the wires W is bent in a radially expanding direction.

In an operation of sandwiching the two wires W of which feeding is stopped between the second movable engaging member 70R and the fixed engaging member 70C, the two wires W are bent about a position as a support point that is pressed with the second movable engaging member 70R, as shown in FIG. 22B, so that the tip ends WS of the wires W separate from the feeding regulation unit 9A.

Figure 22D:
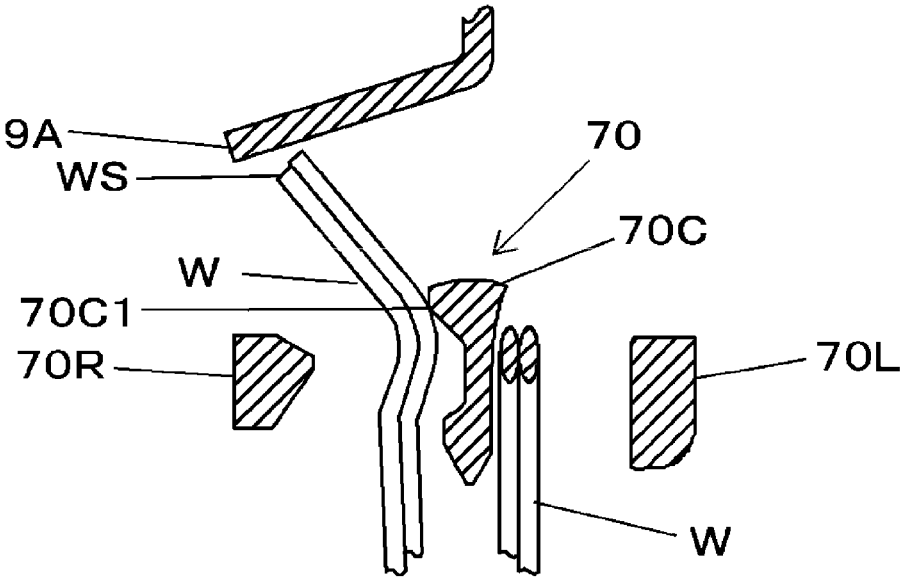
FIG. 22D illustrates an example of an operation of aligning two wires in parallel in a predetermined direction.

Thereby, when the second movable engaging member 70R is opened from the state shown in FIG. 22B, the tip ends WS of the wires W intend to move toward the feeding regulation unit 9A due to elasticity of the wires W bent in the radially expanding direction, as shown in FIG. 22D. In the aspect in which the two wires W are aligned in parallel in the opening/closing direction of the second movable engaging member 70R, one wire W is difficult to move because it is in contact with the convex part 70C1 of the fixed engaging member 70C. In contrast, the other wire W can easily move because it is not in contact with the convex part 70C1 of the fixed engaging member 70C. For this reason, when the wires W are moved by the operation of opening the second movable engaging member 70R, a force of changing the parallel alignment direction of the two wires W is applied, so that an aspect in which the parallel alignment state of the two wires W in the opening/closing direction of the second movable engaging member 70R can be easily released can be formed, as shown in FIG. 20C.

Figure 22E:
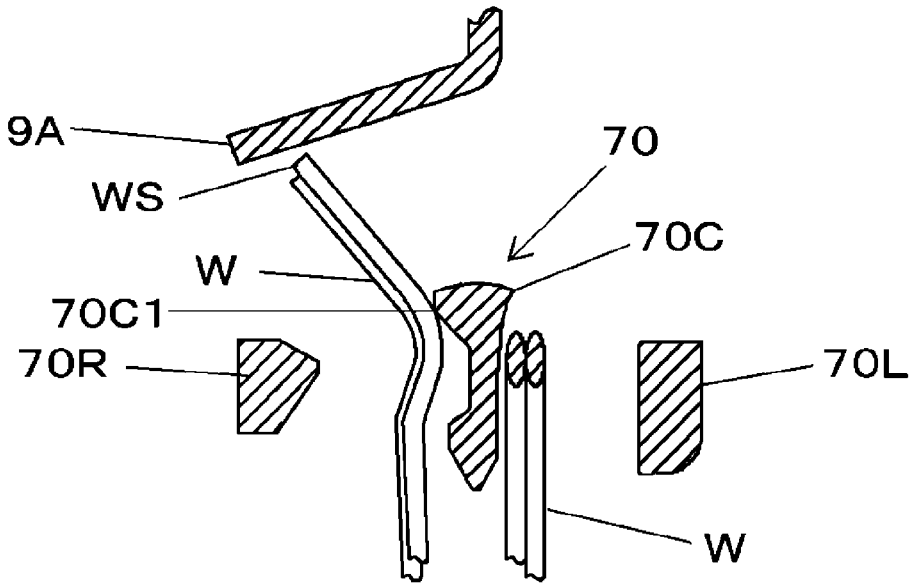
FIG. 22E illustrates an example of an operation of aligning two wires in parallel in a predetermined direction.

Therefore, the parallel alignment state of the two wires W in the opening/closing direction of the second movable engaging member 70R is released by the operation of opening the second movable engaging member 70R, so that the two wires W can be aligned in parallel with intersecting with the opening/closing direction of the second movable engaging member 70R, as shown in FIG. 22E.

Subsequently, a case in which the parallel alignment state of the two wires Win the opening/closing direction of the second movable engaging member 70R is released by an operation of closing again the first movable engaging member 70L and the second movable engaging member 70R is described.

Figure 22F:
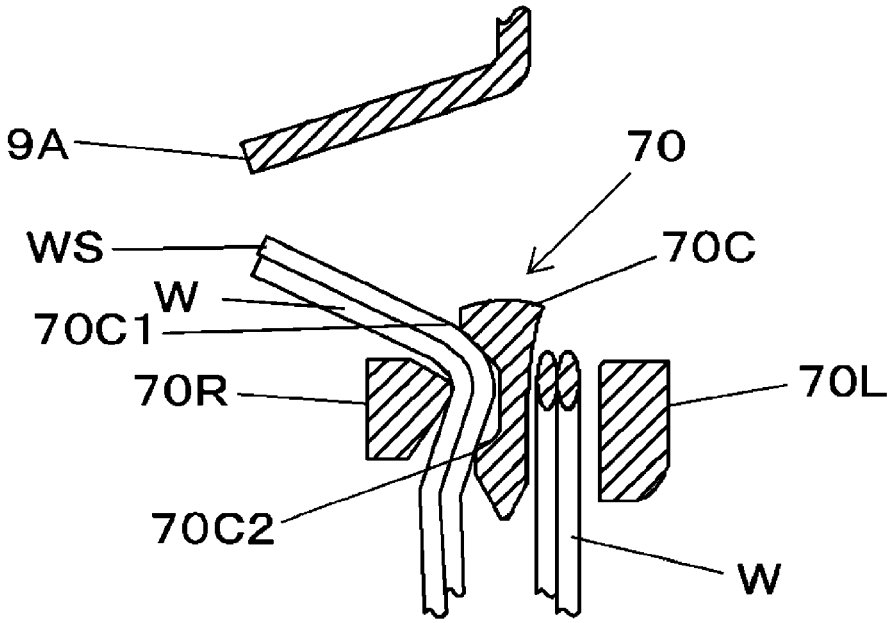
FIG. 22F illustrates an example of an operation of aligning two wires in parallel in a predetermined direction.

When the control unit 14A stops the drive of the motor 80 in the reverse rotation direction, the control unit 14A drives the motor 80 in the forward rotation direction to move the first movable engaging member 70L toward the fixed engaging member 70C and to move the second movable engaging member 70R toward the fixed engaging member 70C, thereby closing the engaging member 70, in step SA8, as shown in FIG. 22F.

By the operation of sandwiching the two wires W between the second movable engaging member 70R and the fixed engaging member 70C, the two wires W are pushed toward the fixed engaging member 70C with the second movable engaging member 70R, and a force of changing the parallel alignment direction of the two wires W at the convex parts 70C1 and 70C2 of the fixed engaging member 70C as a support point is applied, so that an aspect in which the parallel alignment state of the two wires W in the opening/closing direction of the second movable engaging member 70R can be easily released can be formed, as shown in FIG. 20C.

Figure 22G:
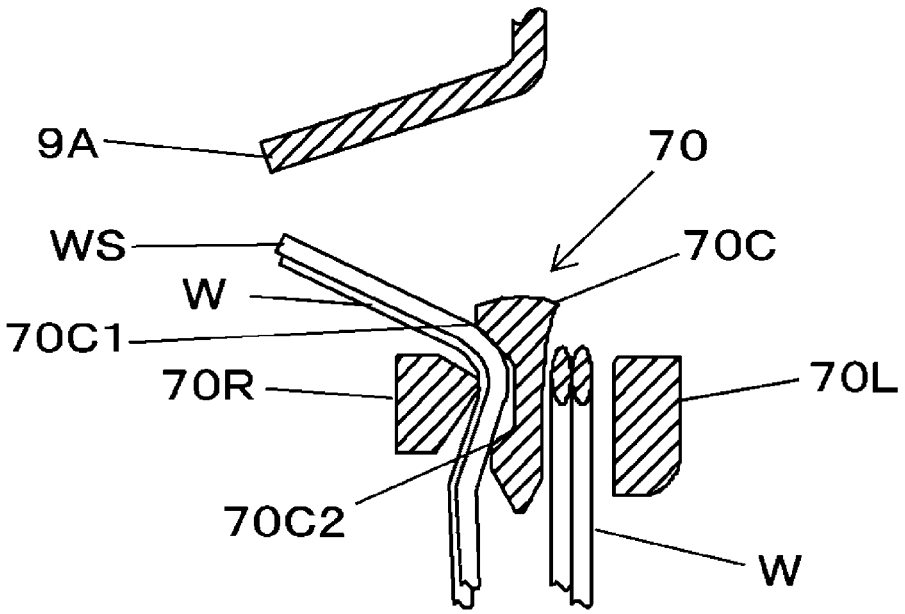
FIG. 22G illustrates an example of an operation of aligning two wires in parallel in a predetermined direction.

Therefore, the parallel alignment state of the two wires W in the opening/closing direction of the second movable engaging member 70R is released by the operation of closing the second movable engaging member 70R, so that the two wires W can be aligned in parallel with intersecting with the opening/closing direction of the second movable engaging member 70R, as shown in FIG. 22G.

Figure 22H:
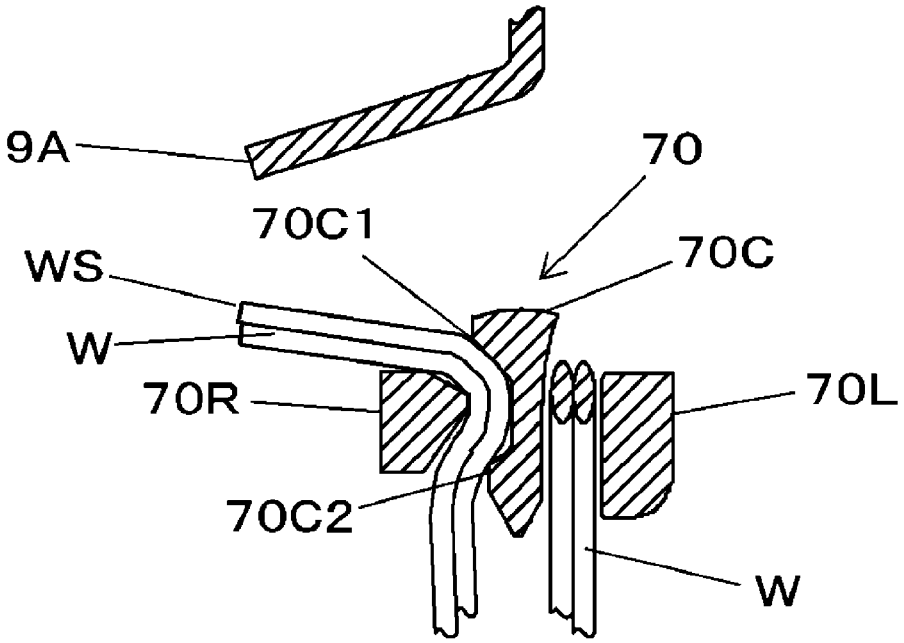
FIG. 22H illustrates an example of an operation of aligning two wires in parallel in a predetermined direction.

Also, as shown in FIG. 22F, the parallel alignment state of the wires W in the predetermined direction may not be released even though the second movable engaging member 70R is moved toward the fixed engaging member 70C. That is, the state as shown in FIG. 20C may not be formed. Even in this case, as shown in FIG. 22H, when the second movable engaging member 70R is further moved toward the fixed engaging member 70C, the two wires W are pushed toward the fixed engaging member 70C by the second movable engaging member 70R, so that the force of changing the parallel alignment direction of the two wires W at the convex parts 70C1 and 70C2 of the fixed engaging member 70C as a support point is applied and the aspect in which the parallel alignment state of the two wires W in the opening/closing direction of the second movable engaging member 70R can be easily released can be formed, as shown in FIG. 20C.

Figure 22I:
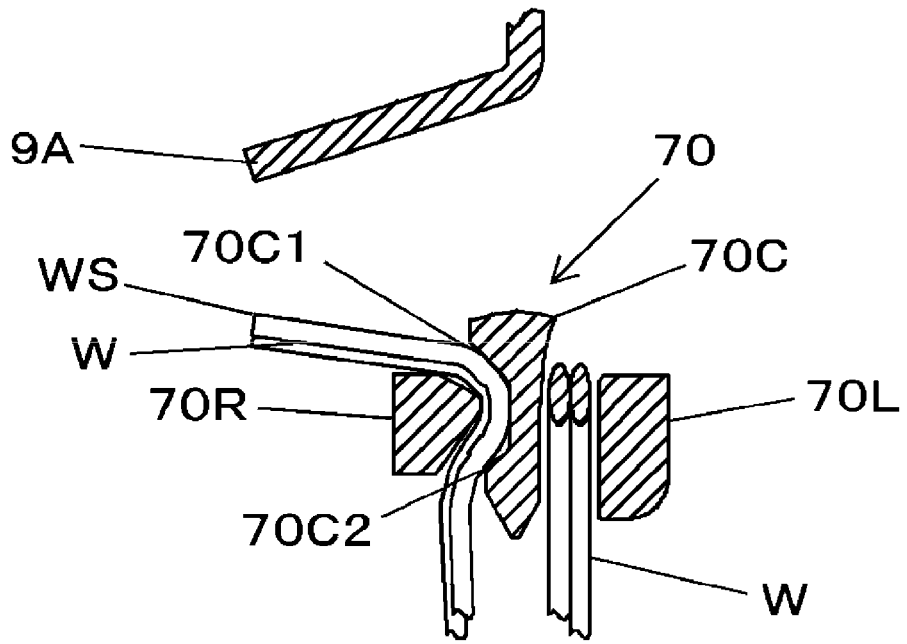
FIG. 22I illustrates an example of an operation of aligning two wires in parallel in a predetermined direction.

Therefore, the parallel alignment state of the two wires W in the opening/closing direction of the second movable engaging member 70R is released by the operation of further closing the second movable engaging member 70R, so that the two wires W can be aligned in parallel with intersecting with the opening/closing direction of the second movable engaging member 70R, as shown in FIG. 22I.

In step SA9, the control unit 14A detects the current flowing through the motor 80 with the current detection unit 16A. If the parallel alignment state of the two wires W in the opening/closing direction of the second movable engaging member 70R is released by the operation of opening/closing the first movable engaging member 70L and the second movable engaging member 70R, the current flowing through the motor 80 does not exceed the predetermined value when the motor 80 is driven in the forward rotation direction. For this reason, when the current flowing through the motor 80 does not exceed the abnormality detection threshold value, the control unit 14A continues to perform the usual binding operation, in step SA6.

In contrast, when the current flowing through the motor 80 exceeds the abnormality detection threshold value, the control unit 14A estimates that the parallel alignment state of the two wires W in the opening/closing direction of the second movable engaging member 70R is not released, determines that an error has occurred, and stops the drive of the motor 80 in the forward rotation direction. In the meantime, the abnormality detection threshold value may vary. For example, an abnormality detection threshold value in a first operation of closing the first movable engaging member 70L and the second movable engaging member 70R is set greater than an abnormality detection threshold value in a second operation of closing the first movable engaging member 70L and the second movable engaging member 70R. During the first binding operation, the control unit 14A switches the abnormality detection threshold value, in accordance with the number of times of closing the first movable engaging member 70L and the second movable engaging member 70R.

When the control unit 14A stops the drive of the motor 80 in the forward rotation direction, the control unit 14A drives the motor 80 in the reverse rotation direction to move the first movable engaging member 70L away from the fixed engaging member 70C and to move the second movable engaging member 70R away from the fixed engaging member 70C, thereby opening the engaging member 70, in step SA10.

When the control unit 14A drives the motor 80 in the reverse rotation direction in the predetermined amount by which the first movable engaging member 70L and the second movable engaging member 70R are opened, the control unit 14A stops the drive of the motor 80 in the reverse rotation direction. Then, in step SA11, the control unit 14A drives the notification unit 17A to notify an error.

Figure 23:
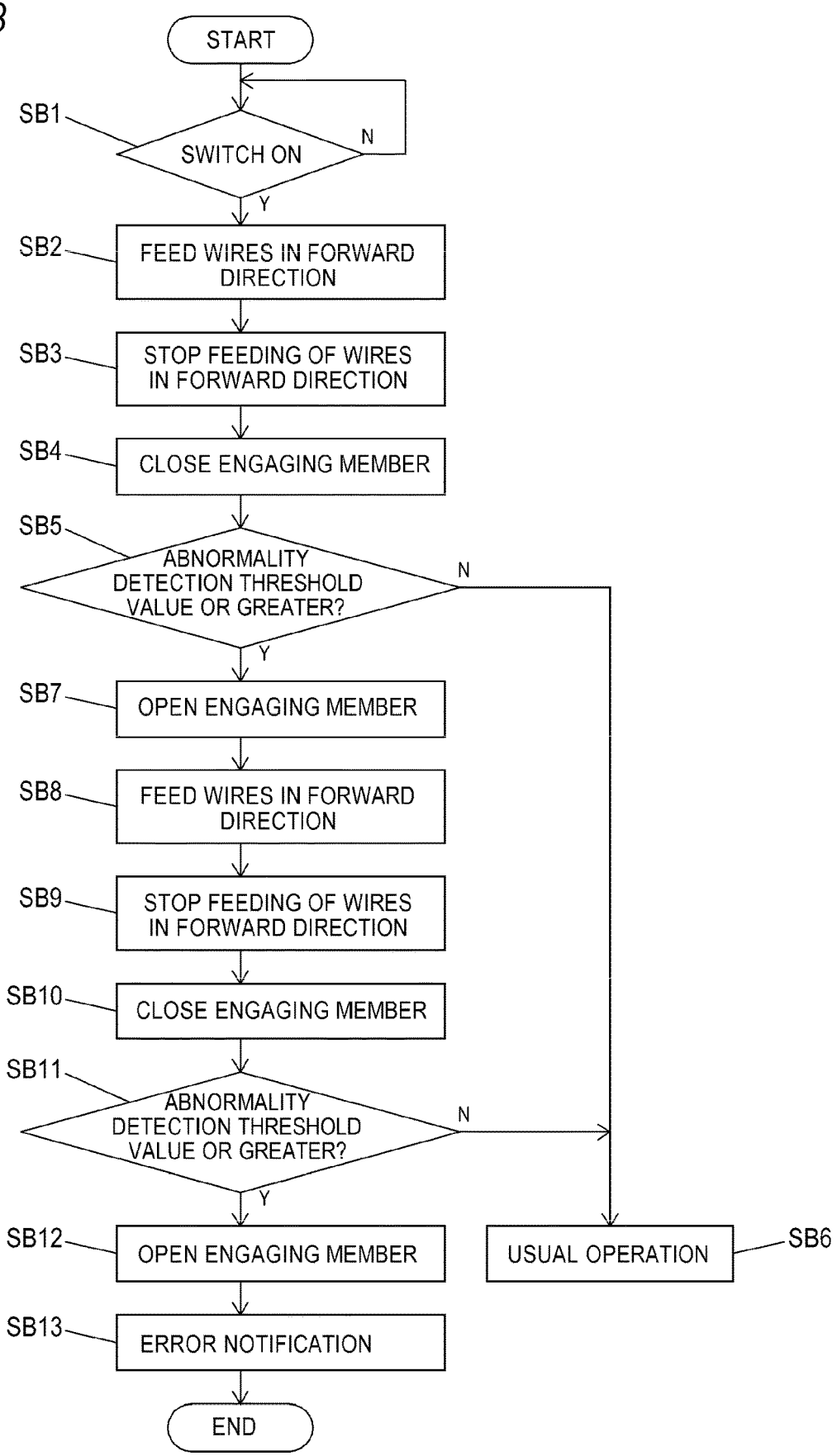
FIG. 23 is a flowchart depicting a seventh embodiment of control of aligning two wires in parallel in a predetermined direction.

FIG. 23 is a flowchart depicting a seventh embodiment of control of aligning two wires in parallel in a predetermined direction. In the below, another embodiment of estimating the parallel alignment state of the two wires W and releasing the parallel alignment state of the two wires W in the opening/closing direction of the second movable engaging member 70R is described.

In step SB1 of FIG. 23, when it is determined that the switch 13A is in a predetermined state, in the present example, the switch 13A becomes on, the control unit 14A drives the feeding motor 33 in the forward rotation direction to feed the two wires W in the forward direction, in step SB2.

When the two wires W guided between the second movable engaging member 70R and the fixed engaging member 70C are fed to a position in which the tip ends WS are butted to the feeding regulation unit 9A, the control unit 14A stops the drive of the feeding motor 33 to stop the feeding of the wires W in the forward direction, in step SB3.

When the control unit 14A stops the drive of the feeding motor 33, the control unit drives the motor 80 in the forward rotation direction to move the first movable engaging member 70L toward the fixed engaging member 70C and to move the second movable engaging member 70R toward the fixed engaging member 70C, thereby closing the engaging member 70, in step SB4.

The control unit 14A detects the current flowing through the motor 80 with the current detection unit 16A, in step SB5. When the current flowing through the motor 80 does not exceed an abnormality detection threshold value, the control unit 14A executes the usual binding operation, in step SB6.

In contrast, when the current flowing through the motor 80 exceeds the abnormality detection threshold value, the control unit 14A stops the drive of the motor 80 in the forward rotation direction.

When the control unit 14A stops the drive of the motor 80 in the forward rotation direction, the control unit 14A executes operations of opening/closing the first movable engaging member 70L and the second movable engaging member 70R, feeding the wires W in the forward direction by a slight amount and releasing the parallel alignment state of the two wires W in the opening/closing direction of the second movable engaging member 70R.

In step SB7, the control unit 14A drives the motor 80 in the reverse rotation direction to move the first movable engaging member 70L away from the fixed engaging member 70C and to move the second movable engaging member 70R away from the fixed engaging member 70C, thereby opening the engaging member 70.

When the control unit 14A drives the motor 80 in the reverse rotation direction in a predetermined amount by which the first movable engaging member 70L and the second movable engaging member 70R are opened, the control unit 14A stops the drive of the motor 80 in the reverse rotation direction.

When the control unit 14A opens the engaging member 70, the control unit 14A drives the feeding motor 33 in the forward rotation direction to feed the two wires W in the forward direction, in step SB8. When the control unit 14A feeds the wires W in the forward direction by a predetermined slight amount, the control unit 14A stops the drive of the feeding motor 33 to stop the feeding of the wire W in the forward direction, in step SB9.

As described above, in the aspect in which the two wires W are aligned in parallel in the opening/closing direction of the second movable engaging member 70R, one wire W in contact with the convex part 70C1 of the fixed engaging member 70C is difficult to move. In contrast, the other wire W that is not in contact with the convex part 70C1 of the fixed engaging member 70C can easily move. For this reason, the second movable engaging member 70R is opened and the wire W is fed in the forward direction by the slight amount, so that a force of changing the parallel alignment direction of the two wires W is applied. Also, the wire W is fed in the forward direction by the slight amount, so that the tip ends WS of the wires W can easily come into contact with the feeding regulation unit 9A. When the tip ends WS of the wires W come into contact with the feeding regulation unit 9A, the force of changing the parallel alignment direction of the two wires W is applied. Therefore, as shown in FIG. 20C, the aspect in which the parallel alignment state of the two wires W in the opening/closing direction of the second movable engaging member 70R can be easily released can be formed.

Therefore, the parallel alignment state of the two wires W in the opening/closing direction of the second movable engaging member 70R is released by the operation of opening the second movable engaging member 70R and the operation of feeding the wires W, so that the two wires W can be aligned in parallel with intersecting with the opening/closing direction of the second movable engaging member 70R.

When the control unit 14A stops the drive of the motor 80 in the reverse rotation direction to stop the feeding of the wire W, the control unit 14A drives the motor 80 in the forward rotation direction to move the first movable engaging member 70L toward the fixed engaging member 70C and to move the second movable engaging member 70R toward the fixed engaging member 70C, thereby closing the engaging member 70, in step SB10.

By the operation of sandwiching the two wires W between the second movable engaging member 70R and the fixed engaging member 70C, the force of changing the parallel alignment direction of the two wires W is applied, so that the aspect in which the parallel alignment state of the two wires W in the opening/closing direction of the second movable engaging member 70R can be easily released can be formed, as shown in FIG. 20C. Also, the wires W are fed by the slight amount, so that the contact positions of the wires W with the second movable engaging member 70R and the fixed engaging member 70C are changed. Thereby, the force of changing the parallel alignment direction of the two wires W is applied, so that the aspect in which the parallel alignment state of the two wires W in the opening/closing direction of the second movable engaging member 70R can be easily released can be formed, as shown in FIG. 20C.

Therefore, the parallel alignment state of the two wires W in the opening/closing direction of the second movable engaging member 70R is released by the operation of closing the second movable engaging member 70R, so that the two wires W can be aligned in parallel with intersecting with the opening/closing direction of the second movable engaging member 70R.

Also, the parallel alignment state of the wires Win the predetermined direction may not be released even though the second movable engaging member 70R is moved toward the fixed engaging member 70C. That is, the state as shown in FIG. 20C may not be formed. Even in this case, when the second movable engaging member 70R is further moved toward the fixed engaging member 70C, the two wires W are pushed toward the fixed engaging member 70C by the second movable engaging member 70R, so that the force of changing the parallel alignment direction of the two wires W is applied and the aspect in which the parallel alignment state of the two wires W in the opening/closing direction of the second movable engaging member 70R can be easily released can be formed, as shown in FIG. 20C.

Therefore, the parallel alignment state of the two wires W in the opening/closing direction of the second movable engaging member 70R is released by the operation of further closing the second movable engaging member 70R, so that the two wires W can be aligned in parallel with intersecting with the opening/closing direction of the second movable engaging member 70R.

In step SB11, the control unit 14A detects the current flowing through the motor 80 with the current detection unit 16A. If the parallel alignment state of the two wires W in the opening/closing direction of the second movable engaging member 70R is released by the operation of opening/closing the first movable engaging member 70L and the second movable engaging member 70R and the operation of feeding the wires W by the slight amount, the current flowing through the motor 80 does not exceed the abnormality detection threshold value when the motor 80 is driven in the forward rotation direction. For this reason, when the current flowing through the motor 80 does not exceed the abnormality detection threshold value, the control unit 14A continues to perform the usual binding operation, in step SB6.

In contrast, when the current flowing through the motor 80 exceeds the abnormality detection threshold value, the control unit 14A estimates that the parallel alignment state of the two wires W in the opening/closing direction of the second movable engaging member 70R is not released, determines that an error has occurred, and stops the drive of the motor 80 in the forward rotation direction. In the meantime, as described above, the control unit 14A may be set so that the abnormality detection threshold value can be switched.

When the control unit 14A stops the drive of the motor 80 in the forward rotation direction, the control unit 14A drives the motor 80 in the reverse rotation direction to move the first movable engaging member 70L away from the fixed engaging member 70C and to move the second movable engaging member 70R away from the fixed engaging member 70C, thereby opening the engaging member 70, in step SB12.

When the control unit 14A drives the motor 80 in the reverse rotation direction in the predetermined amount by which the first movable engaging member 70L and the second movable engaging member 70R are opened, the control unit 14A stops the drive of the motor 80 in the reverse rotation direction. Then, in step SB13, the control unit 14A drives the notification unit 17A to notify an error.

Figure 24:
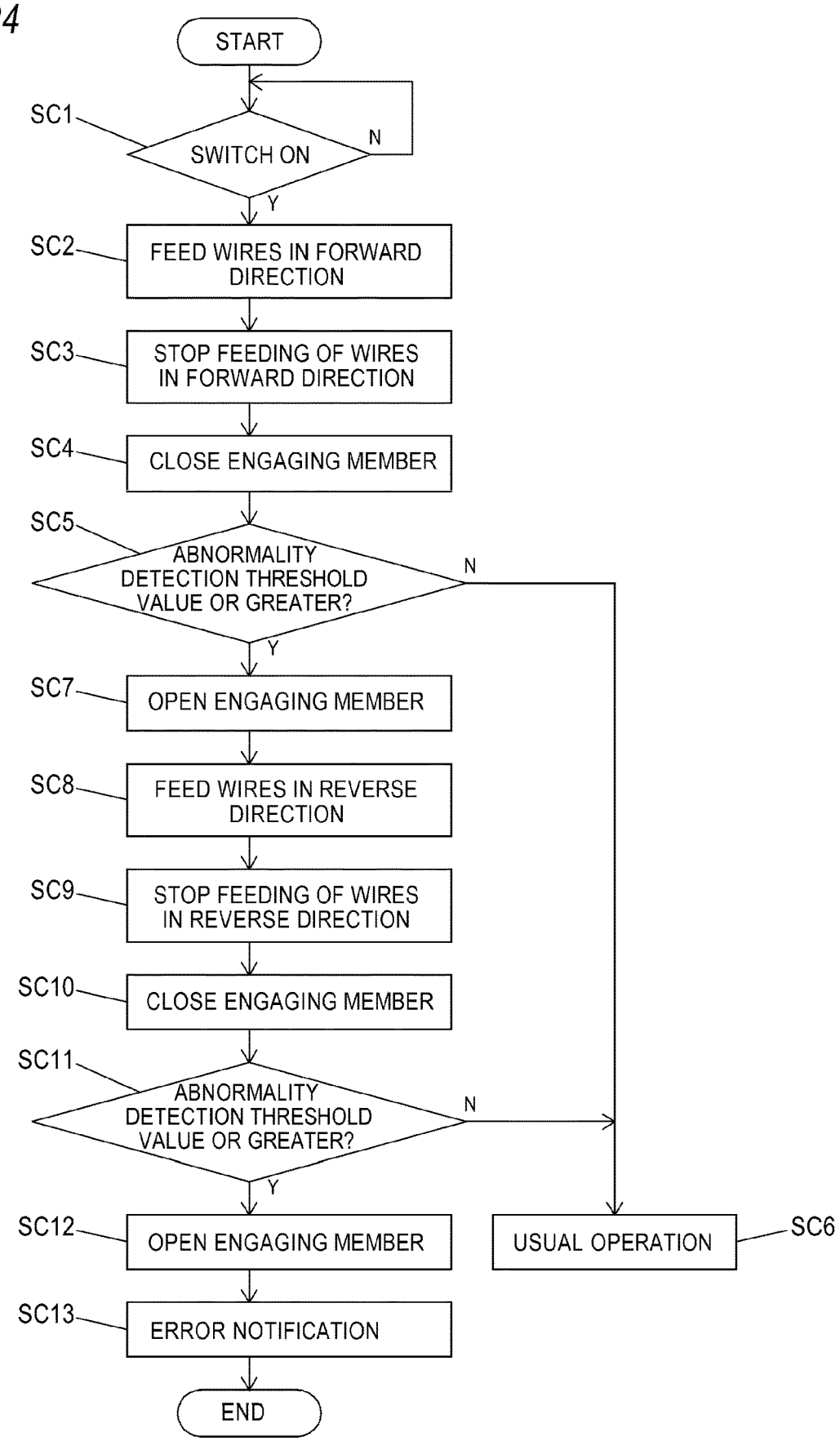
FIG. 24 is a flowchart depicting a eighth embodiment of control of aligning two wires in parallel in a predetermined direction.

FIG. 24 is a flowchart depicting a eighth embodiment of control of aligning two wires in parallel in a predetermined direction. In the below, another embodiment of estimating the parallel alignment state of the two wires W and releasing the parallel alignment state of the two wires W in the opening/closing direction of the second movable engaging member 70R is described.

In step SC1 of FIG. 24, when it is determined that the first movable engaging member 70L, the second movable engaging member 70R and the like are in the standby state, the control unit 14A drives the feeding motor 33 in the forward rotation direction to feed the two wires W in the forward direction, in step SC2.

When the two wires W guided between the second movable engaging member 70R and the fixed engaging member 70C are fed to a position in which the tip ends WS are butted to the feeding regulation unit 9A, the control unit 14A stops the drive of the feeding motor 33 to stop the feeding of the wires W in the forward direction, in step SC3.

When the control unit 14A stops the drive of the feeding motor 33, the control unit drives the motor 80 in the forward rotation direction to move the first movable engaging member 70L toward the fixed engaging member 70C and to move the second movable engaging member 70R toward the fixed engaging member 70C, thereby closing the engaging member 70, in step SC4.

The control unit 14A detects the current flowing through the motor 80 with the current detection unit 16A, in step SC5. When the current flowing through the motor 80 does not exceed an abnormality detection threshold value, the control unit 14A executes the usual binding operation, in step SC6.

In contrast, when the current flowing through the motor 80 exceeds the abnormality detection threshold value, the control unit 14A stops the drive of the motor 80 in the forward rotation direction.

When the control unit 14A stops the drive of the motor 80 in the forward rotation direction, the control unit 14A executes operations of opening/closing the first movable engaging member 70L and the second movable engaging member 70R, feeding the wires W in the reverse direction by a slight amount and releasing the parallel alignment state of the two wires W in the opening/closing direction of the second movable engaging member 70R.

In step SC7, the control unit 14A drives the motor 80 in the reverse rotation direction to move the first movable engaging member 70L away from the fixed engaging member 70C and to move the second movable engaging member 70R away from the fixed engaging member 70C, thereby opening the engaging member 70.

When the control unit 14A drives the motor 80 in the reverse rotation direction in a predetermined amount by which the first movable engaging member 70L and the second movable engaging member 70R are opened, the control unit 14A stops the drive of the motor 80 in the reverse rotation direction.

When the control unit 14A opens the engaging member 70, the control unit 14A drives the feeding motor 33 in the reverse rotation direction to feed the two wires W in the reverse direction, in step SC8. When the control unit 14A feeds the wires W in the reverse direction by a predetermined slight amount, the control unit 14A stops the drive of the feeding motor 33 to stop the feeding of the wire W in the reverse direction, in step SC9.

As described above, in the aspect in which the two wires W are aligned in parallel in the opening/closing direction of the second movable engaging member 70R, one wire W in contact with the convex part 70C1 of the fixed engaging member 70C is difficult to move. In contrast, the other wire W that is not in contact with the convex part 70C1 of the fixed engaging member 70C can easily move. For this reason, even when the second movable engaging member 70R is opened and the wire W is fed in the reverse direction by the slight amount, a force of changing the parallel alignment direction of the two wires W is applied. Therefore, as shown in FIG. 20C, the aspect in which the parallel alignment state of the two wires W in the opening/closing direction of the second movable engaging member 70R can be easily released can be formed.

Therefore, the parallel alignment state of the two wires W in the opening/closing direction of the second movable engaging member 70R is released by the operation of opening the second movable engaging member 70R and the operation of feeding the wires W, so that the two wires W can be aligned in parallel with intersecting with the opening/closing direction of the second movable engaging member 70R.

When the control unit 14A stops the drive of the motor 80 in the reverse rotation direction to stop the feeding of the wire W, the control unit 14A drives the motor 80 in the forward rotation direction to move the first movable engaging member 70L toward the fixed engaging member 70C and to move the second movable engaging member 70R toward the fixed engaging member 70C, thereby closing the engaging member 70, in step SC10.

By the operation of sandwiching the two wires W between the second movable engaging member 70R and the fixed engaging member 70C, the force of changing the parallel alignment direction of the two wires W is applied, so that the aspect in which the parallel alignment state of the two wires W in the opening/closing direction of the second movable engaging member 70R can be easily released can be formed, as shown in FIG. 20C. Also, the wires W are fed by the slight amount, so that the contact positions of the wires W with the second movable engaging member 70R and the fixed engaging member 70C are changed. Thereby, the force of changing the parallel alignment direction of the two wires W is applied, so that the aspect in which the parallel alignment state of the two wires W in the opening/closing direction of the second movable engaging member 70R can be easily released can be formed, as shown in FIG. 20C.

Therefore, the parallel alignment state of the two wires W in the opening/closing direction of the second movable engaging member 70R is released by the operation of closing the second movable engaging member 70R, so that the two wires W can be aligned in parallel with intersecting with the opening/closing direction of the second movable engaging member 70R.

Also, the parallel alignment state of the wires W in the predetermined direction may not be released even though the second movable engaging member 70R is moved toward the fixed engaging member 70C. That is, the state as shown in FIG. 20C may not be formed. Even in this case, when the second movable engaging member 70R is further moved toward the fixed engaging member 70C, the two wires W are pushed toward the fixed engaging member 70C by the second movable engaging member 70R, so that the force of changing the parallel alignment direction of the two wires W is applied and the aspect in which the parallel alignment state of the two wires W in the opening/closing direction of the second movable engaging member 70R can be easily released can be formed, as shown in FIG. 20C.

Therefore, the parallel alignment state of the two wires W in the opening/closing direction of the second movable engaging member 70R is released by the operation of further closing the second movable engaging member 70R, so that the two wires W can be aligned in parallel with intersecting with the opening/closing direction of the second movable engaging member 70R.

In step SC11, the control unit 14A detects the current flowing through the motor 80 with the current detection unit 16A. If the parallel alignment state of the two wires W in the opening/closing direction of the second movable engaging member 70R is released by the operation of opening/closing the first movable engaging member 70L and the second movable engaging member 70R and the operation of feeding the wires W by the slight amount, the current flowing through the motor 80 does not exceed the abnormality detection threshold value when the motor 80 is driven in the forward rotation direction. For this reason, when the current flowing through the motor 80 does not exceed the abnormality detection threshold value, the control unit 14A continues to perform the usual binding operation, in step SC6.

In contrast, when the current flowing through the motor 80 exceeds the abnormality detection threshold value, the control unit 14A estimates that the parallel alignment state of the two wires W in the opening/closing direction of the second movable engaging member 70R is not released, determines that an error has occurred, and stops the drive of the motor 80 in the forward rotation direction. In the meantime, as described above, the control unit 14A may be set so that the abnormality detection threshold value can be switched.

When the control unit 14A stops the drive of the motor 80 in the forward rotation direction, the control unit 14A drives the motor 80 in the reverse rotation direction to move the first movable engaging member 70L away from the fixed engaging member 70C and to move the second movable engaging member 70R away from the fixed engaging member 70C, thereby opening the engaging member 70, in step SC12.

When the control unit 14A drives the motor 80 in the reverse rotation direction in the predetermined amount by which the first movable engaging member 70L and the second movable engaging member 70R are opened, the control unit 14A stops the drive of the motor 80 in the reverse rotation direction. Then, in step SC13, the control unit 14A drives the notification unit 17A to notify an error.

Figure 25:
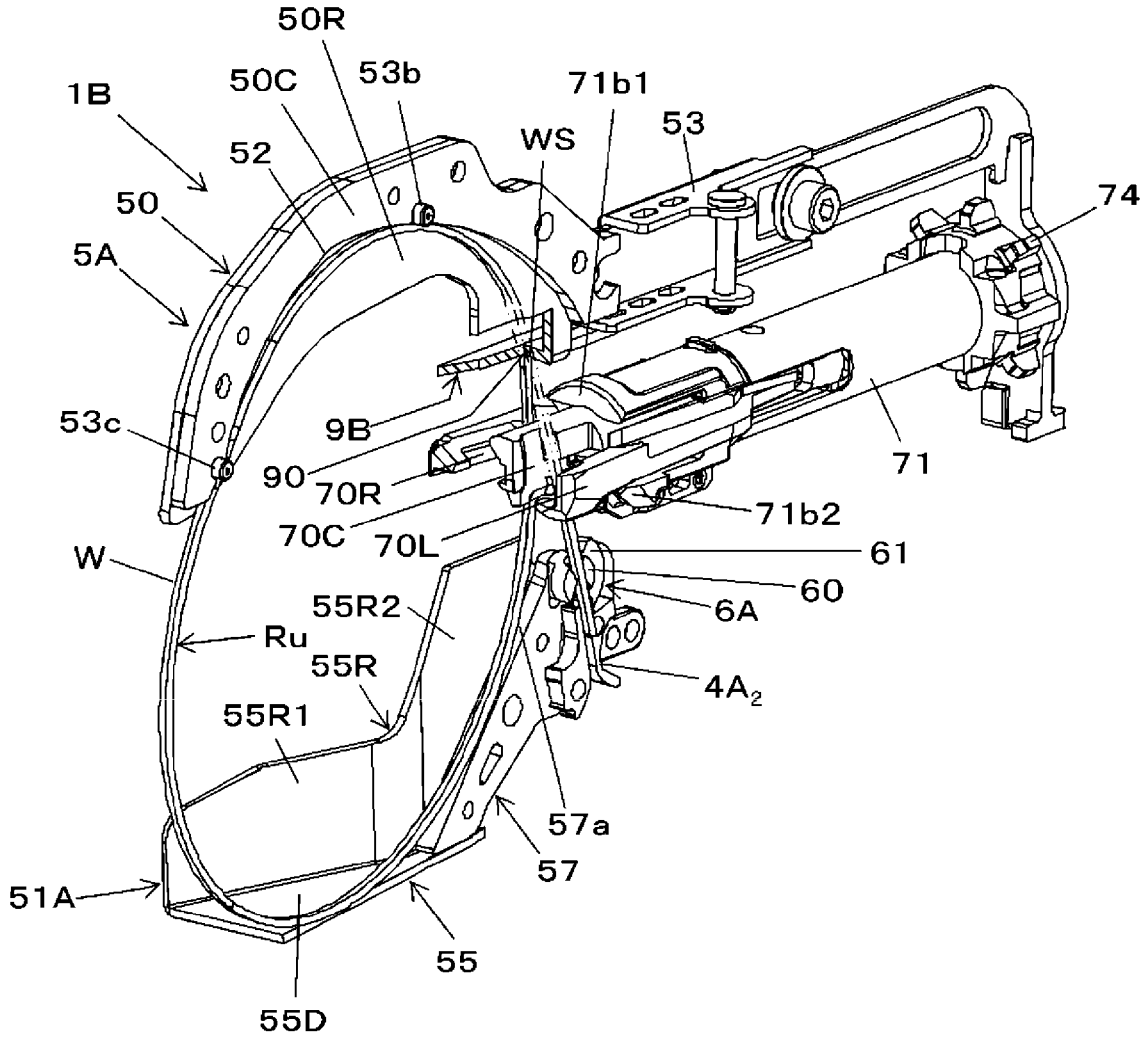
FIG. 25 is a partially broken perspective view depicting another example of a main configuration of a reinforcing bar binding machine.
Figure 26:
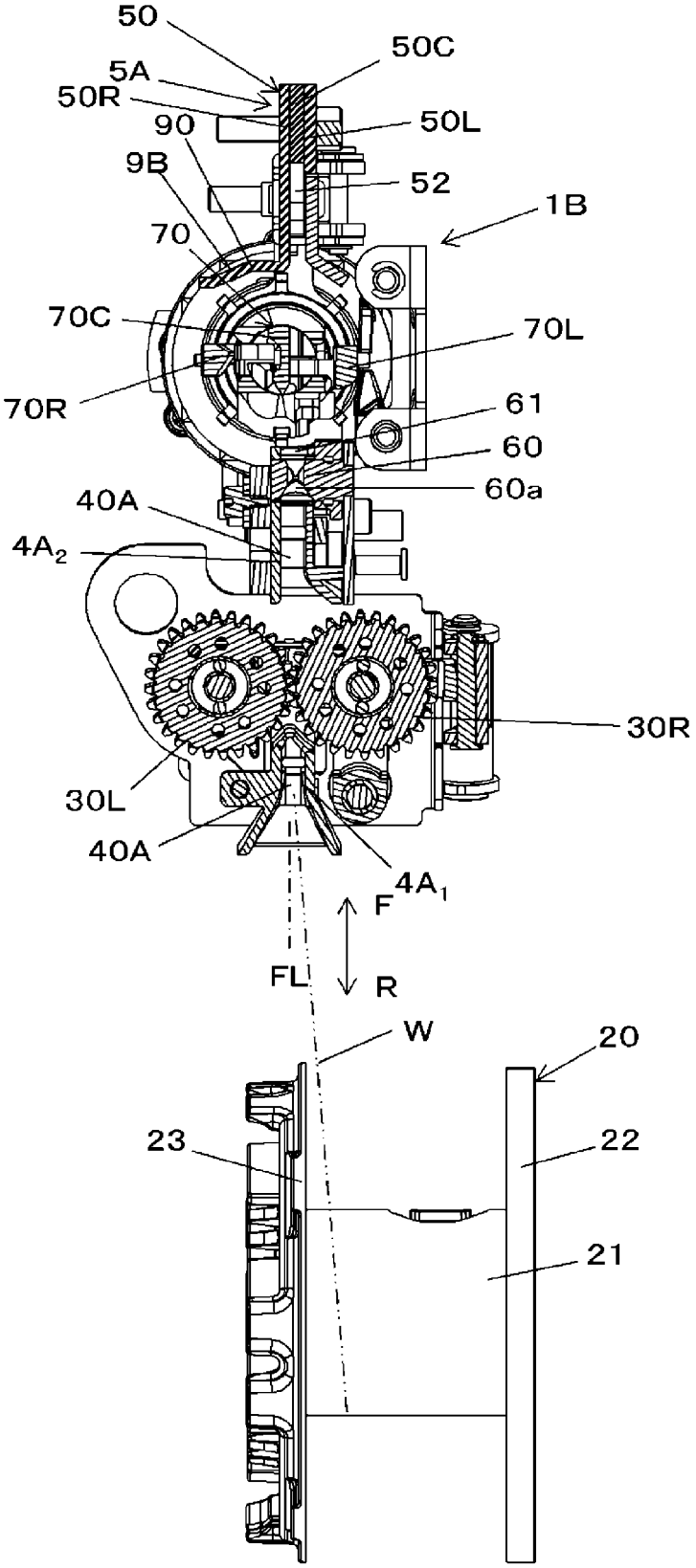
FIG. 26 is a sectional view depicting another example of the main configuration of the reinforcing bar binding machine.

FIG. 25 is a partially broken perspective view depicting another example of the main configuration of the reinforcing bar binding machine, and FIG. 26 is a sectional view depicting another example of the main configuration of the reinforcing bar binding machine. A reinforcing bar binding machine 1B of the modified embodiment includes a parallel alignment regulation part 90 configured to guide a parallel alignment direction of the wires W to a feeding regulation unit 9B. The other configurations are the same as the reinforcing bar binding machine 1A.

The feeding regulation unit 9B configured to regulate feeding of the wires W is configured by providing a member to which the tip ends WS of the wires W are to be butted on a feeding path of the wires W to pass between the fixed engaging member 70C and the second movable engaging member 70R, like the feeding regulation unit 9A. The feeding regulation unit 9B is configured integrally with the guide plate 50 R configuring the curl guide 50, and protrudes from the guide plate 50 R in a direction intersecting with the feeding path of the wires W.

The parallel alignment regulation part 90 has a concave part provided on a surface of the feeding regulation unit 9B with which the wires W are to come into contact and extending in a direction intersecting with a parallel alignment direction of the two wires W to be regulated by the first wire guide $\mathbf{4}A_1$ and the second wire guide $\mathbf{4}A_2$.

FIG. 27A to FIG. 27I illustrate an example of an operation of aligning two wires in parallel in a predetermined direction by using a configuration having a parallel alignment regulation part. In the below, another embodiment of the operation of estimating the parallel alignment state of the two wires W and releasing the parallel alignment state of the two wires W in the opening/closing direction of the second movable engaging member 70R is described. In the meantime, the control flowchart is described with reference to the example shown in FIG. 21. However, the example shown in FIG. 23 or 24 may also be referred to.

In step SA1 of FIG. 21, when it is determined that the switch 13A is in a predetermined state, in the present example, the switch 13A becomes on, the control unit 14A drives the feeding motor 33 in the forward rotation direction to feed the two wires W in the forward direction, in step SA2.

When the two wires W guided between the second movable engaging member 70R and the fixed engaging member 70C are fed to a position in which the tip ends WS are butted to the feeding regulation unit 9B, the control unit 14A stops the drive of the feeding motor 33 to stop the feeding of the wires W in the forward direction, in step SA3.

FIGS. 21A and 21B illustrate movement of the wires in the feeding regulation unit. In the below, an operational effect of guiding the wires W by the feeding regulation unit 9B is described.

A surface of the feeding regulation unit 9B with which the wires W are to come into contact is provided with the parallel alignment regulation part 90 extending in a direction intersecting with a parallel alignment direction of the two wires W to be regulated by the first wire guide $4A_1$ and the second wire guide $4A_2$.

Since the parallel alignment regulation part 90 has such a shape that it is concave in the feeding direction of the wires W being fed in the forward direction, when the tip ends WS of the wires W are pressed to the feeding regulation unit 9B, the tip ends WS of the wires W are guided toward an apex of the concave part configuring the parallel alignment regulation part 90.

Figure 28A:
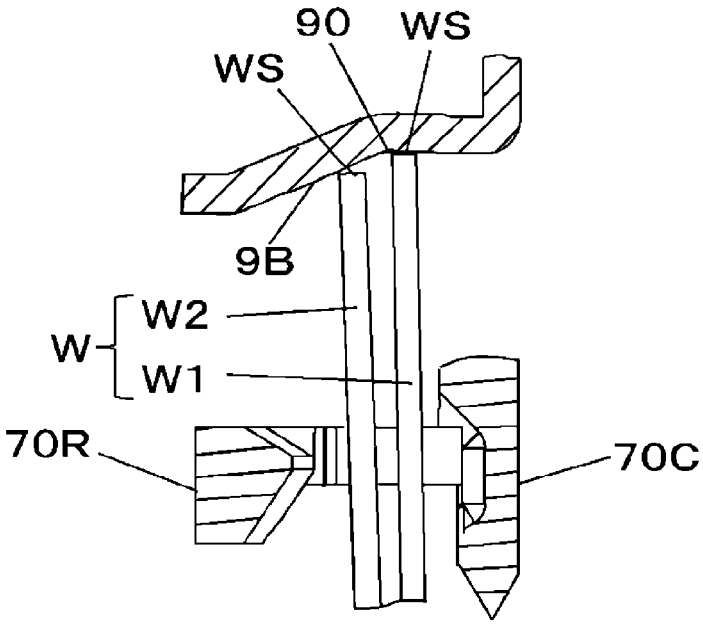
FIG. 28A illustrates movement of the wires in a feeding regulation unit.
Figure 28B:
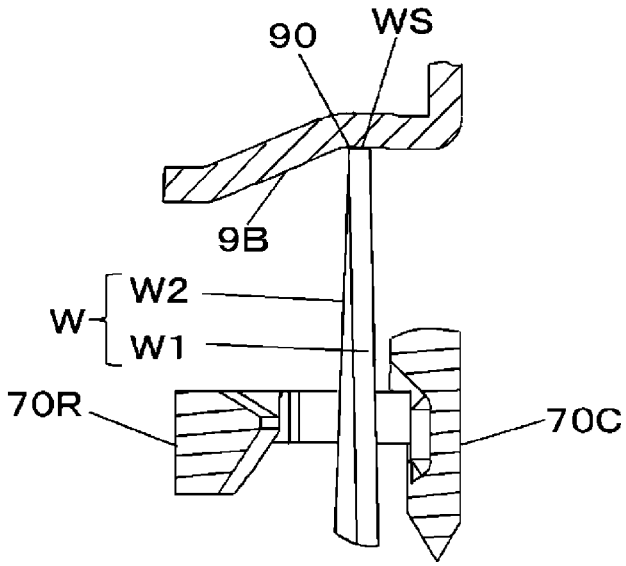
FIG. 28B illustrates movement of the wires in the feeding regulation unit.

Thereby, as shown in FIG. 28A, when the two wires W having passed between the fixed engaging member 70C and the second movable engaging member 70R are fed in the forward direction until the tip ends WS are contacted and pressed to the feeding regulation unit 9B, the tip ends WS of the two wires W are guided along the extension direction of the parallel alignment regulation part 90, as shown in FIG. 28B.

For this reason, as shown in FIG. 20A, the two wires W can be guided to be aligned in parallel in a direction intersecting with the opening/closing direction of the second movable engaging member 70R with respect to the fixed engaging member 70C.

Figure 27A:
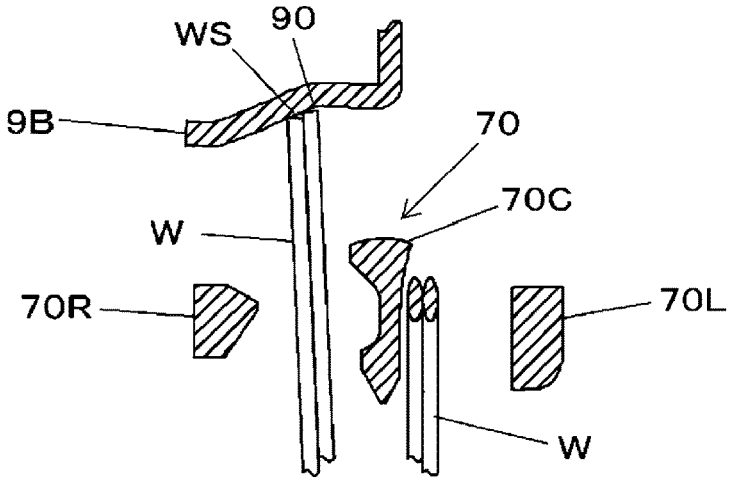
FIG. 27A illustrates an example of an operation of aligning two wires in parallel in a predetermined direction by using a configuration having a parallel alignment regulation part.
Figure 27B:
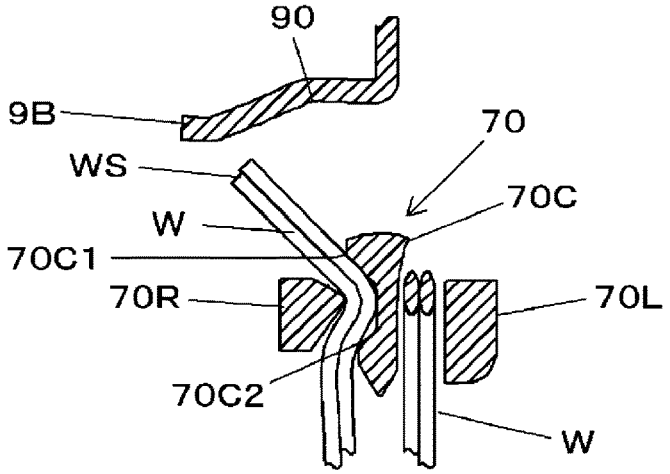
FIG. 27B illustrates an example of an operation of aligning two wires in parallel in a predetermined direction by using a configuration having a parallel alignment regulation part.

When the control unit 14A stops the drive of the feeding motor 33, the control unit drives the motor 80 in the forward rotation direction to move the first movable engaging member 70L toward the fixed engaging member 70C and to move the second movable engaging member 70R toward the fixed engaging member 70C, thereby closing the engaging member 70, in step SA4, as shown in FIG. 27B.

The control unit 14A detects the current flowing through the motor 80 with the current detection unit 16A and estimates the parallel alignment state of the two wires W. Then, the control unit 14A executes an operation of releasing the parallel alignment state of the two wires W in the opening/closing direction of the second movable engaging member 70R in accordance with the parallel alignment state of the two wires.

That is, in step SA5, the control unit 14A detects the current flowing through the motor 80 with the current detection unit 16A. When the current flowing through the motor 80 does not exceed the abnormality detection threshold value, it can be estimated that the two wires W sandwiched between the second movable engaging member 70R and the fixed engaging member 70C are in the normal state in which the wires are aligned in parallel with intersecting with the opening/closing direction of the second movable engaging member 70R, as shown in FIG. 20A. Thereby, when the current flowing through the motor 80 does not exceed an abnormality detection threshold value, the control unit 14A executes the usual binding operation, in step SA6.

In contrast, when the current flowing through the motor 80 exceeds the abnormality detection threshold value, it can be estimated that the two wires W sandwiched between the second movable engaging member 70R and the fixed engaging member 70C are in the abnormal state in which the wires are aligned in parallel in the opening/closing direction of the second movable engaging member 70R, as shown in FIG. 20B. Thereby, when the current flowing through the motor 80 exceeds the abnormality detection threshold value, the control unit 14A stops the drive of the motor 80 in the forward rotation direction.

When the control unit 14A stops the drive of the motor 80 in the forward rotation direction, the control unit 14A executes operations of opening/closing the first movable engaging member 70L and the second movable engaging member 70R, and releasing the parallel alignment state of the two wires W in the opening/closing direction of the second movable engaging member 70R.

Figure 27C:
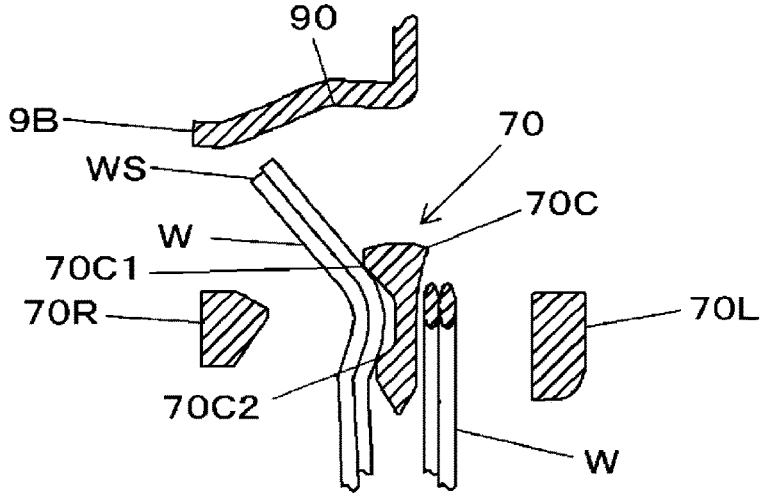
FIG. 27C illustrates an example of an operation of aligning two wires in parallel in a predetermined direction by using a configuration having a parallel alignment regulation part.

In step SA7, the control unit 14A drives the motor 80 in the reverse rotation direction to move the first movable engaging member 70L away from the fixed engaging member 70C and to move the second movable engaging member 70R away from the fixed engaging member 70C, thereby opening the engaging member 70, as shown in FIG. 27C.

When the control unit 14A drives the motor 80 in the reverse rotation direction in a predetermined amount by which the first movable engaging member 70L and the second movable engaging member 70R are opened, the control unit 14A stops the drive of the motor 80 in the reverse rotation direction.

As described above, there is a slight time difference after the tip ends WS of the wires W come into contact with the feeding regulation unit 9A until the drive of the wire feeding unit 3A is stopped. Therefore, the wires W are fed in the forward direction by a slight amount in a state in which the tip ends WS are in contact with the feeding regulation unit 9B, so that the loop Ru formed by the wires W is bent in a radially expanding direction.

In an operation of sandwiching the two wires W of which feeding is stopped between the second movable engaging member 70R and the fixed engaging member 70C, the two wires W are bent about a position as a support point that is pressed with the second movable engaging member 70R, as shown in FIG. 27B, so that the tip ends WS of the wires W separate from the feeding regulation unit 9B.

Figure 27D:
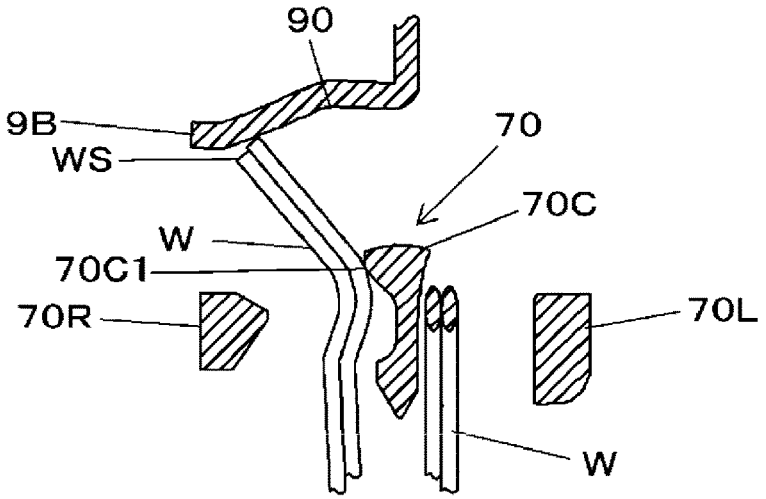
FIG. 27D illustrates an example of an operation of aligning two wires in parallel in a predetermined direction by using a configuration having a parallel alignment regulation part.

Thereby, when the second movable engaging member 70R is opened from the state shown in FIG. 27B, the tip ends WS of the wires W intend to move toward the feeding regulation unit 9B due to elasticity of the wires W bent in the radially expanding direction, as shown in FIG. 27D. In the aspect in which the two wires W are aligned in parallel in the opening/closing direction of the second movable engaging member 70R, one wire Win contact with the convex part 70C1 of the fixed engaging member 70C is difficult to move, as described above. In contrast, the other wire W that is not in contact with the convex part 70C1 of the fixed engaging member 70C can easily move. For this reason, when the wires W are moved by the operation of opening the second movable engaging member 70R, a force of changing the parallel alignment direction of the two wires W is applied, so that the aspect in which the parallel alignment state of the two wires W in the opening/closing direction of the second movable engaging member 70R can be easily released can be formed, as shown in FIG. 20C. Also, when the wires are moved as the second movable engaging member 70R is opened, the tip ends WS of the wires W may come into contact with the feeding regulation unit 9B. When the tip ends WS of the wires W come into contact with the feeding regulation unit 9B, a force of changing the parallel alignment direction of the two wires W is applied, so that the aspect in which the parallel alignment state of the two wires W in the opening/closing direction of the second movable engaging member 70R can be easily released can be formed, as shown in FIG. 20C.

Figure 27E:
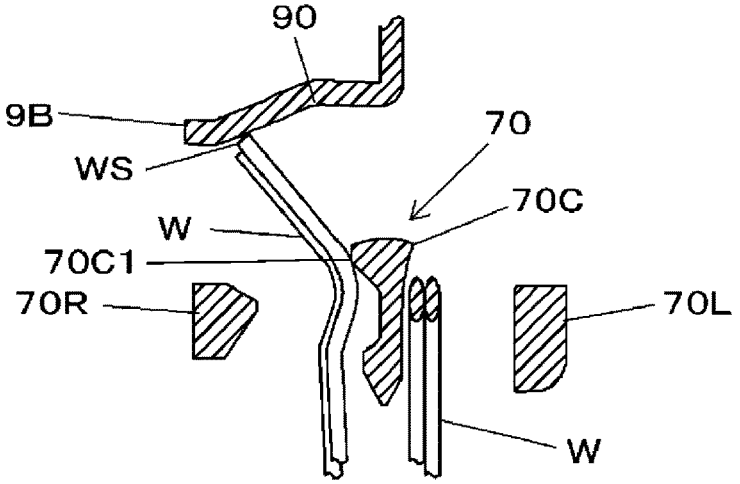
FIG. 27E illustrates an example of an operation of aligning two wires in parallel in a predetermined direction by using a configuration having a parallel alignment regulation part.

Therefore, the parallel alignment state of the two wires W in the opening/closing direction of the second movable engaging member 70R is released by the operation of opening the second movable engaging member 70R, so that the two wires W can be aligned in parallel with intersecting with the opening/closing direction of the second movable engaging member 70R, as shown in FIG. 27E.

Figure 27F:
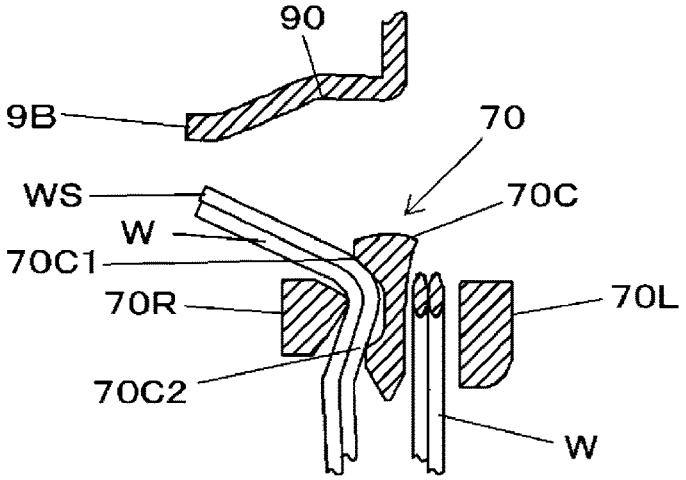
FIG. 27F illustrates an example of an operation of aligning two wires in parallel in a predetermined direction by using a configuration having a parallel alignment regulation part.

When the control unit 14A stops the drive of the motor 80 in the reverse rotation direction, the control unit 14A drives the motor 80 in the forward rotation direction to move the first movable engaging member 70L toward the fixed engaging member 70C and to move the second movable engaging member 70R toward the fixed engaging member 70C, thereby closing the engaging member 70, in step SA8, as shown in FIG. 27F.

By the operation of sandwiching the two wires W between the second movable engaging member 70R and the fixed engaging member 70C, the force of changing the parallel alignment direction of the two wires W is applied, so that the aspect in which the parallel alignment state of the two wires W in the opening/closing direction of the second movable engaging member 70R can be easily released can be formed, as shown in FIG. 20C.

Figure 27G:
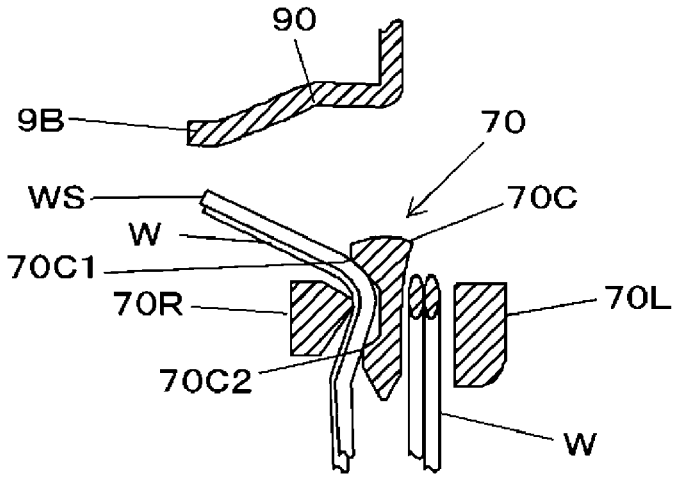
FIG. 27G illustrates an example of an operation of aligning two wires in parallel in a predetermined direction by using a configuration having a parallel alignment regulation part.

Therefore, the parallel alignment state of the two wires W in the opening/closing direction of the second movable engaging member 70R is released by the operation of closing the second movable engaging member 70R, so that the two wires W can be aligned in parallel with intersecting with the opening/closing direction of the second movable engaging member 70R, as shown in FIG. 27G.

Figure 27H:
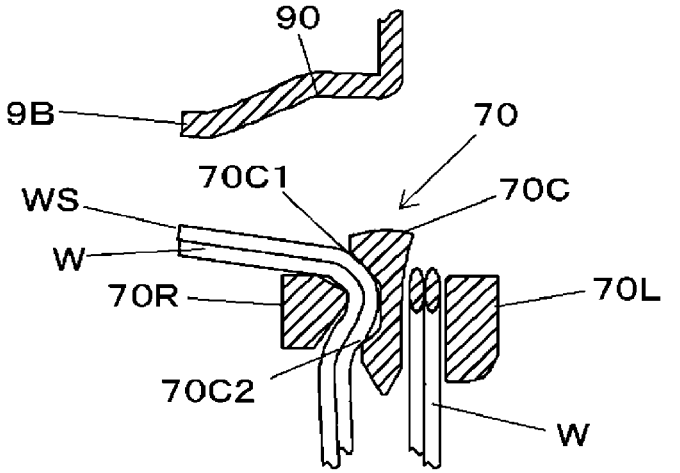
FIG. 27H illustrates an example of an operation of aligning two wires in parallel in a predetermined direction by using a configuration having a parallel alignment regulation part.

Also, as shown in FIG. 27F, the parallel alignment state of the wires W in the predetermined direction may not be released even though the second movable engaging member 70R is moved toward the fixed engaging member 70C. That is, the state as shown in FIG. 20C may not be formed. Even in this case, as shown in FIG. 27H, when the second movable engaging member 70R is further moved toward the fixed engaging member 70C, the two wires W are pushed toward the fixed engaging member 70C by the second movable engaging member 70R, so that the force of changing the parallel alignment direction of the two wires W at the convex parts 70C1 and 70C2 of the fixed engaging member 70C as a support point is applied and the aspect in which the parallel alignment state of the two wires W in the opening/closing direction of the second movable engaging member 70R can be easily released can be formed, as shown in FIG. 20C.

Figure 27I:
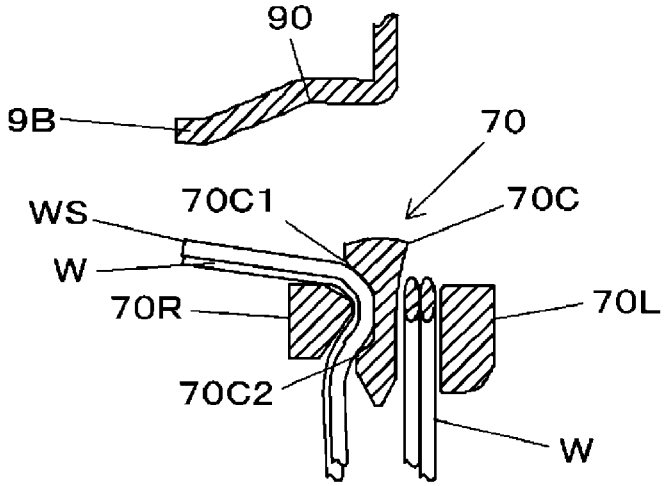
FIG. 27I illustrates an example of an operation of aligning two wires in parallel in a predetermined direction by using a configuration having a parallel alignment regulation part.

Therefore, the parallel alignment state of the two wires W in the opening/closing direction of the second movable engaging member 70R is released by the operation of further closing the second movable engaging member 70R, so that the two wires W can be aligned in parallel with intersecting with the opening/closing direction of the second movable engaging member 70R, as shown in FIG. 27I.

In step SA9, the control unit 14A detects the current flowing through the motor 80 with the current detection unit 16A. If the parallel alignment state of the two wires W in the opening/closing direction of the second movable engaging member 70R is released by the operation of opening/closing the first movable engaging member 70L and the second movable engaging member 70R, the current flowing through the motor 80 does not exceed the predetermined value when the motor 80 is driven in the forward rotation direction. For this reason, when the current flowing through the motor 80 does not exceed the abnormality detection threshold value, the control unit 14A continues to perform the usual binding operation, in step SA6.

In contrast, when the current flowing through the motor 80 exceeds the abnormality detection threshold value, the control unit 14A estimates that the parallel alignment state of the two wires W in the opening/closing direction of the second movable engaging member 70R is not released, determines that an error has occurred, and stops the drive of the motor 80 in the forward rotation direction. In the meantime, as described above, the control unit 14A may be set so that the abnormality detection threshold value can be switched.

When the control unit 14A stops the drive of the motor 80 in the forward rotation direction, the control unit 14A drives the motor 80 in the reverse rotation direction to move the first movable engaging member 70L away from the fixed engaging member 70C and to move the second movable engaging member 70R away from the fixed engaging member 70C, thereby opening the engaging member 70, in step SA10.

When the control unit 14A drives the motor 80 in the reverse rotation direction in the predetermined amount by which the first movable engaging member 70L and the second movable engaging member 70R are opened, the control unit 14A stops the drive of the motor 80 in the reverse rotation direction. Then, in step SA11, the control unit 14A drives the notification unit 17A to notify an error.

As described above, in each embodiment where the parallel alignment state of the two wires W is estimated, the first movable engaging member 70L and the second movable engaging member 70R are opened/closed in accordance with the parallel alignment state of the two wires, and the parallel alignment state of the two wires Win the opening/closing direction of the second movable engaging member 70R is released, the two wires W are engaged in a state in which an interval capable of engaging one wire is formed between the fixed engaging member 70C and the second movable engaging member 70R, as shown in FIG. 20A, so that the load to be applied to the engaging member 70 is reduced to securely engage the two wires W. Also, the binding operation can be continuously performed. In each embodiment, during one binding operation, the first movable engaging member 70L and the second movable engaging member 70R are opened/closed twice, in accordance with the parallel alignment state of the two wires. However, the number of times of opening/closing the first movable engaging member 70L and the second movable engaging member 70R may vary.

Figure 29:
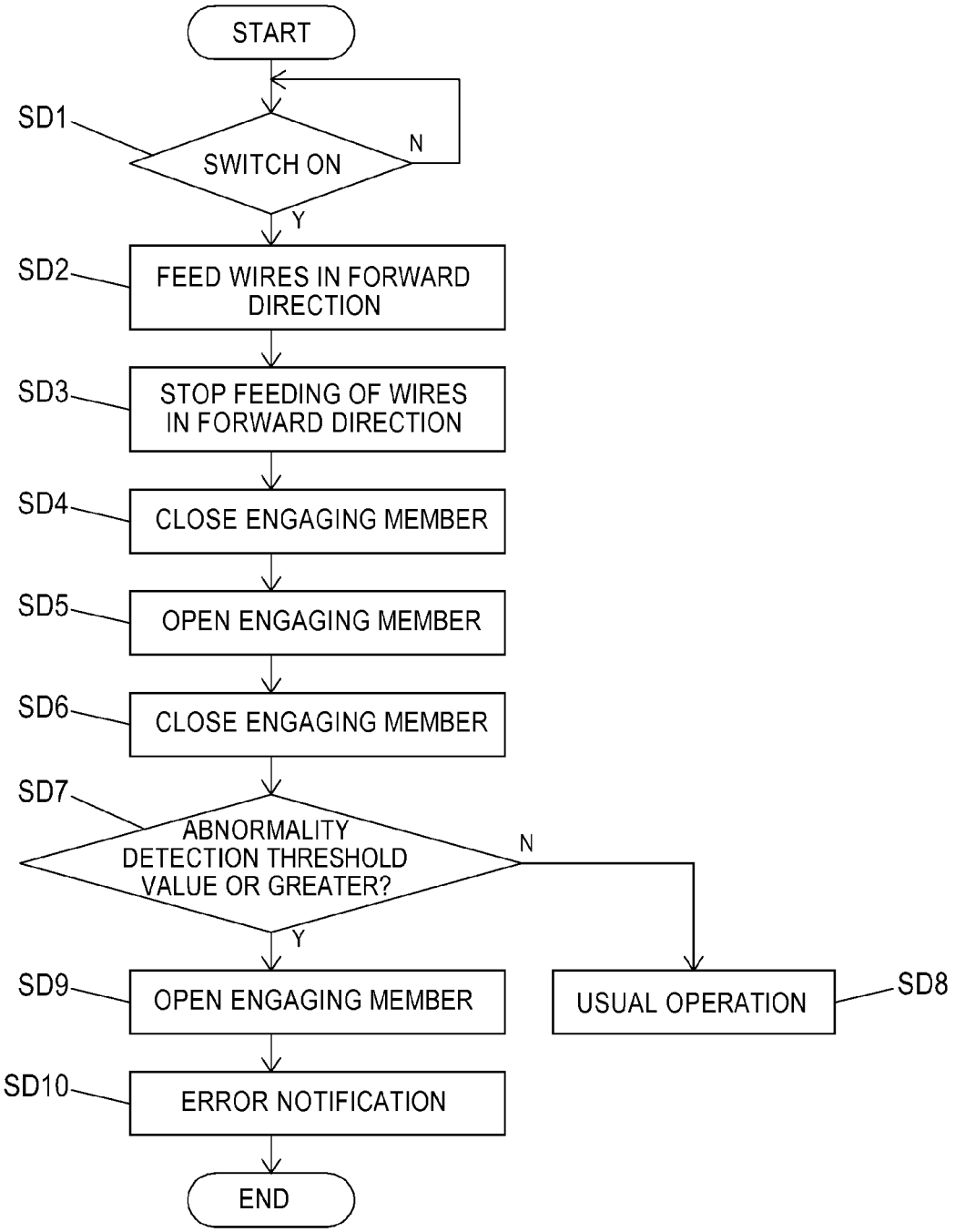
FIG. 29 is a flowchart depicting a ninth embodiment of control of aligning two wires in parallel in a predetermined direction.

FIG. 29 is a flowchart depicting a ninth embodiment of control of aligning two wires in parallel in a predetermined direction. In the below, an embodiment of an operation of releasing the parallel alignment state of the two wires W in the opening/closing direction of the second movable engaging member 70R without estimating the parallel alignment state of the two wires W is described.

In step SD1 of FIG. 29, when it is determined that the switch 13A is in a predetermined state, in the present example, the switch 13A becomes on, the control unit 14A drives the feeding motor 33 in the forward rotation direction to feed the two wires W in the forward direction, in step SD2.

When the two wires W guided between the second movable engaging member 70R and the fixed engaging member 70C are fed to a position in which the tip ends WS are butted to the feeding regulation unit 9A, the control unit 14A stops the drive of the feeding motor 33 to stop the feeding of the wires W in the forward direction, in step SD3.

When the control unit 14A stops the drive of the feeding motor 33, the control unit drives the motor 80 in the forward rotation direction to move the first movable engaging member 70L toward the fixed engaging member 70C and to move the second movable engaging member 70R toward the fixed engaging member 70C, thereby closing the engaging member 70, in step SD4.

When the control unit 14A drives the motor 80 in the forward rotation direction in a predetermined amount by which the first movable engaging member 70L and the second movable engaging member 70R are closed, the control unit 14A stops the drive of the motor 80 in the forward rotation direction.

When the control unit 14A stops the drive of the motor 80 in the forward rotation direction, the control unit 14A drives the motor 80 in the reverse rotation direction to move the first movable engaging member 70L away from the fixed engaging member 70C and to move the second movable engaging member 70R away from the fixed engaging member 70C, thereby opening the engaging member 70, in step SD5.

When the control unit 14A drives the motor 80 in the reverse rotation direction in the predetermined amount by which the first movable engaging member 70L and the second movable engaging member 70R are opened, the control unit 14A stops the drive of the motor 80 in the reverse rotation direction.

When the second movable engaging member 70R is opened, the tip ends WS of the wires W intend to move toward the feeding regulation unit 9A due to elasticity of the wires W bent in the radially expanding direction, as described above. In the aspect in which the two wires W are aligned in parallel in the opening/closing direction of the second movable engaging member 70R, one wire W in contact with the convex part 70C1 of the fixed engaging member 70C is difficult to move, as described above. In contrast, the other wire W that is not in contact with the convex part 70C1 of the fixed engaging member 70C can easily move. For this reason, when the wires W are moved by the operation of opening the second movable engaging member 70R, a force of changing the parallel alignment direction of the two wires W is applied, so that an aspect in which the parallel alignment state of the two wires W in the opening/closing direction of the second movable engaging member 70R can be easily released can be formed, as shown in FIG. 20C.

Therefore, the parallel alignment state of the two wires W in the opening/closing direction of the second movable engaging member 70R is released by the operation of opening the second movable engaging member 70R, so that the two wires W can be aligned in parallel with intersecting with the opening/closing direction of the second movable engaging member 70R.

When the control unit 14A stops the drive of the motor 80 in the reverse rotation direction, the control unit 14A drives the motor 80 in the forward rotation direction to move the first movable engaging member 70L toward the fixed engaging member 70C and to move the second movable engaging member 70R toward the fixed engaging member 70C, thereby closing the engaging member 70, in step SD6.

By the operation of sandwiching the two wires W between the second movable engaging member 70R and the fixed engaging member 70C, the force of changing the parallel alignment direction of the two wires W is applied, so that the aspect in which the parallel alignment state of the two wires W in the opening/closing direction of the second movable engaging member 70R can be easily released can be formed, as shown in FIG. 20C.

Therefore, the parallel alignment state of the two wires W in the opening/closing direction of the second movable engaging member 70R is released by the operation of closing the second movable engaging member 70R, so that the two wires W can be aligned in parallel with intersecting with the opening/closing direction of the second movable engaging member 70R.

Also, the parallel alignment state of the wires W in the predetermined direction may not be released even though the second movable engaging member 70R is moved toward the fixed engaging member 70C. That is, the state as shown in FIG. 20C may not be formed. Even in this case, when the second movable engaging member 70R is further moved toward the fixed engaging member 70C, the two wires W are pushed toward the fixed engaging member 70C by the second movable engaging member 70R, so that the force of changing the parallel alignment direction of the two wires W is applied and the aspect in which the parallel alignment state of the two wires W in the opening/closing direction of the second movable engaging member 70R can be easily released can be formed, as shown in FIG. 20C.

Therefore, the parallel alignment state of the two wires W in the opening/closing direction of the second movable engaging member 70R is released by the operation of further closing the second movable engaging member 70R, so that the two wires W can be aligned in parallel with intersecting with the opening/closing direction of the second movable engaging member 70R.

In step SD7, the control unit 14A detects the current flowing through the motor 80 with the current detection unit 16A. If the parallel alignment state of the two wires W in the opening/closing direction of the second movable engaging member 70R is released by the operation of opening/closing the first movable engaging member 70L and the second movable engaging member 70R, the current flowing through the motor 80 does not exceed the predetermined value when the motor 80 is driven in the forward rotation direction. For this reason, when the current flowing through the motor 80 does not exceed the abnormality detection threshold value, the control unit 14A continues to perform the usual binding operation, in step SD8.

In contrast, when the current flowing through the motor 80 exceeds the abnormality detection threshold value, the control unit 14A estimates that the parallel alignment state of the two wires W in the opening/closing direction of the second movable engaging member 70R is not released, determines that an error has occurred, and stops the drive of the motor 80 in the forward rotation direction. In the meantime, as described above, the control unit 14A may be set so that the abnormality detection threshold value can be switched.

When the control unit 14A stops the drive of the motor 80 in the forward rotation direction, the control unit 14A drives the motor 80 in the reverse rotation direction to move the first movable engaging member 70L away from the fixed engaging member 70C and to move the second movable engaging member 70R away from the fixed engaging member 70C, thereby opening the engaging member 70, in step SD9.

When the control unit 14A drives the motor 80 in the reverse rotation direction in the predetermined amount by which the first movable engaging member 70L and the second movable engaging member 70R are opened, the control unit 14A stops the drive of the motor 80 in the reverse rotation direction. Then, in step SD10, the control unit 14A drives the notification unit 17A to notify an error.

As described above, even in the embodiment in which the parallel alignment state of the two wires W is not estimated, the operation of opening/closing the engaging member 70 causes the two wires W to be engaged in a state in which an interval capable of engaging one wire is formed between the fixed engaging member 70C and the second movable engaging member 70R, as shown in FIG. 20A, so that the load to be applied to the engaging member 70 is reduced to securely engage the two wires W.

Figure 30A:
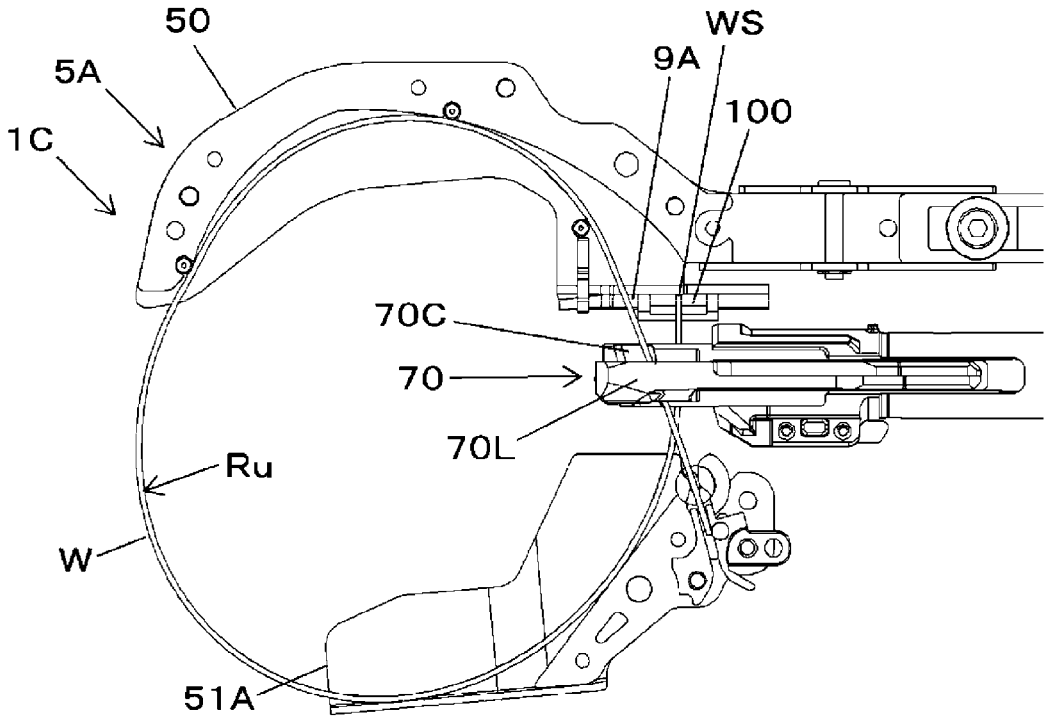
FIG. 30A is a side view depicting an example of a main configuration of the reinforcing bar binding machine having a parallel alignment detection sensor.
Figure 30B:
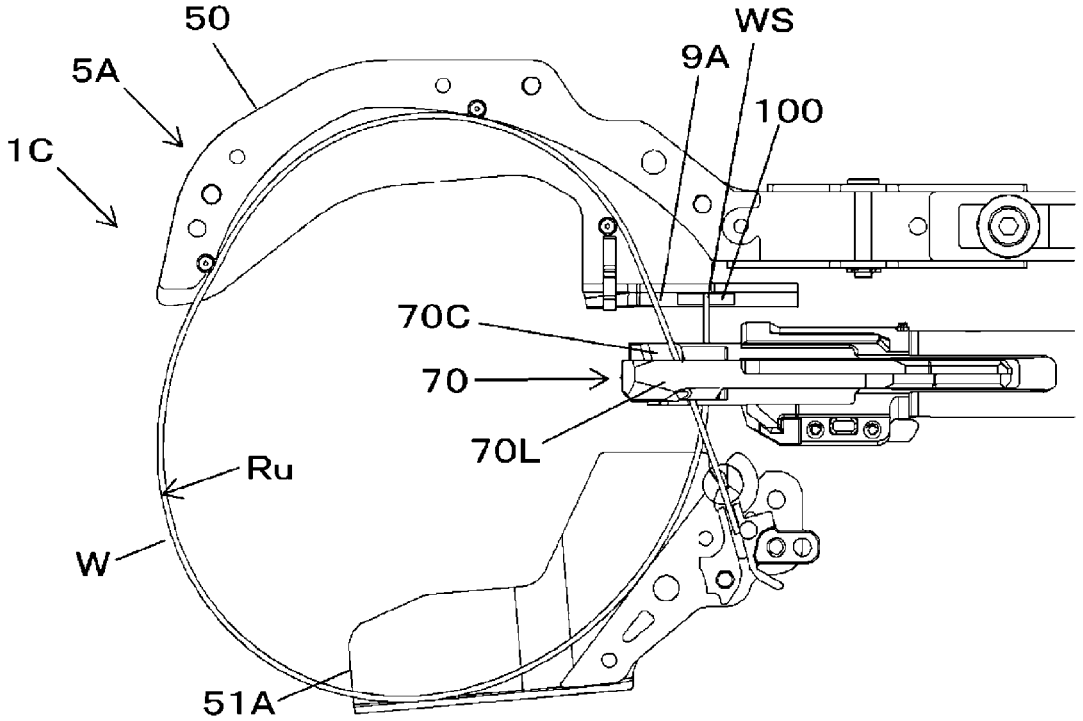
FIG. 30B is a side view depicting another example of a main configuration of the reinforcing bar binding machine having the parallel alignment detection sensor.
Figure 31A:
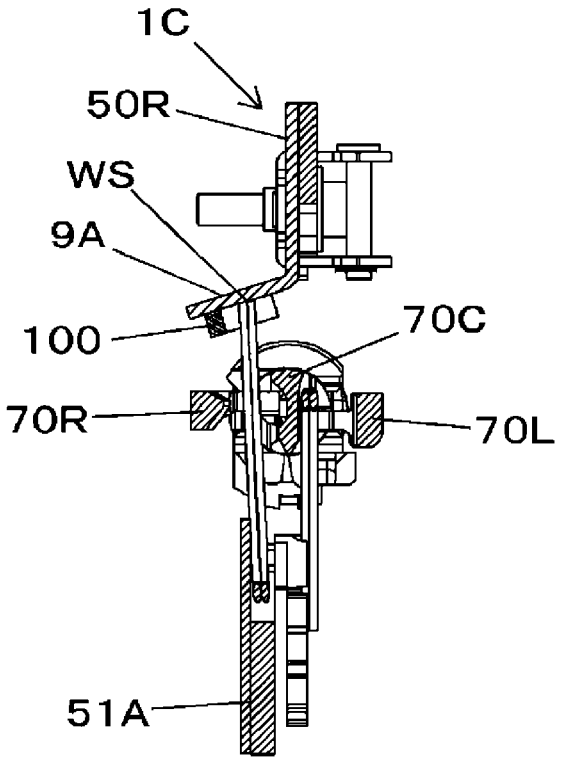
FIG. 31A is a sectional view depicting an example of a main configuration of the reinforcing bar binding machine having the parallel alignment detection sensor.
Figure 31B:
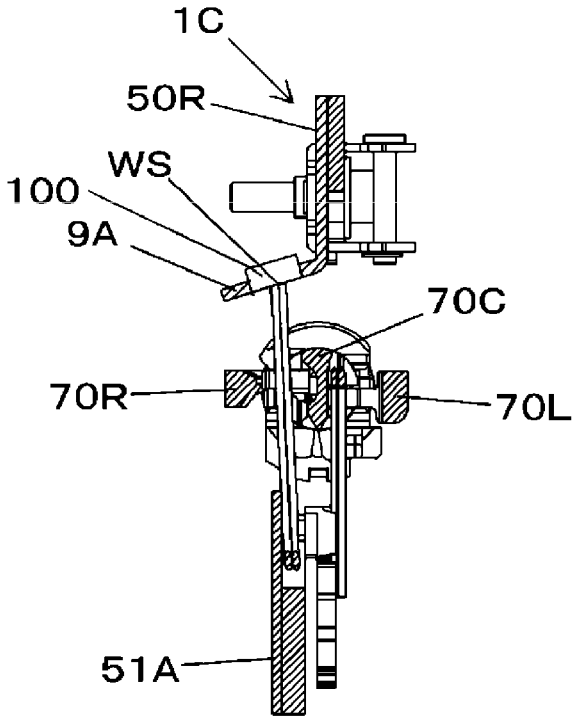
FIG. 31B is a sectional view depicting another example of a main configuration of the reinforcing bar binding machine having the parallel alignment detection sensor.
Figure 32:
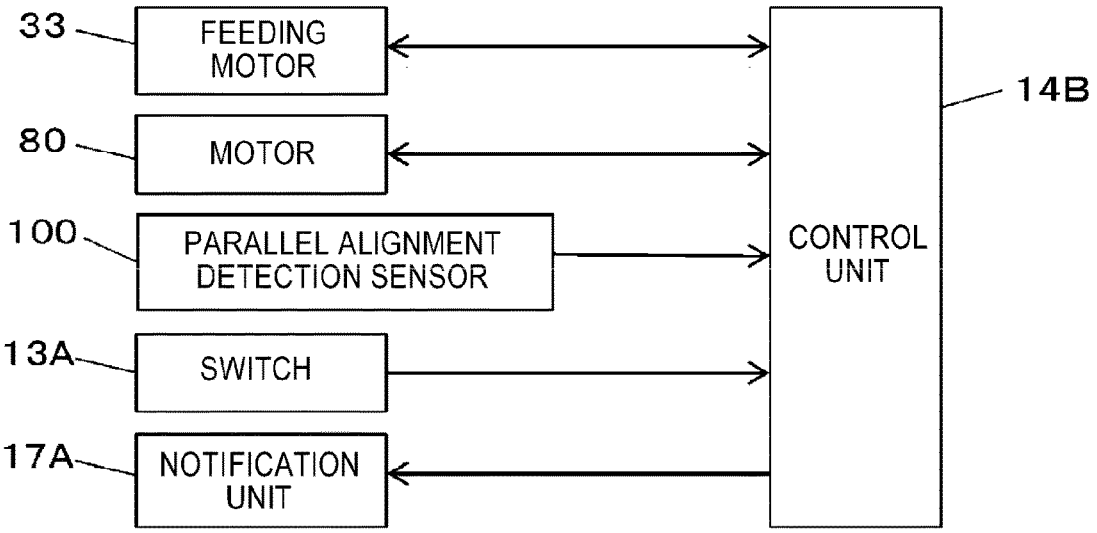
FIG. 32 is a functional block diagram depicting an example of a control function of the reinforcing bar binding machine having the parallel alignment detection sensor.

FIG. 30A is a side view depicting an example of a main configuration of the reinforcing bar binding machine having a parallel alignment detection sensor, FIG. 30B is a side view depicting another example of a main configuration of the reinforcing bar binding machine having the parallel alignment detection sensor, FIG. 31A is a sectional view depicting an example of a main configuration of the reinforcing bar binding machine having the parallel alignment detection sensor, FIG. 31B is a sectional view depicting another example of a main configuration of the reinforcing bar binding machine having the parallel alignment detection sensor, and FIG. 32 is a functional block diagram depicting an example of a control function of the reinforcing bar binding machine having the parallel alignment detection sensor.

A reinforcing bar binding machine 1C includes a parallel alignment detection sensor 100 configured to detect a parallel alignment state of the two wires W.

The parallel alignment detection sensor 100 is an example of a parallel alignment state detection means that is a parallel alignment state estimation means, and is provided in a position of the feeding regulation unit 9A in which the tip ends WS of the wires W are to come into contact, or in the vicinity of the position. The parallel alignment detection sensor 100 is configured by any one of an optical sensor, a magnetic force sensor, a touch sensor and the like. In a case of an optical sensor and a magnetic force sensor, the sensor is provided in a position in which the wires W to come into contact with the feeding regulation unit 9A can be detected, in the vicinity of a position of the feeding regulation unit 9A in which the tip ends WS of the wires W are to come into contact, as shown in FIGS. 23A and 24A. Also, in a case of a touch sensor, the sensor is provided in a position of the feeding regulation unit 9A in which the tip ends WS of the wires W are to come into contact, as shown in FIGS. 23B and 24B.

In a case in which the parallel alignment detection sensor 100 is an optical sensor, it is an image sensor, for example, and is configured to capture the two wires W from a direction intersecting with the opening/closing direction of the second movable engaging member 70R and to detect whether the captured wire W is one or two.

When the captured wire W is one, a control unit 14B determines that the two wires W are aligned in parallel with intersecting with the opening/closing direction of the second movable engaging member 70R with respect to the fixed engaging member 70C, as shown in FIG. 20A. In contrast, when the captured wire W is two, the control unit 14B determines that the two wires W are aligned in parallel in the opening/closing direction of the second movable engaging member 70R with respect to the fixed engaging member 70C, as shown in FIG. 20B.

Also, in a case in which the parallel alignment detection sensor 100 is an optical sensor, it is a transmissive sensor consisting of a pair of light receiving element and light transmitting element, for example, and is configured to emit light from a direction intersecting with the opening/closing direction of the second movable engaging member 70R and to detect whether a light-shielding width corresponds to one wire W or two wires W.

Also, in a case in which the parallel alignment detection sensor 100 is a magnetic force sensor, it is a Hall IC, and is configured to detect a magnetic field from a direction intersecting with the opening/closing direction of the second movable engaging member 70R and to detect whether the two wires W are aligned in parallel with intersecting with the opening/closing direction of the second movable engaging member 70R or the two wires W are aligned in parallel in the opening/closing direction of the second movable engaging member 70R.

Also, in a case in which the parallel alignment detection sensor 100 is a touch sensor, it is a pressure sensor, and is configured to detect whether the two wires W are contacted in an aspect that the two wires W are aligned in parallel with intersecting with the opening/closing direction of the second movable engaging member 70R or in an aspect that the two wires W are aligned in parallel in the opening/closing direction of the second movable engaging member 70R.

When the wires W are detected, the control unit 14B determines the parallel alignment direction of the two wires W. Also, when the wires W come into contact with the feeding regulation unit 9A, the parallel alignment direction of the two wires W may be changed. Therefore, when the wires W are detected, the control unit 14B determines the parallel alignment direction of the two wires W after predetermined time elapses.

Figure 33:
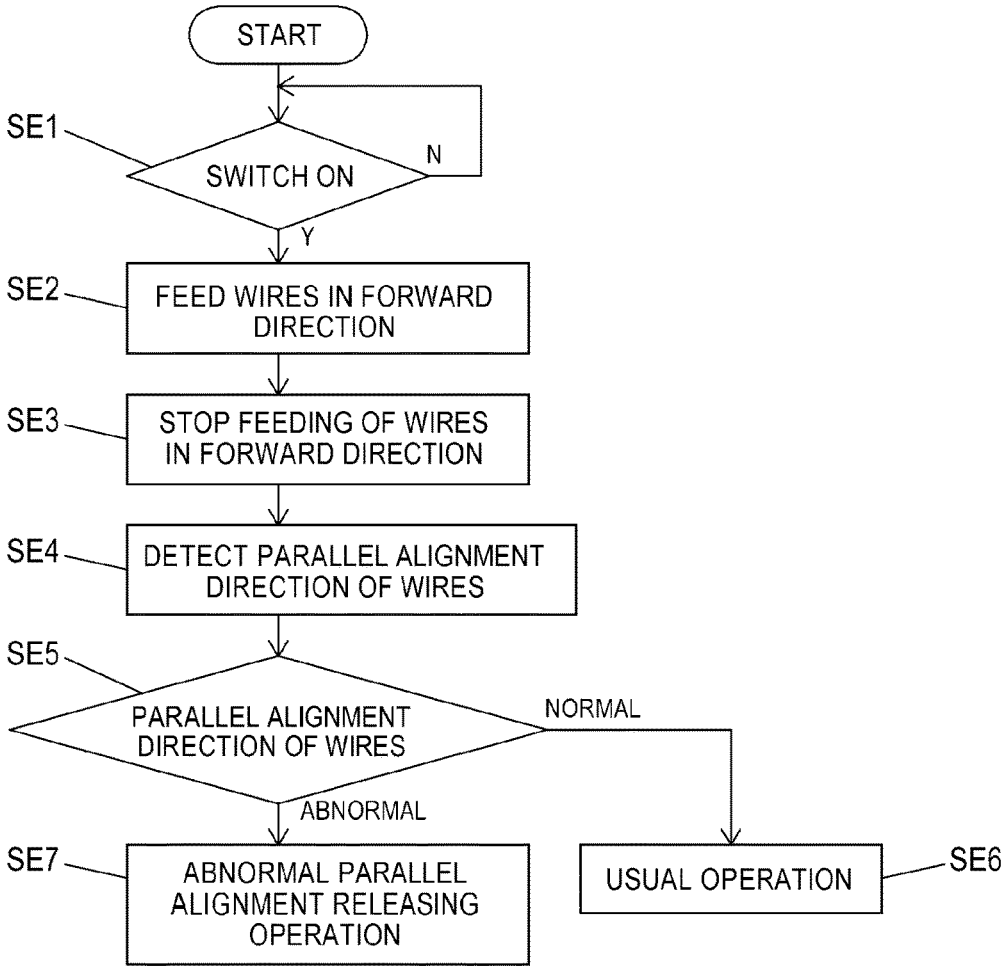
FIG. 33 is a flowchart depicting a tenth embodiment of control of aligning two wires in parallel in a predetermined direction.

FIG. 33 is a flowchart depicting a tenth embodiment of control of aligning two wires in parallel in a predetermined direction. In the below, an embodiment of operations of detecting the parallel alignment state of the two wires W and releasing the parallel alignment state of the two wires W in the opening/closing direction of the second movable engaging member 70R is described.

In step SE1 of FIG. 33, when it is determined that the switch 13A is in a predetermined state, in the present example, the switch 13A becomes on, the control unit 14B drives the feeding motor 33 in the forward rotation direction to feed the two wires W in the forward direction, in step SE2.

When the two wires W guided between the second movable engaging member 70R and the fixed engaging member 70C are fed to a position in which the tip ends WS are butted to the feeding regulation unit 9A, the control unit (controller) 14B stops the drive of the feeding motor 33 to stop the feeding of the wires W in the forward direction, in step SE3.

In step SE4, when the parallel alignment detection sensor 100 detects the wires W, the control unit 14B determines a parallel alignment direction of the two wires W, in step SE5. When the control unit 14B determines that the two wires W are in the normal state in which the wires are aligned in parallel with intersecting with the opening/closing direction of the second movable engaging member 70R, the control unit 14B executes the usual binding operation, in step SE6.

In contrast, when the control unit 14B determines that the two wires W are in the abnormal state in which the wires are aligned in parallel in the opening/closing direction of the second movable engaging member 70R, the control unit 14B executes the operations of opening/closing the first movable engaging member 70L and the second movable engaging member 70R and releasing the parallel alignment state of the two wires W in the opening/closing direction of the second movable engaging member 70R, in step SE7, for example, as described above.

Figure 34:
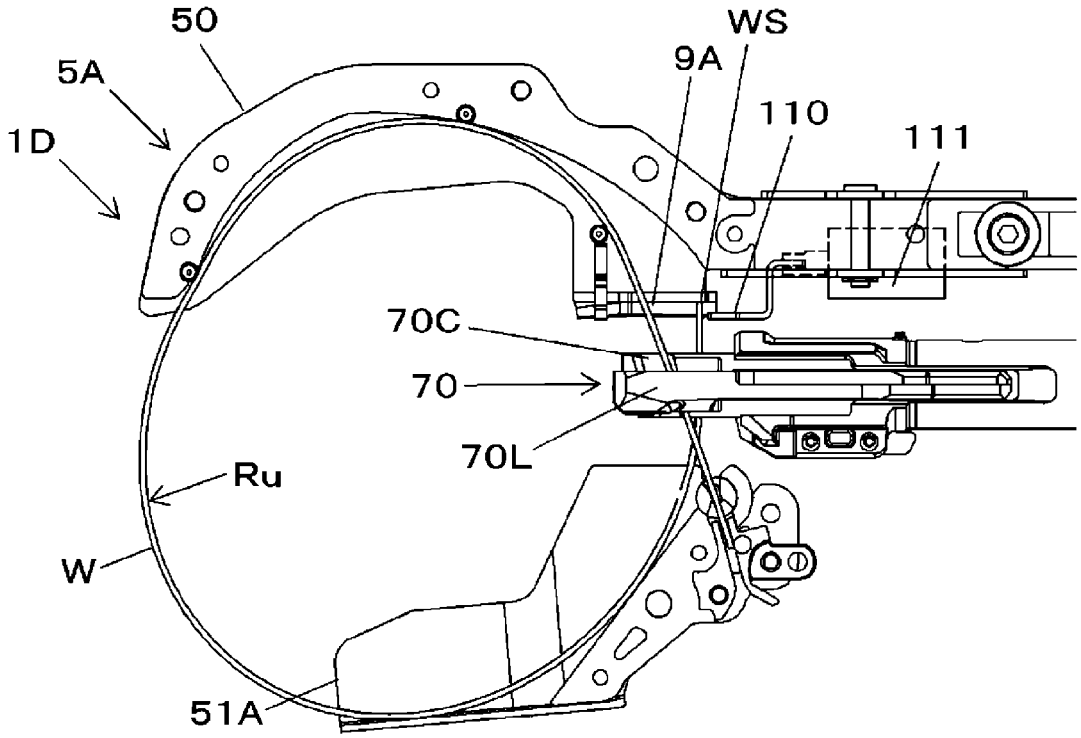
FIG. 34 is a side view depicting an example of a main configuration of a reinforcing bar binding machine having a parallel alignment releasing member.
Figure 35:
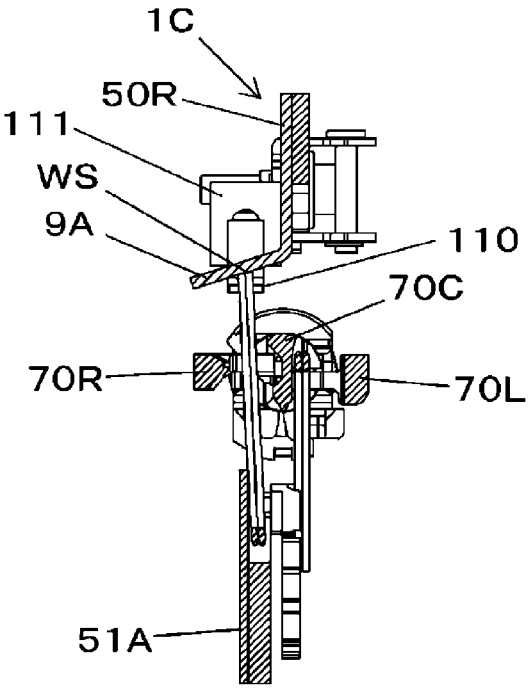
FIG. 35 is a sectional view depicting an example of a main configuration of the reinforcing bar binding machine having the parallel alignment releasing member.
Figure 36:
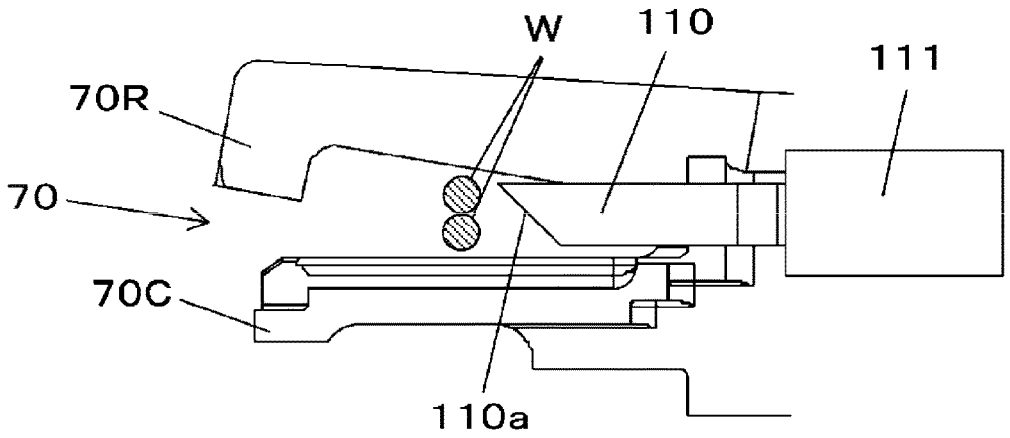
FIG. 36 is a top view depicting an example of a main configuration of the reinforcing bar binding machine having the parallel alignment releasing member.
Figure 37:
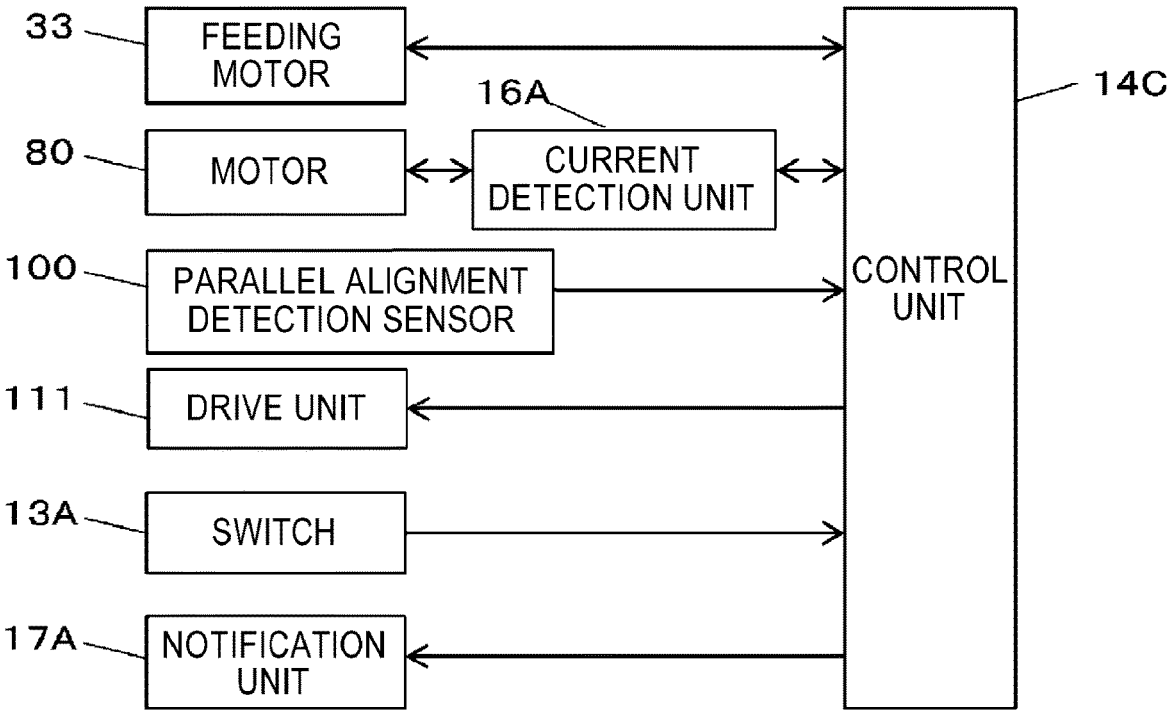
FIG. 37 is a functional block diagram depicting an example of a control function of the reinforcing bar binding machine having the parallel alignment releasing member.

FIG. 34 is a side view depicting an example of a main configuration of a reinforcing bar binding machine having a parallel alignment releasing member, FIG. 35 is a sectional view depicting an example of a main configuration of the reinforcing bar binding machine having the parallel alignment releasing member, FIG. 36 is a top view depicting an example of a main configuration of the reinforcing bar binding machine having the parallel alignment releasing member, and FIG. 37 is a functional block diagram depicting an example of a control function of the reinforcing bar binding machine having the parallel alignment releasing member.

A reinforcing bar binding machine 1D includes a parallel alignment releasing member 110 configured to release a predetermined parallel alignment state of the two wires W. The parallel alignment releasing member 110 is provided to be movable between a position distant from the two wires W to pass between the second movable engaging member 70R and the fixed engaging member 70C and a contact position, and is driven by a drive unit 111 such as a solenoid. In a case in which the two wires W are aligned in parallel in the opening/closing direction of the second movable engaging member 70R, the parallel alignment releasing member 110 has a width in which it can contact the two wires W. Also, in a case in which the two wires W are aligned in parallel in the opening/closing direction of the second movable engaging member 70R, a contact surface of the parallel alignment releasing member 110 with the two wires W is inclined in a direction in which it first comes into contact with one wire W and forms a parallel alignment releasing surface 110*a*.

A control unit 14C (controller) is configured to estimate a parallel alignment state of the two wires from the current flowing through the motor 80, which is detected by the current detection unit 16A, or to detect a parallel alignment state of the two wires W with the parallel alignment detection sensor 100, and to drive the drive unit 111 in accordance with the parallel alignment state of the two wires.

Figure 38:
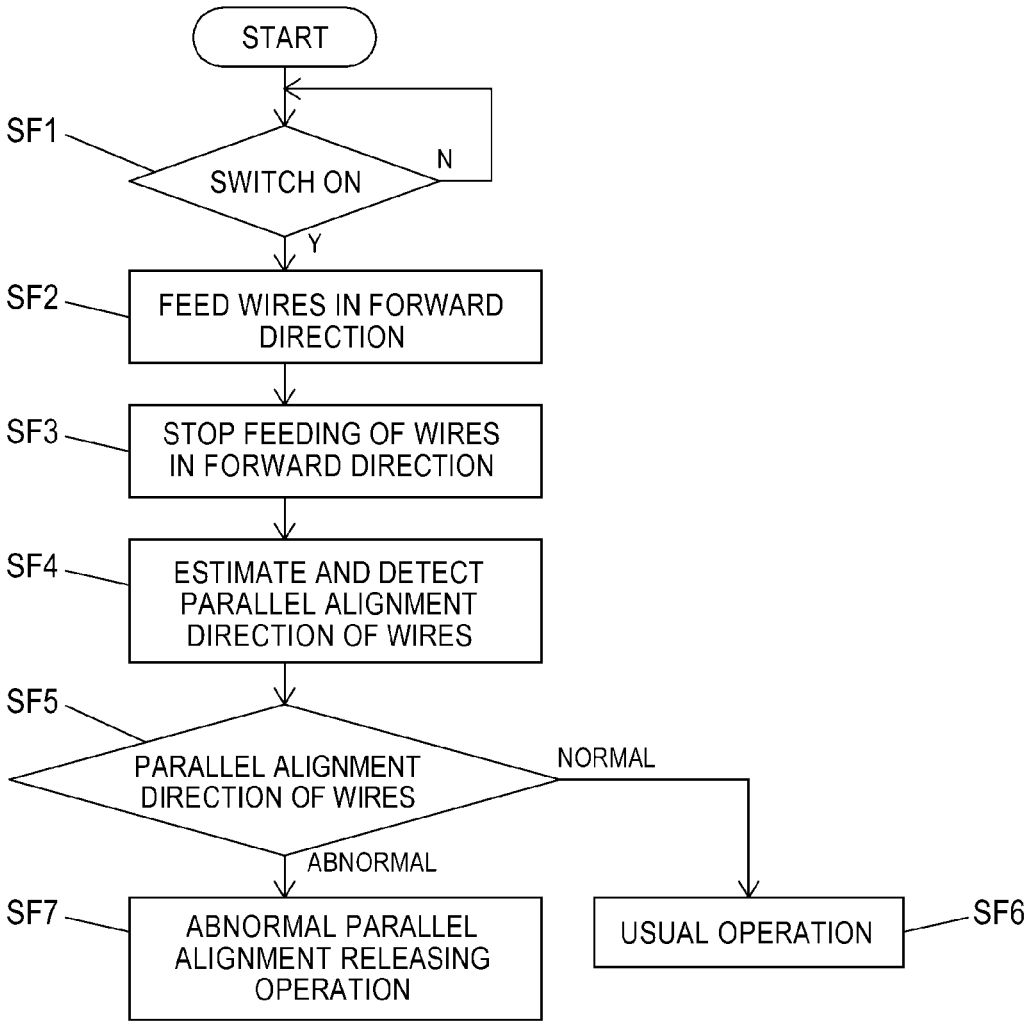
FIG. 38 is a flowchart depicting a eleventh embodiment of control of aligning two wires in parallel in a predetermined direction.

FIG. 38 is a flowchart depicting a eleventh embodiment of control of aligning two wires in parallel in a predetermined direction. In the below, an embodiment of operations of releasing the parallel alignment state of the two wires W in the opening/closing direction of the second movable engaging member 70R by the parallel alignment releasing member 110 is described.

In step SF1 of FIG. 38, when it is determined that the switch 13A is in a predetermined state, in the present example, the switch 13A becomes on, the control unit 14C drives the feeding motor 33 in the forward rotation direction to feed the two wires W in the forward direction, in step SF2.

When the two wires W guided between the second movable engaging member 70R and the fixed engaging member 70C are fed to a position in which the tip ends WS are butted to the feeding regulation unit 9A, the control unit 14C stops the drive of the feeding motor 33 to stop the feeding of the wires W in the forward direction, in step SF3.

In step SF4, the control unit 14C estimates and determines the parallel alignment direction of the two wires W by the current flowing through the motor 80, which is detected by the current detection unit 16A during the operation of closing the engaging member 70, or by the parallel alignment detection sensor 100.

In step SF5, when it is determined that the two wires W are in the normal state in which the wires are aligned in parallel with intersecting with the opening/closing direction of the second movable engaging member 70R, the control unit 14C executes the usual binding operation, in step SF6.

In contrast, when it is determined that the two wires W are in the abnormal state in which the wires are aligned in parallel in the opening/closing direction of the second movable engaging member 70R, the control unit 14C drives the drive unit 111 to move the parallel alignment releasing member 110 to a position in which the parallel alignment releasing surface 110*a* comes into contact with the wires W, in step SF7. Thereby, the operation of releasing the parallel alignment state of the two wires W in the opening/closing direction of the second movable engaging member 70R is executed.

In the meantime, an operation of releasing the parallel alignment state of the two wires W in the opening/closing direction of the second movable engaging member 70R by pushing the inductive guide 51A or the like with the parallel alignment releasing member and vibrating the two wires W may also be executed.

<Operational Effect of Guiding Wires by Inductive Guide>

Figure 39A:
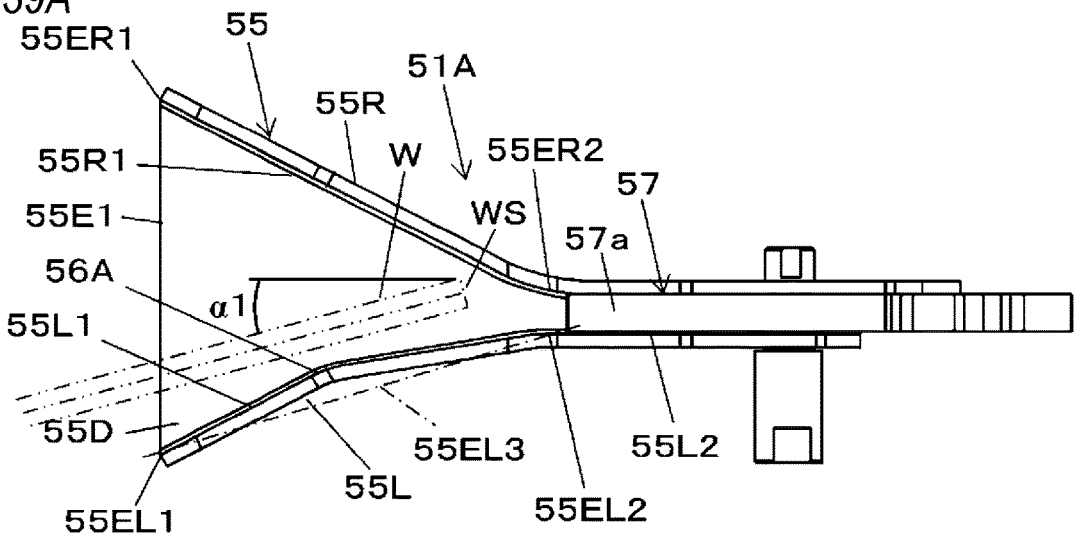
FIG. 39A illustrates movement of the wires in the inductive guide.
Figure 39B:
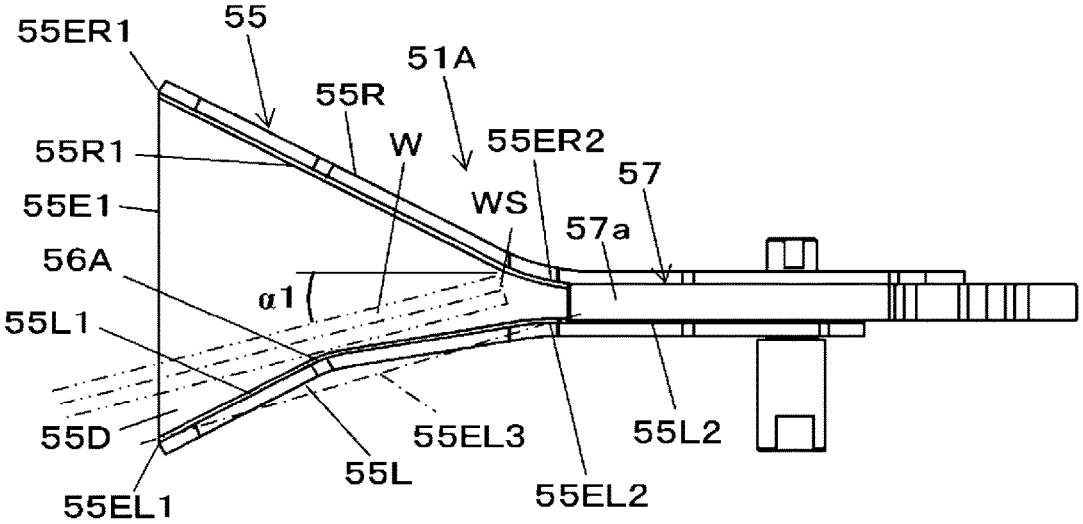
FIG. 39B illustrates movement of the wires in the inductive guide.
Figure 39C:
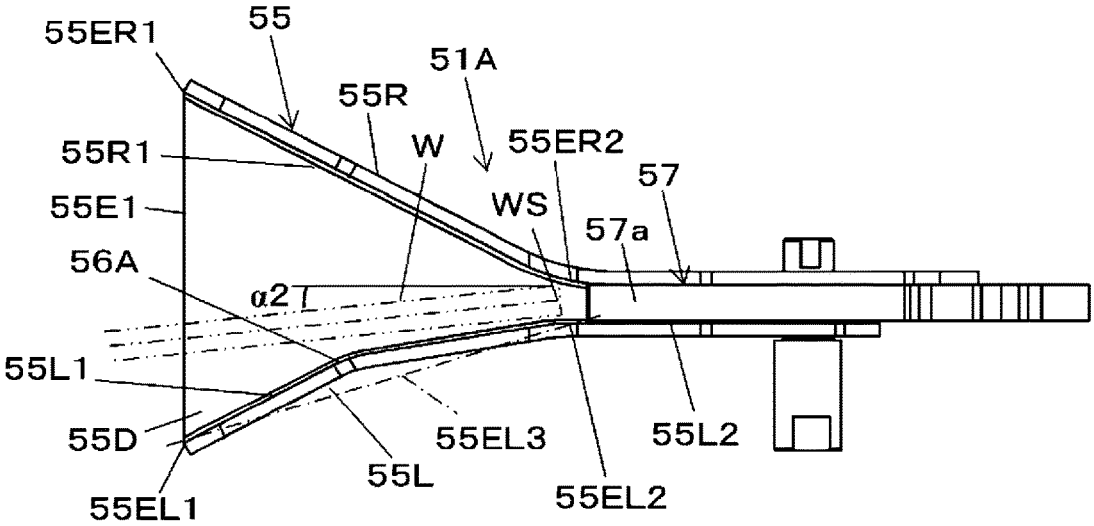
FIG. 39C illustrates movement of the wires in the inductive guide.

FIGS. 39A, 39B and 39C illustrate movement of the wires in the inductive guide. In the below, an operational effect of guiding the wires W by the inductive guide 51A is described.

As described above, the wires W cured by the curl guide 50 are directed toward the other direction that is an opposite direction to one direction in which the reel 20 is offset. For this reason, in the inductive guide 51A, the wires W entering between the side surface part 55L and the side surface part 55R of the first guide part 55 are first introduced toward the third guiding part 55R1 of the side surface part 55R.

As described above, when the length in the long axis direction is about equal to or greater than 75 mm and equal to or less than 100 mm, on the assumption that the locus of wires W curled to form the loop Ru by the curl guide 50 is an ellipse, an entry angle $\alpha 1$ of the wires W entering toward the third guiding part 55R1 of the side surface part 55R increases, as compared to the reinforcing bar binding machine of the related art.

For this reason, when the tip ends WS of the wires W entering toward the third guiding part 55R1 of the side surface part 55R of the inductive guide 51A come into contact with the third guiding part 55R1, a resistance increases upon guiding of the tip ends WS of the wires W along the third guiding part 55R1. Therefore, a feeding defect that the wires W are not directed toward between the narrowest part 55EL2 of the first guiding part 55L1 and the narrowest part 55ER2 of the third guiding part 55R1 may occur.

Therefore, the entry angle regulation part 56A is provided to cause the tip ends of the wires W entering toward the third guiding part 55R1 of the side surface part 55R to be directed toward between the narrowest part 55EL2 of the first guiding part 55L1 and the narrowest part 55ER2 of the third guiding part 55R1.

That is, when the wires W entering between the side surface part 55L and the side surface part 55R of the first guide part 55 are introduced toward the third guiding part 55R1 of the side surface part 55R, the wires W at a part located between the side surface part 55L and the side surface part 55R come into contact with the entry angle regulation part 56A, as shown in FIG. 39B. When the wires W come into contact with the entry angle regulation part 56A, a force of rotating the wires W in a direction in which the tip ends WS of the wires W are caused to be directed toward between the narrowest part 55EL2 of the first guiding part 55L1 and the narrowest part 55ER2 of the third guiding part 55R1 is applied to the wires W with the entry angle regulation part 56A as a support point.

Thereby, as shown in FIG. 39C, an entry angle $\alpha 2$ of the wires W ($\alpha 2<\alpha 1$) entering toward the third guiding part 55R1 of the side surface part 55R decreases and the tip ends WS of the wires W are directed toward between the narrowest part 55EL2 of the first guiding part 55L1 and the narrowest part 55ER2 of the third guiding part 55R1. Therefore, the wires W curled by the curl guide 50 can be introduced between the pair of second guiding part 55L2 and fourth guiding part 55R2 of the first guide part 55.

REFERENCE SIGNS LIST

1A, 1B, 1C . . . reinforcing bar binding machine, 10A . . . main body part, 2A . . . magazine (accommodation unit), 14A . . . control unit (parallel alignment state estimation means) 14B, 14C . . . control unit, 16A . . . current detection unit (parallel alignment state estimation means), 20 . . . reel, 21 . . . hub part, 22, 23 . . . flange part, 3A . . . wire feeding unit, 30L . . . first feeding gear (feeding member), 31L . . . tooth part, 32L . . . groove portion, 30R . . . second feeding gear (feeding member), 31R . . . tooth part, 32R . . . groove portion, 33 . . . feeding motor, 36 . . . first displacement member, 37 . . . second displacement member, 38 . . . spring, 4$A_1$ . . . first wire guide, 4$A_2$ . . . second wire guide, 5A . . . curl forming unit, 50 . . . curl guide, 51A, 51B, 51C, 51D, 51E . . . inductive guide, 53 . . . retraction mechanism, 53*a* . . . first guide pin, 53*b* . . . second guide pin, 53*c* . . . third guide pin, 55 . . . first guide part, 55L . . . side surface part, 55R . . . side surface part, 55D . . . bottom surface part, 55L1 . . . first guiding part, 55L2 . . . second guiding part, 55R1 . . . third guiding part, 55R2 . . . fourth guiding part, 55S . . . converging passage, 55E1 . . . opening end portion, 55E2 . . . narrowest part, 55EL1 . . . opening end portion, 55ER1 . . . opening end portion, 55EL2 . . . narrowest part, 55ER2 . . . narrowest part, 55EL3 . . . virtual line, 56A, 56B, 56C . . . entry angle regulation part, 57 . . . second guide part, 57*a* . . . guide surface, 58A, 58B, 58C, 58D, 58E . . . parallel alignment regulation part, 6A . . . cutting unit, 60 . . . fixed blade part, 61 . . . movable blade part, 62 . . . transmission mechanism, 7A . . . binding unit, 70 . . . engaging member, 70L . . . first movable engaging member, 70R . . . second movable engaging member, 70C . . . fixed engaging member, 71 . . . actuating member, 71*a* . . . opening/closing pin, 71*b*1 . . . bending part, 71*b*2 . . . bending part, 72 . . . rotary shaft, 73 . . . opening/closing guide hole, 74 . . . rotation regulation part, 8A . . . drive unit, 80 . . . motor, 81 . . . decelerator, 9A, 9B . . . feeding regulation unit, 90 . . . parallel alignment regulation part, 100 . . . parallel alignment detection sensor, 110 . . . parallel alignment releasing member, 111 . . . drive unit, W . . . wire

The invention claimed is:

1. A binding machine comprising:

a wire feeding unit configured to feed two wires to be wound on an object to be bound;

a binding unit comprising at least a pair of engaging members which are openable and closable, the binding unit configured to twist the two wires engaged by closing the pair of the engaging members; and a controller configured to execute an operation of releasing a parallel alignment state of the two wires in an opening/closing direction of the pair of engaging members, wherein the controller is configured to estimate a parallel alignment state of the two wires passing between the pair of engaging members, and wherein when it is estimated that the two wires are aligned in parallel in the opening/closing direction of the pair of engaging members, the controller executes the operation of releasing the parallel alignment state of the two wires in the opening/closing direction of the pair of engaging members.

2. The binding machine according to claim 1, wherein the controller is configured to estimate that the two wires are aligned in parallel in the opening/closing direction of the pair of engaging members, in accordance with a load to be applied to the pair of engaging members.

3. The binding machine according to claim 1, further comprising a current detection sensor configured to detect current flowing through a motor configured to drive the binding unit, wherein the controller is configured to estimate that the two wires are aligned in parallel in the opening/closing direction of the pair of engaging members, based on the current detected by the current detection sensor.

4. The binding machine according to claim 3, wherein the controller is configured to switch a threshold value of current for estimating that the two wires are aligned in parallel in the opening/closing direction of the pair of engaging members.

5. The binding machine according to claim 1, further comprising a parallel alignment detection sensor configured to detect a parallel alignment state of the two wires passing between the pair of engaging members, wherein when it is estimated that the two wires are aligned in parallel in the opening/closing direction of the pair of engaging members based on a parallel alignment state of the wires detected by the parallel alignment detection sensor, the controller executes the operation of releasing the parallel alignment state of the two wires in the opening/closing direction of the pair of engaging members.

6. The binding machine according to claim 1, wherein when the controller closes the pair of engaging members and estimates that the two wires are aligned in parallel in the opening/closing direction of the pair of engaging members, the controller executes the operation of releasing the parallel alignment state of the two wires in the opening/closing direction of the pair of engaging members by opening the pair of engaging members.

7. The binding machine according to claim 1, wherein when the controller closes the pair of engaging members and estimates that the two wires are aligned in parallel in the opening/closing direction of the pair of engaging members, the controller executes the operation of releasing the parallel alignment state of the two wires in the opening/closing direction of the pair of engaging members by opening/closing the pair of engaging members.

8. The binding machine according to claim 1, wherein when the controller estimates that the two wires are aligned in parallel in the opening/closing direction of the pair of engaging members, the controller executes the operation of releasing the parallel alignment state of the two wires in the opening/closing direction of the pair of engaging members by feeding the two wires.

9. The binding machine according to claim 1, further comprising a parallel alignment releasing member configured to come into contact with at least one of the two wires passing between the pair of engaging members and to release the parallel alignment state of the two wires in the opening/closing direction of the pair of engaging members.

10. A binding machine comprising:

a wire feeding unit configured to feed two wires to be wound on an object to be bound;

a binding unit comprising at least a pair of openable/closable engaging members, the binding unit configured to twist the two wires engaged by closing a pair of the engaging members; and a controller configured to execute an operation of closing and then opening the pair of engaging members, and again closing the pair of engaging members before twisting the wires by the binding unit.

* * * * *